United States Patent [19]

Allen et al.

[11] 4,222,564

[45] Sep. 16, 1980

[54] AUTOMATED SCORING TARGET SYSTEM

[75] Inventors: Donnie E. Allen; Robert Kilmer, both of St. Petersburg; Thomas L. Guy, Brandon; Wesley C. Fosnow, St. Petersburg, all of Fla.

[73] Assignee: ABA Electromechanical Systems, Inc., Pinellas Park, Fla.

[21] Appl. No.: 806,309

[22] Filed: Jun. 13, 1977

[51] Int. Cl.[2] ..... F41J 5/00

[52] U.S. Cl. ..... 273/369; 273/372; 273/371; 273/406

[58] Field of Search ..... 273/102.2 R, 102.2 A, 273/102.2 B, 102.2 S, 105.2, 105.6; 35/25

[56] References Cited

U.S. PATENT DOCUMENTS

| | | | |
|---|---|---|---|
| 2,916,289 | 12/1959 | Zito | 273/102.2 S |
| 3,034,788 | 5/1962 | Cauble | 273/105.6 |
| 3,233,904 | 2/1966 | Gillam et al. | 273/102.2 S |
| 3,323,800 | 6/1967 | Knight | 273/102.2 R |
| 3,392,979 | 7/1968 | Wilska | 273/102.2 S |
| 3,479,032 | 11/1969 | Ohlmund et al. | 273/102.2 R |
| 3,499,651 | 3/1970 | Hubbard | 273/102.2 R |
| 3,515,388 | 6/1970 | Zachmeier | 273/105.6 |
| 3,550,941 | 12/1970 | Spire | 273/102.2 R |
| 3,578,327 | 5/1971 | Pickell | 273/102.2 R |
| 3,682,478 | 8/1972 | Knight | 273/102.2 S |
| 3,690,661 | 9/1972 | Scharz et al. | 273/102.2 R |
| 3,705,725 | 12/1972 | Thalmann | 273/102.2 A |
| 3,733,073 | 5/1973 | Gutler | 273/105.6 X |
| 3,737,166 | 6/1973 | Knight | 273/102.2 S |
| 3,788,748 | 1/1974 | Knight et al. | 356/141 |
| 3,802,098 | 4/1974 | Sampson et al. | 273/102.2 X |
| 3,805,030 | 4/1974 | Wichinsky | 273/102.2 S X |
| 3,865,373 | 2/1975 | Knight | 273/105.2 |

FOREIGN PATENT DOCUMENTS

| | | | |
|---|---|---|---|
| 1009068 | 5/1957 | Fed. Rep. of Germany | 273/102 S |

OTHER PUBLICATIONS

Operator's Handbook for Day Record Fire Range Target System, Jan. 1977.

Department of the Army Technical Manual, TM-69-20-203-14, May, 1972.

*Primary Examiner*—William H. Grieb

*Attorney, Agent, or Firm*—Kerkam, Stowell, Kondracki & Clarke

[57] ABSTRACT

A computer controlled automatic target system is disclosed which may be implemented on a fixed range or selectively deployed in the field. The fixed range system utilizes land line connections to the target and hit sensor assemblies. The portable field control embodiment incorporates a radio adapter unit which provides a two-way telemetry link between the control console and the target and hit sensor assemblies. The targets are provided with a fixed base or a disk-shaped sled. The targets utilizing the sled are adapted to be pulled across the terrain by a winch system. Both target mounting systems incorporate a base shield adapted to protect the target control and hit sensor assemblies. The hit sensor subsystem registers hits by ammunition or laser beam. Data from the hit sensor and control of the target silhouette between an up or down position is accomplished via communication links between the targets and the control console.

53 Claims, 38 Drawing Figures

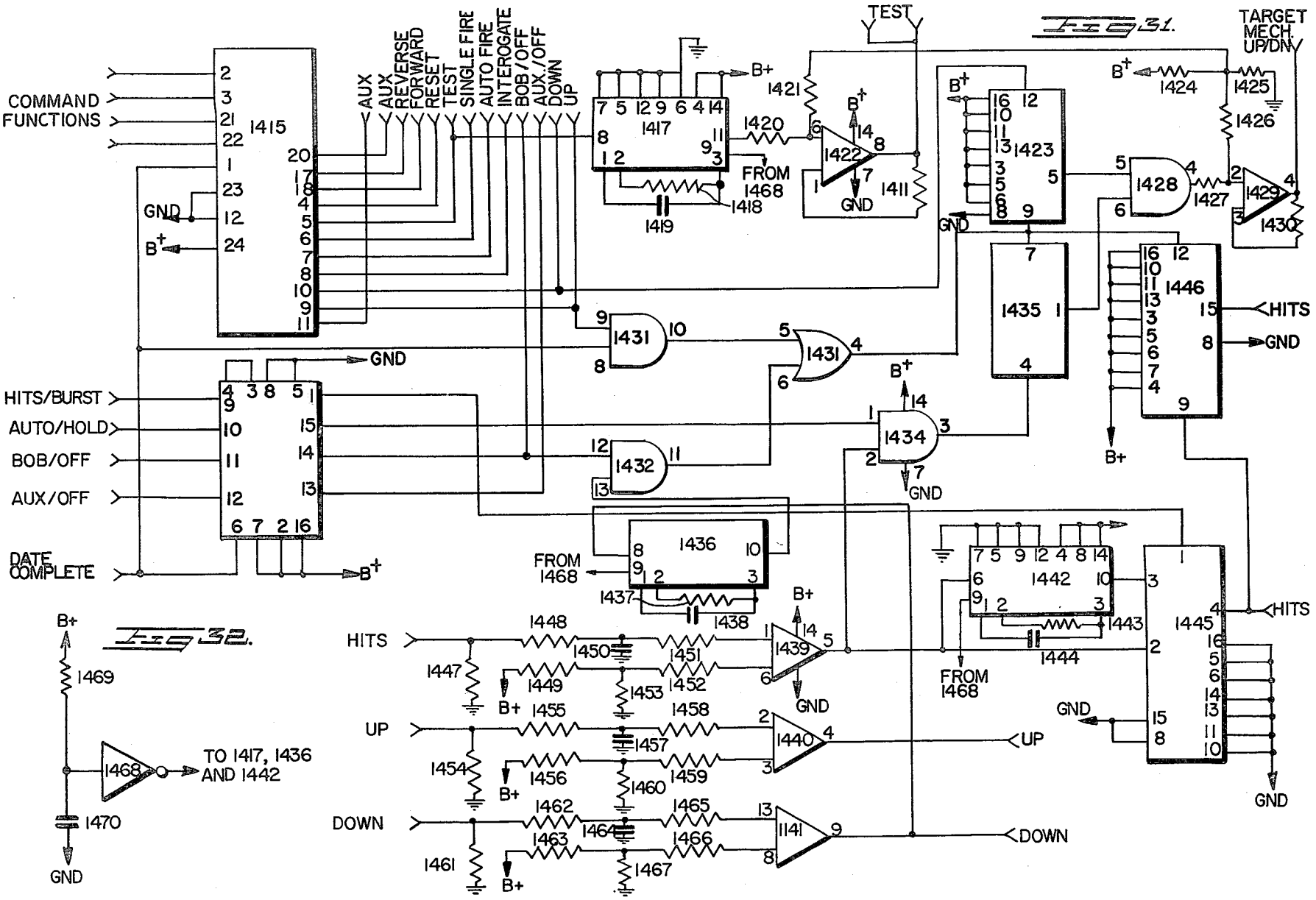
TARGET MECH UP/DN
HITS
GND
B+
TEST
FROM 1468
UP
DOWN
AUX
REVERSE
FORWARD
RESET
TEST
SINGLE FIRE
AUTO FIRE
INTERROGATE
BOB/OFF
AUX/OFF
COMMAND FUNCTIONS
HITS/BURST
AUTO/HOLD
BOB/OFF
AUX/OFF
DATE COMPLETE
TO 1417, 1436 AND 1442

TARGET 1 UP/DOWN
TARGET 2 UP/DOWN
TARGET 3 UP/DOWN
TARGET 4 UP/DOWN
FLASHER
HOSTIL FIRE SIMULATOR
HITS
UP
B+
GND
JOINS FIG. 33A

CODE 110110
□ = 2.5 M SEC
DATA IN J1-2 TO 1220 PIN 7
OUTPUT 1224 PIN 10
OUTPUT 1225 PIN 10
15 M SEC.
5 M SEC.
10 M SEC.
ONE M SEC.
1
0
1
0
1
0
DATA
TIMING PULSE
SHIFT PULSE

AUTOMATED SCORING TARGET SYSTEM

FIELD OF THE INVENTION

This invention relates to a target system for training personnel in the use of rifles, hand guns and similar weapons by providing both fixed and movable targets that may be remotely controlled and are adapted to provide hit data to a centralized control and score keeping system.

DESCRIPTION OF THE PRIOR ART

In the prior art, various target systems are provided where the impact of a projectile on a target creates a shock wave that is sensed via a communications link at a counting station. Prior target systems also provide means to transport targets through the fire zone by mounting the targets on a small dolly and pulling the dolly over a railway. The prior art systems utilizing movable targets require significant predeployment planning and installation, precluding their use as portable systems capable of rapid installation in the field.

Existing small arms target training mechanisms have utilized inertial sensitive electro-mechanical switches to detect the impact of projectiles on a man-sized plastic target. The inertial switch of the prior art systems are sensitive to environmental conditions, activation from debris, wind gusts and near misses, and are difficult to adjust over a wide range of operating conditions.

The inertial switches have been applied in target mechanisms which are expensive, heavy, difficult to maintain, and exhibit low reliability. These mechanisms have been controlled by electronic controls with limited flexibility as to useage and capacity in fixed and portable applications. The designs of the mchanisms are implemented with outdated technology and materials.

The small arms moving target training devices which utilize rails or tracks to support and guide the moving targest are difficult and expensive to install, and require considerable maintenance. They are sensitive to environmental conditions and are difficult to keep operating. The rail or track systems are not usually portable and require extensive range preparation and setup time. Furthermore the targets which move on these rails or tracks do not follow the natural terrain of the range site, they move above the ground level with an artificial smoothness and linerarity, thus failing to achieve the desired realistic illusion of a running person.

OBJECTIVES OF THE INVENTION

A primary objective of the invention is to provide an automated, scoring target system incorporating moving targets that may be field deployed with a minimum of pre-deployment preparation.

Another objective of the invention is to provide a target system incorporating a computer controlled training sequence of target presentation.

A still further objective of the installation is to provide an automated scoring target system incorporating a control console which will provide for manual or automatic operating modes.

A further objective of the invention is to provide a scoring target system which will produce a hard copy performance print out.

A still further objective of the invention is to provide a target system that incorporates a real-time status display of all targets within the system.

Another objective of the invention is to provide a fully automated scoring target system which incorporates fault isolation test concept.

A further objective of the invention is to provide a fully automated scoring target system in which communication between targets and control is provided by radio telemetry links.

A further objective of the invention is to provide a target system which may be operated from portable battery packs.

A still further objective of the invention is to provide a target system wherein targets are mounted on dish shaped sleds adapted to be towed over unprepared terrain.

Another objective of the invention is to provide a portable, field combat, automated scoring target system incorporating means to charge portable battery packs.

A further objective of the invention is to provide a target system wherein each target incorporates a solid state, sealed, projectile protected hit sensor and target deployment apparatus.

A still further objective of the invention is to provide a scoring target system incorporating a night light and return fire simulator.

A further objective of the invention is to provide a target system which incorporates a hostile fire simulator.

It is a still further objective of the invention to provide a fully automated, scoring target system incorporating silhoutte and three dimensional targets responsive to laser simulated fire or live fire.

Another objective of the invention is to provide a fully automated target scoring system which is compact, lightweight and field deployable without site preparation.

A further objective of the invention is to provide an automated scoring target system utilizing plug-in programmable read-only memory systems for program changes.

A still further objective of the invention is to provide a small arms target training system which eliminates the need for inertial switches and hit sensing mechanisms through the use of piezoelectric accelerometers.

Another objective of the invention is to provide an improved hit detector process or target mechanism and control system adapted to provide maximum impact discrimination in a reliable, low cost and versatile design.

A further objective of the invention is to provide a solid state detector which senses target acceleration at the natural frequency of the target holder and discriminates the signal of a rifle projectile hitting the target from false signals generated from debris, wind gusts and near misses.

It is a further objective of the invention to provide a false signal time domain filtering means responsive to frequency and amplitude.

Another objective of the invention is the use of small, high speed, DC motors to drive a walking-crane linkage target actuator.

A still further objective of the invention is the improvement of reliability and maintainability of target mechanisms while reducing cost by design of the actuator as a simple walking-crane mechanism and use of solid state hit sensors and motor control circuitry for the drive motor.

Another objective of the invention is to use a small computer to increase the capability and capacity of control of the target mechanisms while reducing cost and complexity of the electronic controls and simplifying the operation of the system.

A further objective of the invention is the design of a remote radio control system to enable use of the target mechanisms in field simulation exercises.

A further objective of the invention is a radio controller featuring expanded target control capability which can identify individual targets via a changeable address selector.

A further objective of the invention is to provide two-way communications of data between target and controller and improve selectivity and rejection of RF interference by use of a dual tone discriminator circuit.

Another objective of the invention is the improvement of moving target devices to provide a small arms training system with maximum realism.

A still further objective of the invention is to provide a moving target system with a minimum of environmental sensitivity so that it can be operated effectively in mud, snow, rain, hail, wind, heat and extreme cold with little or no change in operating parameters.

Another objective is to provide a moving target system having maximum portability so that it can be set up and operated within a very short time in a wide variety of natural terrains with a minimum of range preparation.

Another objective of the invention is to provide a system with simple, highly reliable components to minimize maintenance and to provide that such maintenance which is required can be performed quickly and inexpensively.

The foregoing and other objectives of the invention will become apparent in light of the drawings, specifications and claims contained herein.

SUMMARY OF THE INVENTION

The fully automated scoring target system disclosed herein is comprised of a control console and a plurality of target mechanisms. The control console may be a fixed installation test range control incorporating a display panel adapted to indicate the status of all targets in the system and control their deployment. This console also provides selection of the type of operation to be initiated and means to provide a hard copy print out for scoring purposes.

The system includes an alternate control console which is a portable radio control unit that functions in combination with a radio adapter. This system provides communication between the targets and the control system at frequency ranges of 30 to 75 MHZ and has an operational range of 4,000 meters. The system utilizes CMOS circuitry for increased battery life and incorporates extensive modular design for improved maintainability. A rechargable battery pack allows for up to 12 hours of operation.

All the targets utilize a target mechanism assembly which is sealed to permit operation in completely submerged conditions. It includes a target lift means which will raise standard military E and F type targets in 40 knot winds. A solid state hit sensor including false signal discriminators and a battery power pack are included within the target mechanism housing.

The hit detection system consists of an accelerometer attached to the target arm and signal processing electronics contained within the target mechanism housing. The hit sensor electronics contain multi-domain filter means which discriminate hits on the basis of amplitude, frequency, and time domain discrimination at a rate up to 2400 rounds per minute.

The target mechanisms are adapted to be mounted on a portable carrier stand which includes a 12 volt battery pack and a radio adapter or on a sled type carrier having a dished configuration to permit towing over rough terrain.

Associated with the target carrier are strobe light systems which simulate automatic or single shot return fire and audio systems adapted to simulate the noise associated with return fire.

A further description of the invention, its objects and advantages are provided in the Operator's Handbook for Day Record Fire Range Target System, Inc., a copy of which has been filed with this application and the subject matter of which is hereby incorporated by reference.

DESCRIPTION OF THE DRAWINGS

FIG. 9 is a schematic diagram of the target walking-crane drive motor control circuit.

FIG. 18 is a diagram of the target assembly interface.

FIG. 19 is a schematic diagram of the hand control unit.

FIG. 26 is a schematic diagram of the receiver register circuit.

FIG. 29 is a schematic diagram of the transmitter register power reset circuit.

FIG. 31 is a schematic diagram of the transmitter target interface.

FIG. 32 is a schematic diagram of the transmitter target interface power reset circuit.

DESCRIPTION OF THE PREFERRED EMBODIMENTS

Figure 1:
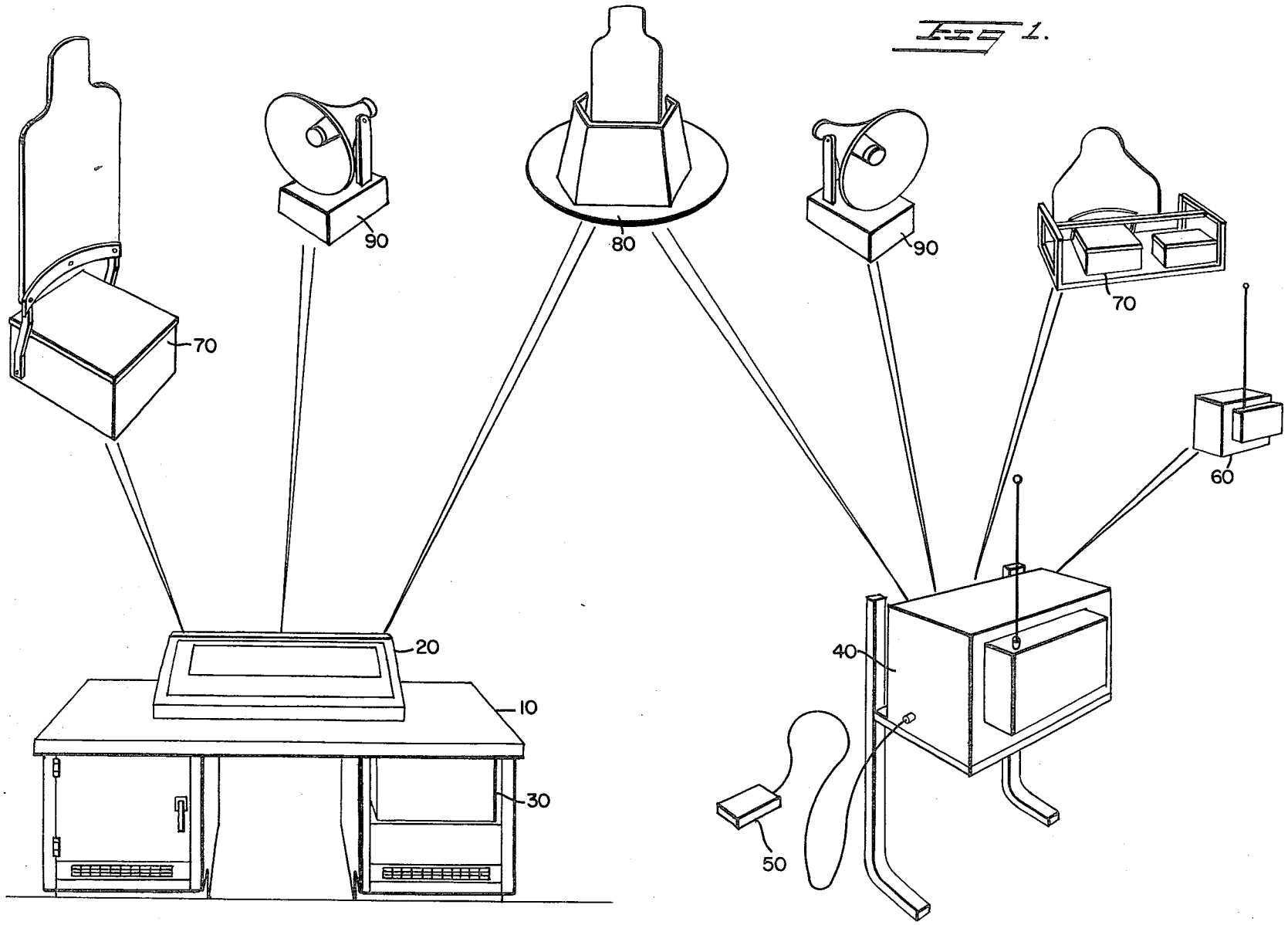
FIG. 1 illustrates the interrelation of the various components comprising the automated scoring target system.

FIG. 1 illustrates the automated scoring target system in both the fixed and portable adaptations. The fixed system utilizes a defense test range control console 10 which incorporates a display control panel 20 and an automatic control module 30.

The portable version of the target system utilizes a remote control unit assembly 40 in place of the defense test range control console 10. The remote control unit 40 is contained on a back pack to allow a single operator to carry the unit into the field. A remote control panel 50 is coupled to the primary electronics on the back pack 40 to permit the operator to monitor the system while wearing the back pack. In the radio controlled system, each target carrier incorporates a separate radio adapter 60 to enable two-way communications of telemetry data and control signals between the back pack 40 and control panel 50 and the individual target mechanisms.

All targets, whether portable or fixed incorporate a hit sensor and a target mechanism 70 which includes means to raise and lower the target.

The permanently installed automated scoring target system utilizes fixed targets that may be secured to trees, concrete beams and other means to permanently affix the target in a predetermined area. The portable system utilizes an aluminum framework to mount the target mechanism and associated components so that two people may carry the individual target units for field deployment.

Both fixed installation and portable installations utilize moving targets 80. These targets incorporate a target mechanism 70 as do the portable targets and fixed targets. Provisions are made in the moving target assemblies to accommodate radio adapters 60 so that the moving targets may be utilized with the portable system as well as with the fixed test range.

All targets may include a hostile fire simulator 90 and a muzzle flash simulator.

Figure 2:
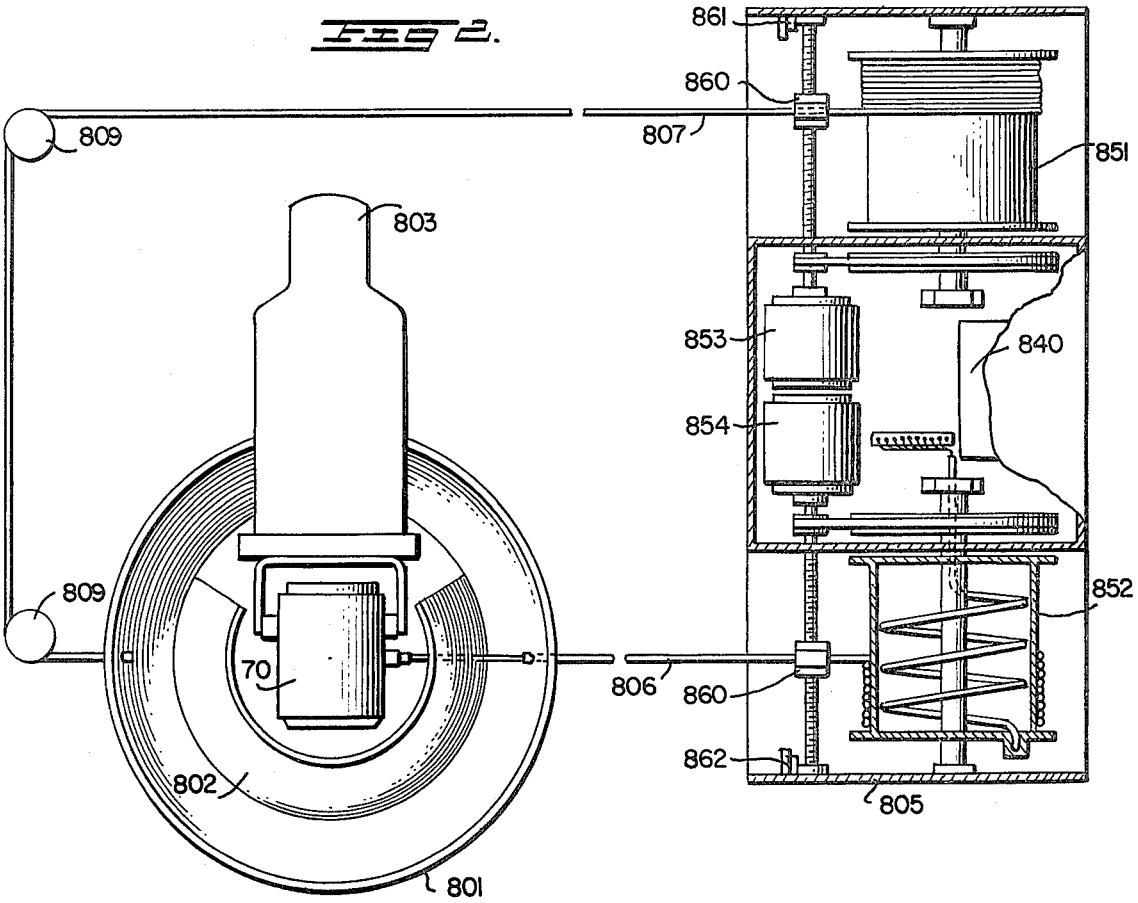
FIG. 2 is a representation of the moving target system.

FIG. 2 illustrates a single moving target system. It is comprised of a circular sled 801 which includes a shield 802 adapted to protect the target mechanism 70. A target body 803 is activated via control arms of the target mechanism. A winch 805 is provided to pull the sled 801 over the terrain via cables 806 and 807.

A plurality of pulleys 809 are utilized to permit a complete loop arrangement whereby cable 807 may be wound upon the winch drum as cable 806 is played out. In an alternate embodiment, two winches are provided at opposite sides of the fire field to eliminate the necessity of pulleys 809. In this alternate embodiment one winch will pull the target across the field while the other winch is free-spooling. After the target has traversed the field, the function of the winches is reversed and the second or earlier free-spooling winch now becomes a driving winch and pulls the target back across the field and the other winch is free-spooling. Slight dynamic breaking may be applied to the free-spooling winch to prevent backlash.

Figure 3:
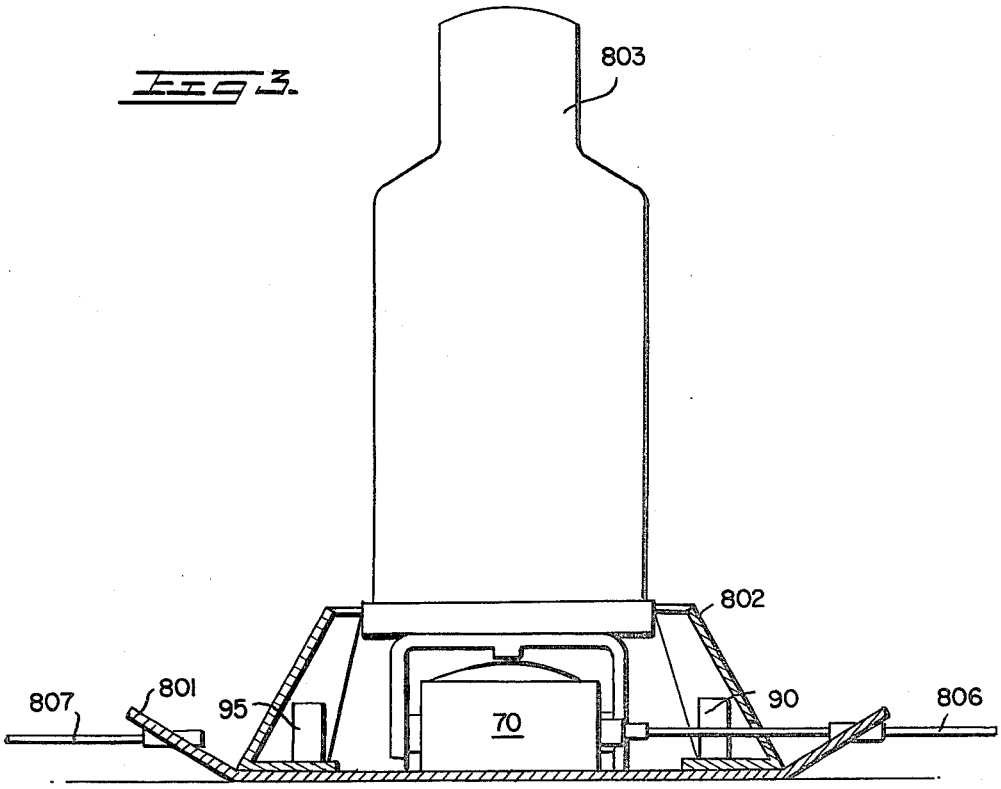
FIG. 3 is a side view of a moving target and sled.

FIG. 3 illustrates the profile of the target sled showing the dish shaped base 801 and angled projectile deflector 802. The base 801 has an upward deflected peripheral section which in a preferred embodiment is inclined 30 to 60 degrees from the horizontal. The target mechanism 70 is positioned so that it is completely shielded by deflector 802. Also protected by deflector 802 is the muzzle flash simulator 95. The piezoelectric accelerometer which is adapted to sense motion of the targets caused by hits is also contained behind the protective screen.

The winches 851 and 852 in assembly 805 of FIG. 2 are adapted to operate on 24 volts DC which may be supplied by a converter in the fixed range installation or by a battery pack in the portable range installation. They are powered by permanent magnet electric motors 853 and 854 adapted to drive a 12 inch outside diameter drum through a timing belt system. Winch 851 pulls the target carrier with a conventional cable and the other winch 852, operates the target carrier through a special cable 806 which also supplies signals and electrical power to the target mechanism in the fixed field installation. The winch drum having the special cable is hollow and the cable is coiled inside to eliminate the need for slip rings. The cable is fed onto the exterior of the drum by a level wind system 860 which operates at motor shaft speed and traverses across the front of the drum. The traversing mechanism is further adapted to operate adjustable limit switches 861 and 862 which signal the winchs to stops at selected distances.

Figure 4:
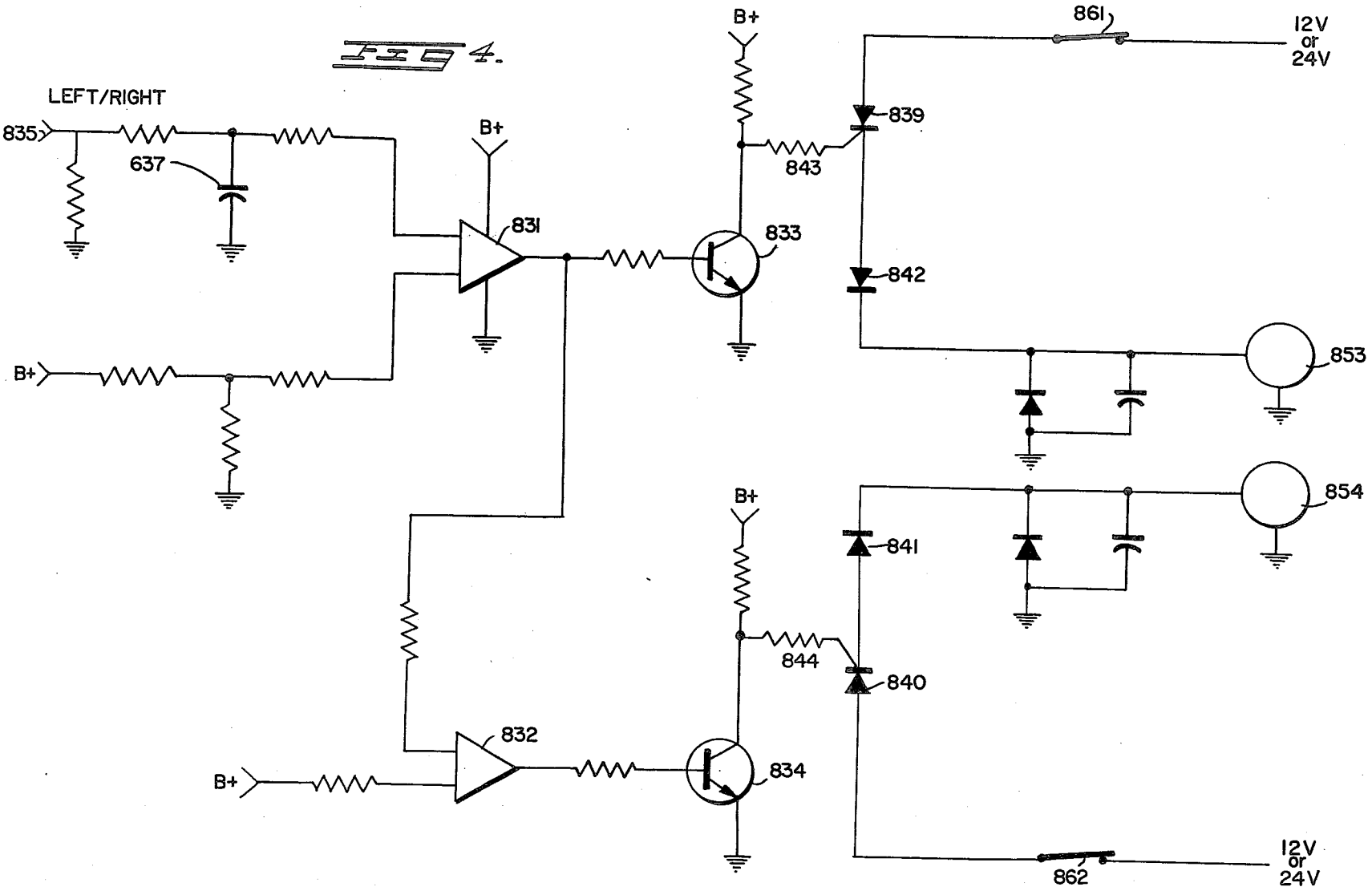
FIG. 4 is a schematic diagram of the moving target winch motor control circuit.

The winch drive motors 853 and 854 are controlled by the motor control circuit illustrated in FIG. 4. The circuit includes a pair of differential amplifiers 831 and 832 which, through transistors 833 and 834 control the application of a positive potential to motors 853 and 854.

Motor control is accomplished when a left or right signal from the control console is applied to amplifier 831 via input jack 835 and the resistive and capacitive filter 637. If the signal is a left drive signal it causes transistor 833 to conduct and gate on SCR 839 through resistor 843 providing limit switch 861 is closed. This provides a positive potential to winch 851 drive motor 853.

When the left limit switch 861 is open by the level wind mechanism 860, SCR 839 drops out and motor 853 is turned off.

When a right signal is applied to input 835, the output of amplifier 831 causes amplifier 832 to turn on SCR 840 via transistor 834 and resistor 844, provided the right limit microswitch 862 is closed. Motor 854 will be energized via SCR 840 and rectifier 841 to drive the target to the right. When the level wound mechanism depresses limit switch 862, the switch opens and drops out SCR 840 and cuts off power to the motor.

Four motor winch speeds are provided by causing the motors to operate at a 12 volt low, 12 volt high, 24 volt low and 24 volt high motor speeds. These speeds relate to 1.3, 1.8, 2.6, and 3.6 meters per second respectively.

The silhouette targets 803 illustrated in FIGS. 2 and 3 are plastic targets known as standard military E and F type. These targets may be replaced by laser responsive targets to enable the system to operate in laser simulation rifle training programs. In this mode of operation the hit sensor system described herein is replaced by a laser responsive system.

Figures 5, 6:
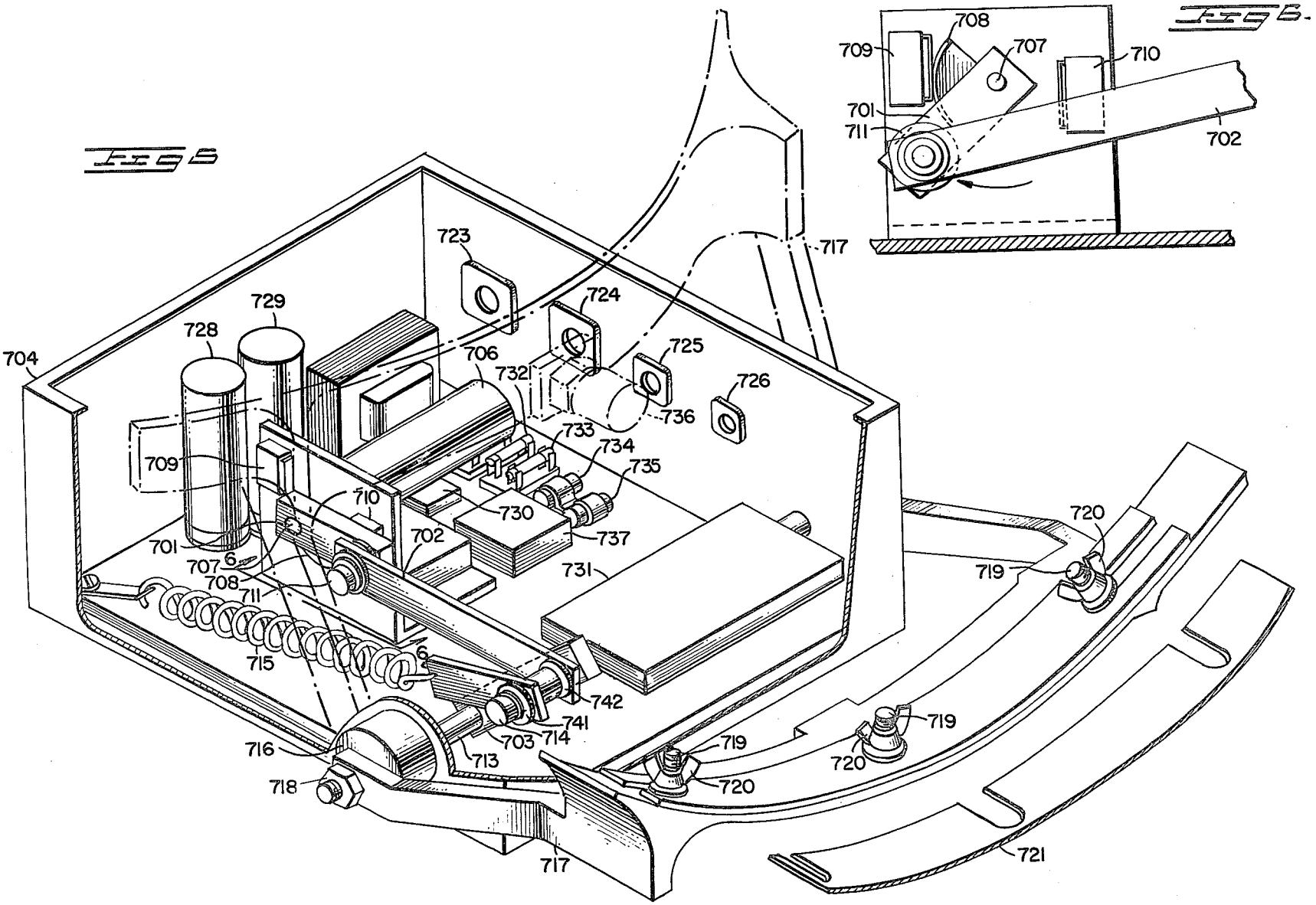
FIG. 5 is a cutaway, perspective view of the target mechanism.
FIG. 6 is a detailed view of the target walking-crane drive.
Figure 7:
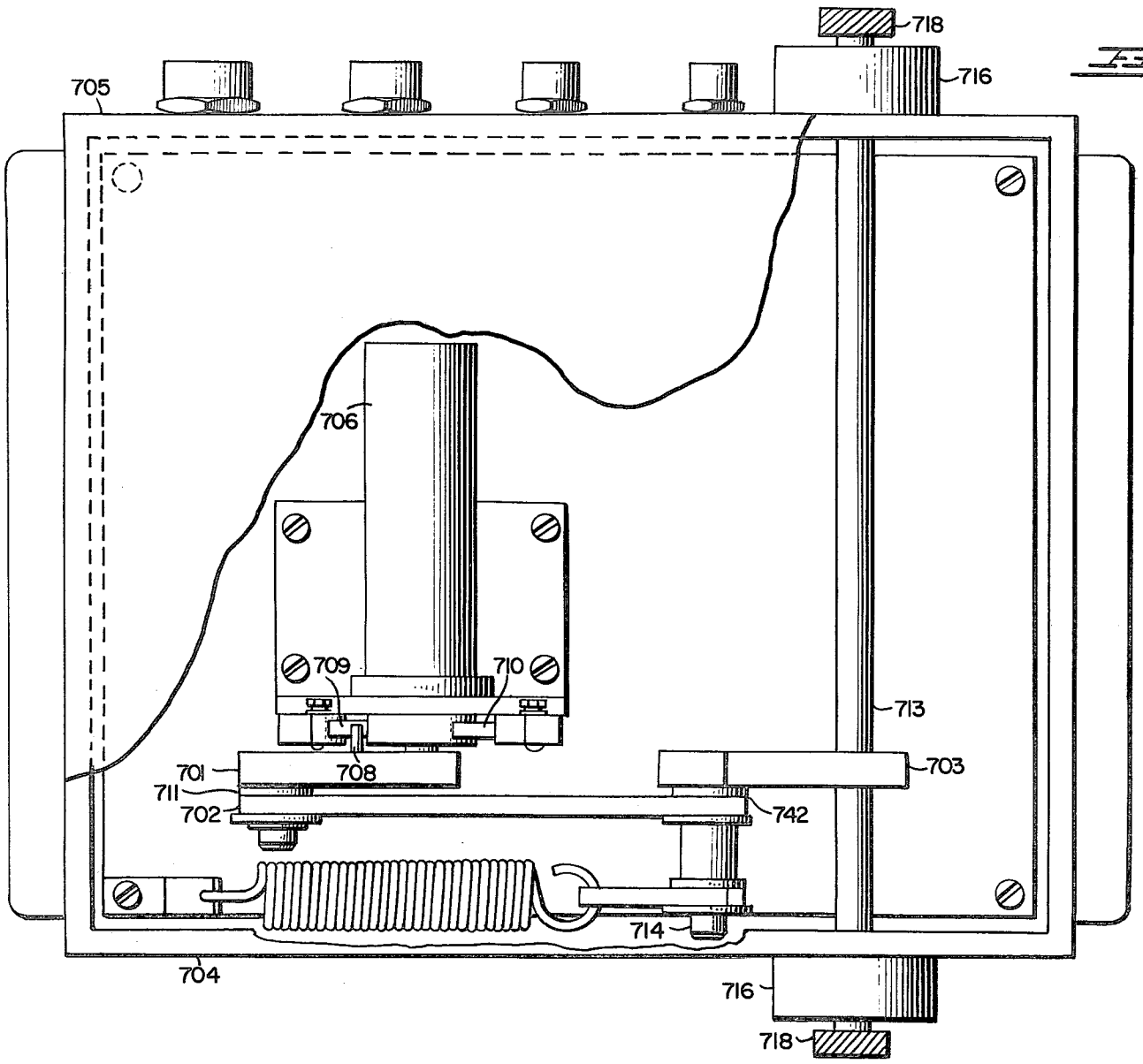
FIG. 7 is a top view of the target walking-crane mechanism.

FIG. 5 illustrates the target mechanism 70 which is contained in all of the various types of target installations used in the system. Raising and lowering of the targets is accomplished by a double link actuator comprised of arms 701, 702 and 703 of FIGS. 5, 6 and 7 contained in housing 704 which is sealed by a lid assembly to provide a waterproof and dustproof container for the electrical systems as well as the mechanical systems. The cover is illustrated as 705 in FIG. 7 which shows various components in cutaway view beneath the cover.

The double link actuator is commonly referred to as a walking crane actuator and it is driven by a high speed DC motor 706. Arm 701 has a cam 708 adapted to open microswitches 709 and 710 which provide up and down limiting functions for the drive control circuitry of motor 706.

A bearing 711 couples arm 701 to arm 702 so that motion is imparted through bearing 742 and shaft 714 to arm 703. This rotates elevating torque rod 713. Shaft 714 is affixed to arm 702 and provides a means to couple arms 707 and 703 to arm 702 via bearings 741 and 742 respectively. Arm 707 provides a bias via spring 715.

Two waterproof and dustproof sealing bearings 716 provide a means through which target support torque rod 713 exits the housing 704. The target support casting 717 is rigidly secured to torque arm 713 by two nuts 718. Three threaded members 719 and wing nuts 720 are used in combination with retainer bar 721 to secure a target to the support assembly. In FIG. 5 the target support assembly is shown in the down position in solid lines and in the up position in dotted lines.

Waterproof and dustproof connectors 723, 724, 725 and 726 are provided to couple power and control signals into the electronics contained in housing 704 and transmit hit data and target condition data to the control systems.

The walking crane of the target mechanism utilizes spring 715 to serve as a counter balance to the target arm 717 when in the down position to reduce the torque requirement for raising the target. The DC motor 706 and actuator provide sufficient torque to raise two E size targets in two seconds with a 20 mile-an-hour wind or a single target in E, F or 3D configuration in 35 mile-an-hour winds. The target actuator will raise all targets within one second in a no wind condition.

The torque arm 713 is provided with sealed bearings 716 which include a secondary gasket seal between the housing and the bearing blocks, and a third moisture seal by creating a grease pocket between the bearing and target mechanism through which grease is inserted via lube fittings to pack the bearings blocks and prevent entry of water in a submerged condition. All of the actuator components are fabricated from stainless steel, including the spring assembly, to assure that no corrosion or rust will deteriorate the target mechanism over the life of the unit.

The electrical components and blocks illustrated within the chasis 704 include the power supply, motor controller, hit electronics and voltage regulator. The power supply is comprised of transformer 727 and capacitor 728 and 729 and other components not illustrated in FIG. 5. A rectififer 730 and voltage regulator 737 are positioned adjacent to motor 706 and the hit electronics is included in sub-assembly 731. The fuses 732 and 733 and capacitors 734 and 735 may be considered as part of the power supply circuitry.

The piezoelectric accelerometer is contained on the target support arm 717 approximately at the center and is indicated by reference designator 736 in FIG. 5.

Figure 8:
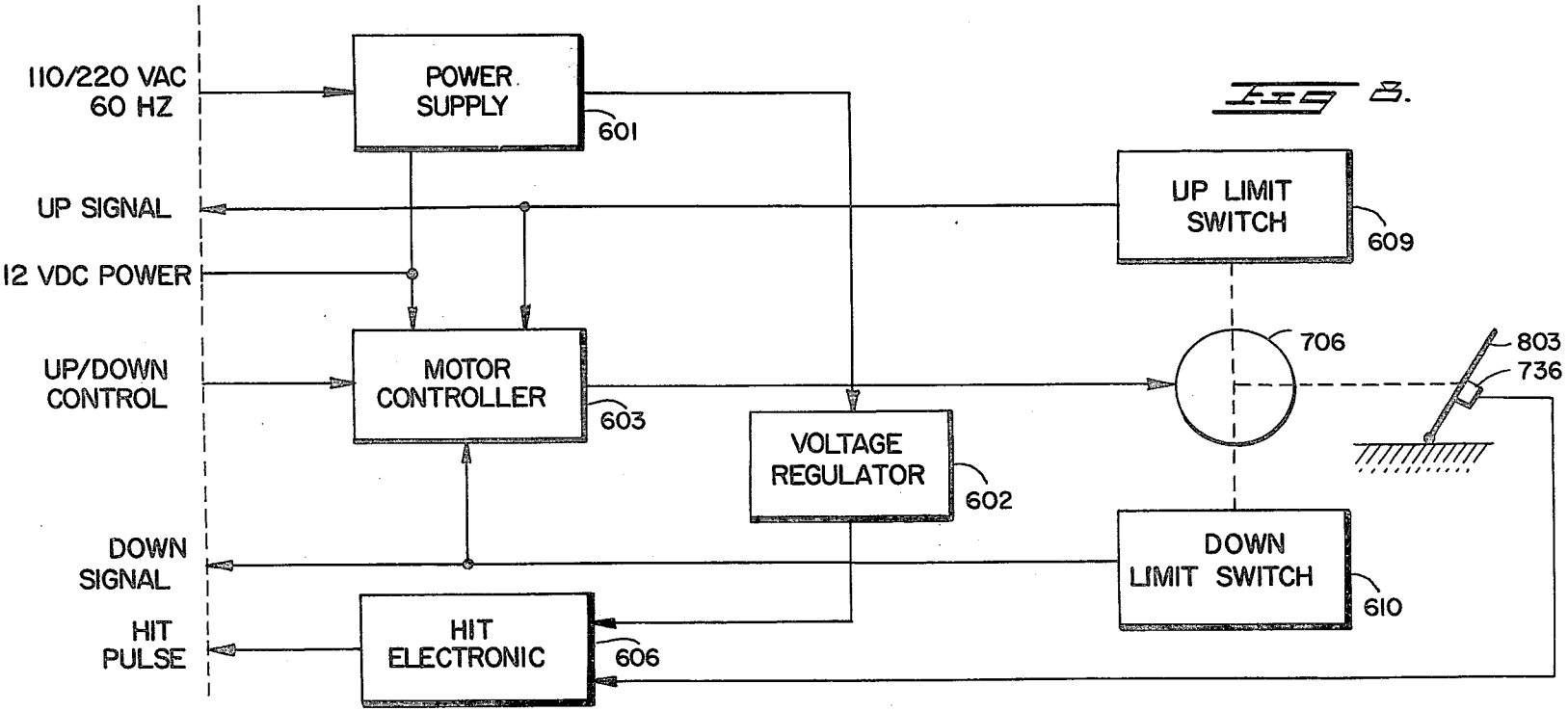
FIG. 8 is a block diagram of the target mechanism electronics.
Figure 6E:
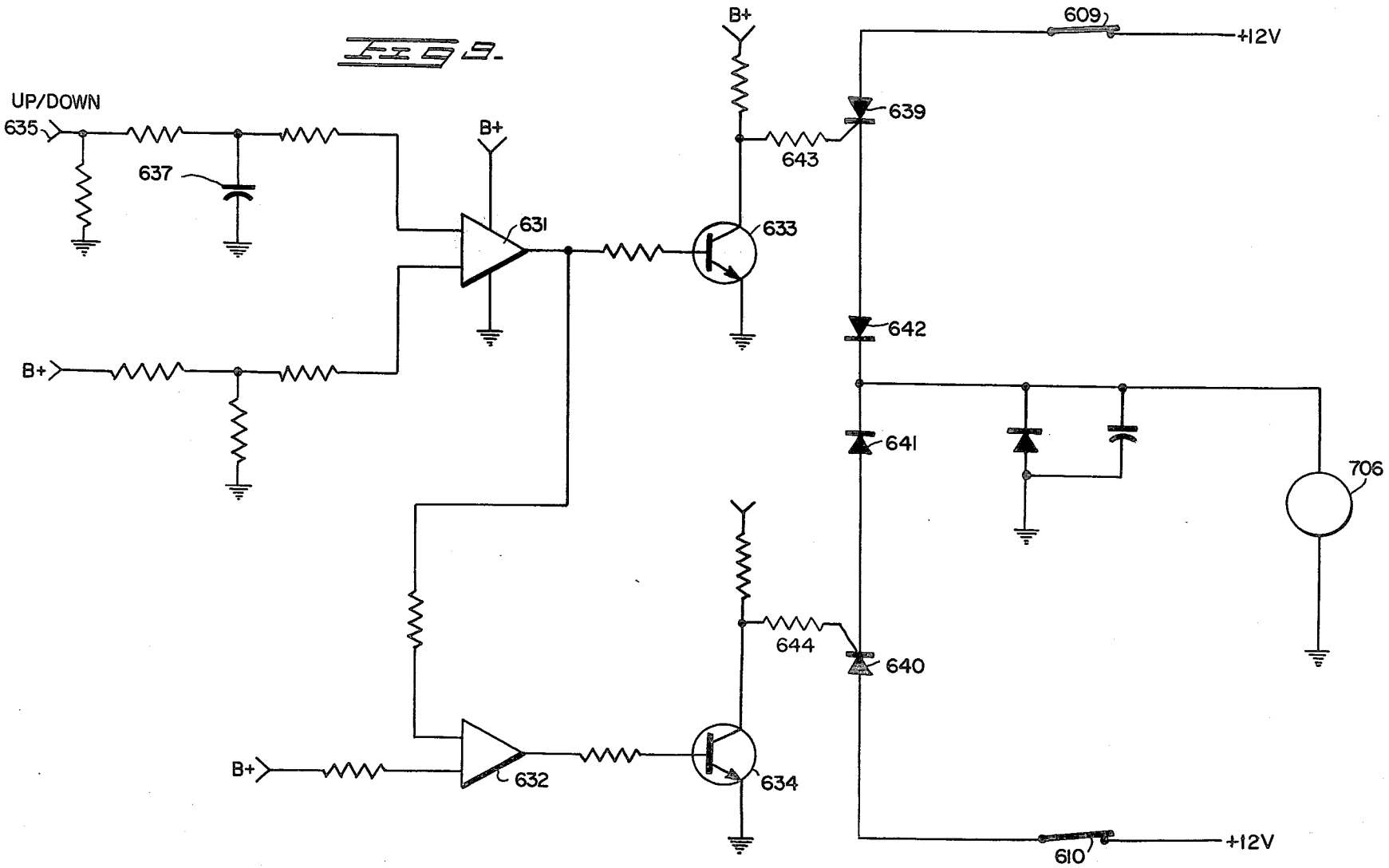

FIG. 8 is a block diagram of the electronic components contained within the target mechanism assembly. These components include power supply 601 which is adapted to receive 120 or 220 volts AC at 60 cycles and provide a 12 volt DC output signal that is applied to voltage regulator 602 and motor control system 603. The motor control system 603 is responsive to an up/-down control provided by the control console or the portable control unit. The up/down control input signal to the motor controller functions to control the application of 12 volts DC via the up/down limit switches 609 and 610 from the power supply or from a battery pack in the portable mode of operation to motor 706.

The hit electronics 606 is responsive to the hit sensor 736 and provides hit pulses to the controller. Power for the hit electronics is derived from voltage regulator 602 which is adapted to provide a closely regulated B volts DC.

FIG. 9 presents a schematic diagram of the motor control circuitry which is adapted to control the target mechanism motor. This circuit is used also to control the winch drive motors, see FIG. 4. It includes a pair of differential amplifiers 631 and 632 which, through transistors 633 and 634, control a positive potential to motor 706.

When an up signal from the control console is applied to amplifier 631 via input jack 635 and the resistive and capacitive filter 637 it produces an output signal which allows transistor 633 to gate on SCR 639 via resistor 643, provided switch 609 is closed. This provides a positive potential to the target drive motor 706. When the up limit switch 709 is opened by the motor cam, SCR 639 drops out and the motor is turned off.

When a down signal is applied to input 635, the output of amplifier 631 causes amplifier 632 to turn on SCR 640 via transistor 634 and resistor 644, provided the down microswitch 610 is in a closed position. Motor 706 will be energized via SCR 640 and rectifier 641 to drive the target to the down position. When the target support arm 717 reaches the full down position, limit switch 710 opens and cuts off power to the motor 706.

Motor 706 rotates in the same direction and provides up and down target deployment alternately as a function of the walking crane transmission.

Figure 10:
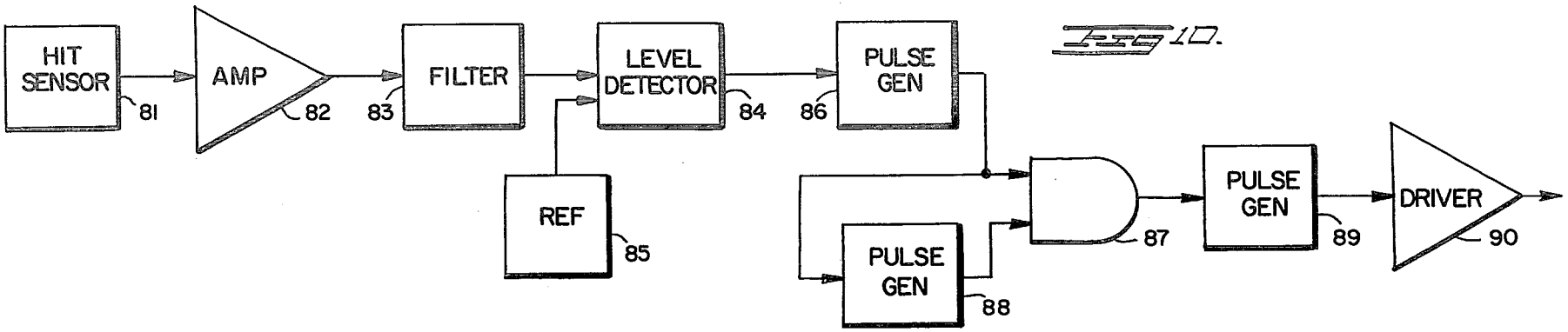
FIG. 10 is a block diagram of the hit system.

The block diagram presented in FIG. 10 illustrates the hit sensor and hit detector electronics. The hit sensor 81 is a solid state piezoelectric accelerometer adapted to sense impact of a projectile penetrating the target by measuring the acceleration or second derivative of the natural resonant vibrations of the target holder 717 of FIG. 5. The output of the sensor 81 is coupled via a cable to the hit sensor assembly within the target mechanism chassis. The signal is applied to amplifier 82 of FIG. 10 which increases the amplitude of the signal to a point where the signal may be processed by notch filter 83. Notch filter 83 selectively filters the signal and rejects all signals except the characteristic target holder frequency. The output of filter 83 is applied to one input of level detector 84 which provides a logic level output for any signals above a preset reference level. The present reference level is developed by a voltage divider network 85. The logic level output of level detector 84 triggers pulse generator 86 which creates an output pulse for the duration of the level detector output plus 5 milliseconds. This lengthend pulse is applied to an inhibit input of gate 87 directly and through a 10 millisecond pulse generator 88. The output of gate 87 is a pulse representing the pulse produced by pulse generator 88 minus the duration of the pulse produced by the level detector extended 5 milliseconds. Thus, if the output of the level detector is 5 milliseconds or more, no output will appear at gate 87.

When an output does appear at gate 87 it is applied to pulse generator 89 which is adapted to provide a 20 millisecond driving pulse to line driver 90. The output of the line driver 90 is coupled to control unit for hit counting and control via land lines or a radio telemetry link depending on the mode of operation of the system.

Figure 11A:
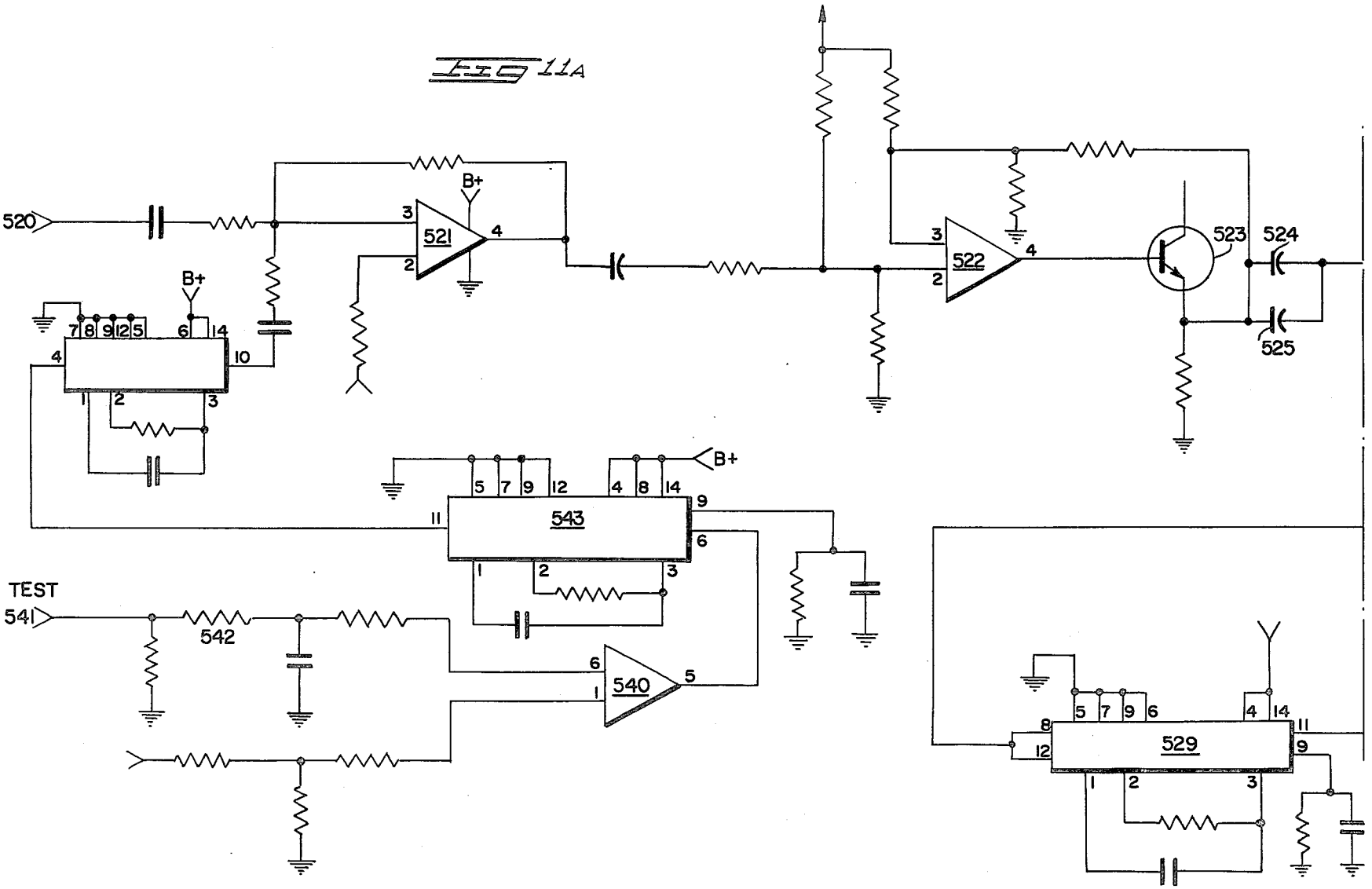
FIGS. 11A and 11B are schematic diagrams of the hit electronics.
Figure 11B:
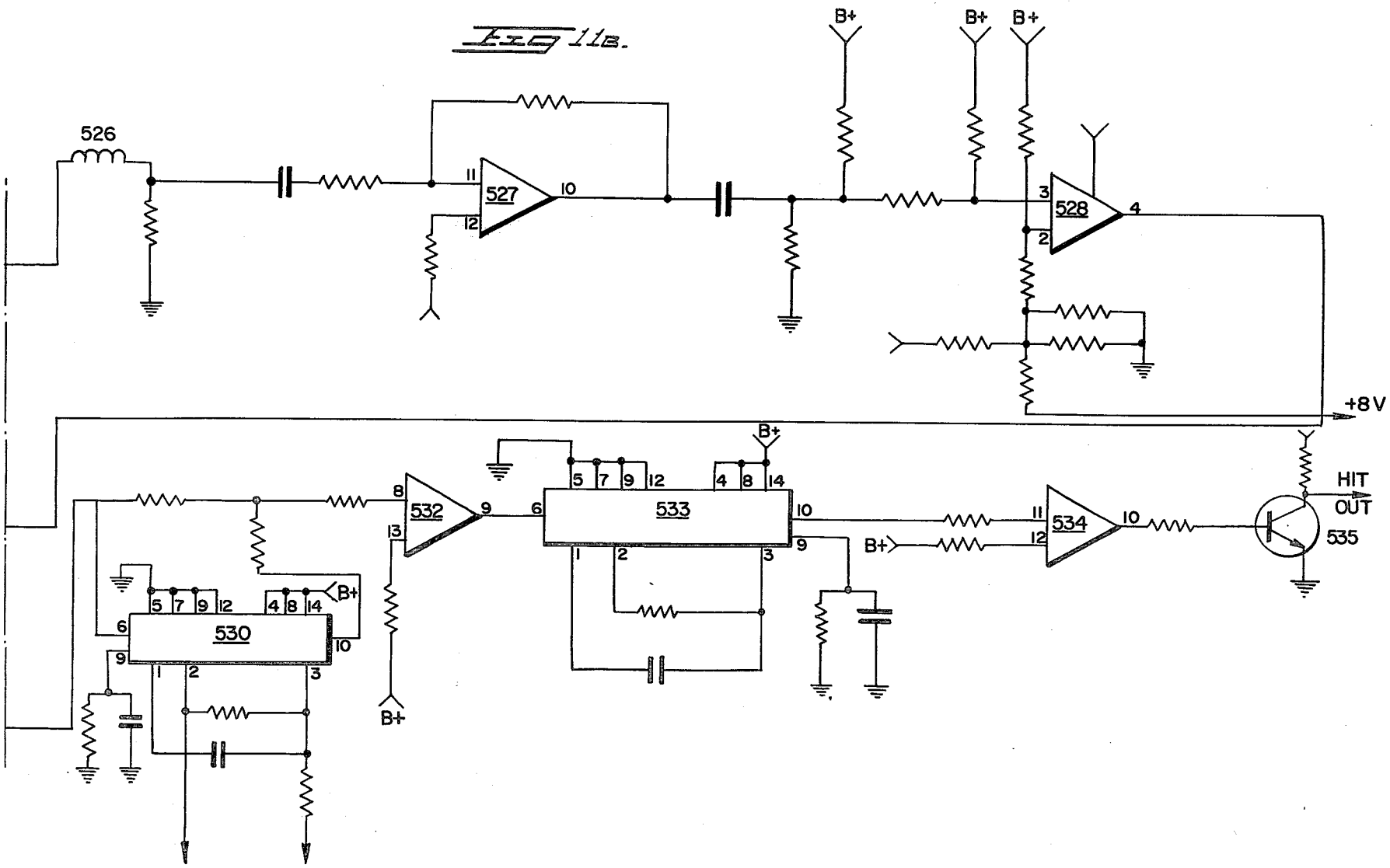

FIGS. 11A and 11B are a schematic diagram of the hit sensor circuitry which more clearly illustrates the functioning of this unit. The output of the transducer is applied to input jack 520 and via an RC coupling and impedance matching network to an input of preamplifier 521. This amplifier controls the level of the input to the following stages and acts as a buffer for the test circuit. The output of preamplifier 521 is capacitively coupled to amplifier 522 which functions as a notch filter in combination with transistor 523 as a result of the negative feedback provided thereby and the LC output choke comprised of capacitors 524 and 525 and inductance 526. The output of inductor 526 is capacitively coupled to amplifier 527 which is adapted to increase the amplitude of the notch filter so that it may be further processed. This amplified signal is capacitively coupled to one input of differential amplifier 528. The other input to differential amplifier 528 is provided from the positive 8 volts DC power source through a resistive ladder. When the output of amplifier 527 is of sufficient amplitude, differential amplifier 528 is caused to conduct and a 5 KHz output signal is applied through a retriggerable multivibrator 529. The retriggerable multivibrator 529 produces a signal which is 5 milliseconds longer than the input signal. This extended signal is applied to differential amplifier 532 but it does not cause the amplifier to conduct due to its polarity. The extended signal is also applied to reference generator 530 which is a one-shot multivibrator adapted to produce an output of predetermined duration, normally 10 milliseconds. This output is also applied to differential amplifier 532 and it is of proper polarity and of sufficient amplitude to cause the amplifier to conduct provided the direct output of the retriggerable multivibrator 529 is not present at the same input to amplifier 532. Thus this circuit serves to block target hit signals having a duration greater than the duration of the output of reference generator 530.

By way of example, if a rock strikes the target it may produce a 6 millisecond output of hit sensor transducer 81. This results in a 6 millisecond burst of a 5 KHZ signal being applied to retriggerable multivibrator 529 which produces an output signal of 11 milliseconds duration in response thereto. The 11 millisecond signal is applied to the reference generator 530 and it produces a 10 millisecond signal. Both the 11 and 10 millisecond signals are applied to the same input of amplifier 532. The 11 millisecond signal inhibits the amplifier and prevents the 10 millisecond signal from being processed further.

If a bullet strikes the target it produces a 2 millisecond signal which causes retriggerable multivibrator 529 to produce a 7 millisecond signal. The 7 millisecond signal is applied to amplifier 532 and to reference generator 530. The reference generator 830 produces a 10 millisecond output which is summed with the 7 millisecond signal at an input to amplifier 532. The 7 millisecond signal inhibits the amplifier but after it passes, the remaining 3 milliseconds of the 10 millisecond signal is applied via 532 to pulse generator 533.

Pulse generator 533 is a one-shot multivibrator which produces a 20 millisecond pulse that is applied to line driver 535 via amplifier 534. The line driver produces a hit signal which is further processed by the scoring system.

The hit electronics is tested by applying an input test signal at 541 from the central console or radio adapter. The signal is coupled to differential amplifier 540 which triggers oscillator 543. Oscillator 543 is a stable multivibrator adapted to produce a 5 KHZ signal for duration of 4 milliseconds when triggered. This signal is converted to a 2 millisecond signal by one-shot multivibrator 544 and applied to amplifier 521 to simulate a rifle bullet hit.

In a preferred embodiment, multivibrators 529, 530, 533, 543 and 544 are RCA integrated circuits CD4047AE, and amplifiers 521, 522, 527, 528, 532, 534 and 540 are National Semiconductor integrated circuits LM2900N.

Figure 12:
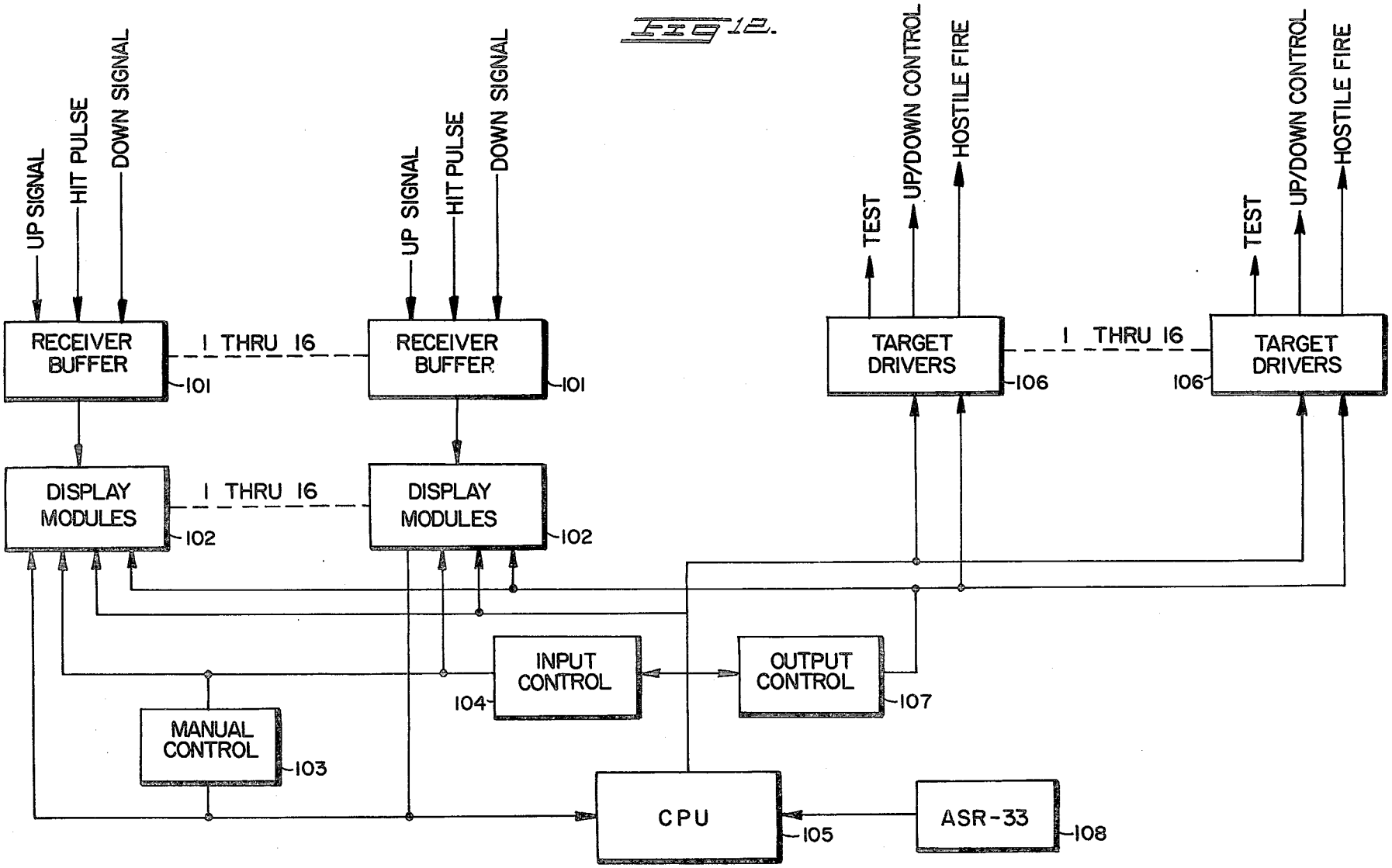
FIG. 12 is a block diagram of the control unit.

The hit output signal or hit pulse is applied to a predetermined receiver buffer 101 of the control console FIG. 12. The receiver buffers 101, are also responsive to up signals and down signals from their associated target mechanisms to provide energizing pulses to the display modules 102. The display modules provide indication as to the status of individual targets and hit data. These modules are responsive to a manual control means 103 or in an automatic mode of operation to input control means 104. Manual control means 103 controls the position of the targets by applying signals through the computer processing unit 105 to the target drivers 106. The target drivers couple test signals, up/down control signals, and hostile fire signals to the individual targets.

When the system is functioning in the automatic mode, the computer programming unit 105 provides the stimulus to the target drivers via output control 107 so that the individual targets receive control signals which are similar to those provided in the manual control mode. The computer processing unit 105 also provides signals via the input control means 104 to the display modules. Thus the display modules accurately indicate the ordered status of the targets as a function of either manual control 103 or input control 104 as controlled by the computer processing unit 105 and the ordered target data is coupled to the individual targets via target drivers 106 as a function of manual control 103 and computer processing unit 105 or alternately by computer processing unit 105 and output control 107.

When hits are received by the receiver buffers 101, the hit data is channeled through the display modules and then through the computer processing unit which is coupled to printer 108. Printer 108 is adapted to provide hard copy print out of hit data when so ordered or, alternately, to program the computer processing unit.

The computer programming unit 105 is pre-programmed to automatically operate the complete field of targets in a predetermined sequence while recording all hits, operations, possible failures, and providing a complete printed record of the hits by operation of the printer 108.

The computer processing unit 105 functions by transmitting a 12 bite paralled address word, and transmits and receives 12 bite data words. An address word is identified by a true or one level in bite 12. The address is located in bites 0 through 7. Data words are identified by a 0 or false in bite 12 and the data is contained in bites 0 through 7. Output control 107 receives address words from the computer, stores the present address word, decodes the address, and provides a signal to the control line of the appropriate input and/or output units.

The input control 104 provides control for multiplexing the inputs into the common input bus to the processor. The target drivers 106 provides storage for the up/down, test and hostile fire command words for up to eight target mechanisms from the computer processor 105 under control of the output control 107. They also provide the line drivers which forward the control signals to the individual target mechanisms.

The receiver buffers 101 process the up, down, and hit indications for up to eight target mechanisms per buffer.

The display modules 102, display the up, down, and hit status of each of the target mechanisms as well as the total hit count on a target mechanism connected through the receiver buffer. The display modules 102 also multiplex the received data onto the computer bus for input to the computer.

Manual control 103 provides a means to select the mode of operation. It also provides a means to disable any specific target from operation and further provides a complete manual control of any or all targets without computer functioning of the computer processing unit.

The remote radio control unit provides for manual control of the target mechanisms deployed in the portable target system. The remote radio control system consists of the remote control unit and a radio adapter unit for each target to provide two-way communication between target and control station. The remote control unit provides for control and selection of up to ninty-nine targets while the radio adapter unit returns status and hit data, upon command to the control station.

Figure 13:
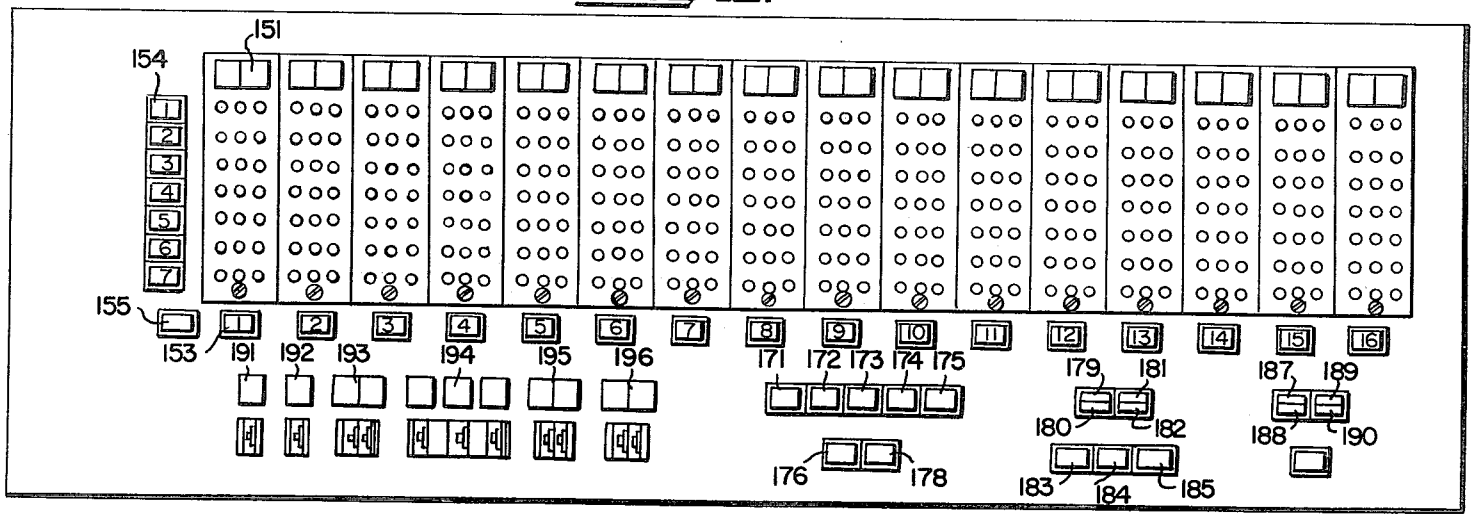
FIG. 13 is a top view of the fixed installation display and control panel.

FIG. 13 illustrates the display/control console configured to process data relevent to 16 fire lanes, each of which includes 7 targets. Three lights are provided for each individual target to provide an instantaneous registration of a hit, and to advise the operator of the up or down status of the targets. Accumulative data relating to the number of hits in the individual fire lanes are indicated by the digital readout means 151 located at the top of each fire lane column. The fire lane buttons 153 and target buttons 154 create a multiplex signal addressing a specific target. The "All" button 155 energizes all targets so that a complete recycling of the total system may be expedited.

A plurality of indicator lamps are provided in the lower left hand corner of the panel. These lamps provide an indication of the status of a fire test mission by indicating the hard copy record 191 and table number 192, the fire problem step 193, the number of target banks 194, the number of targets up 195, and the number of targets down 196. Positioned directly below the above indicators are a plurality of rotary switches adapted to enable an operator to input the specific data for manual access to the computer programmer unit and print out.

Mode selector switches 171, 172, 173, 174 and 175 are provided to enable selection of an automatic mode, alibi mode, manual mode, program mode, or test mode respectively. Directly below the mode switches are the start and stop switches 176 and 177. Hit data is controlled by a group of four switches which select a table or record function 179 and 180 respectively and the type of hits to be recorded whether single 181 or burst 182. Directly under the hits function selection switches are the printer switches which allow the operator to generate a command via the print push-button 183 to cause the output printer to produce a hard copy of the data selected by the "hits" pushbuttons. The clear switch 184 and reset switch 185 provide clear and reset instructions to the computer programming unit with respect to printer operations. The start button 186 located to the right of the reset button is utilized by the operator to activate the printer once the data to be printed has been selected by the various control switches on the panel. Return fire is controlled by on/-off switches 187 and 188 and the type of return fire simulation, either single or burst is controlled by switches 89 and 190 respectively.

Figure 14:
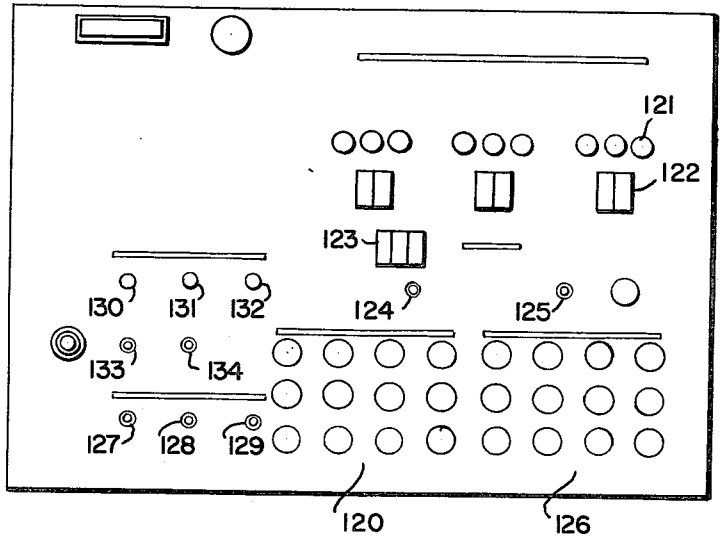
FIG. 14 is a top view of the radio control panel.

FIG. 14 illustrates the radio control unit utilized in the portable/field combat system. This panel is similar to the display control system of the fixed range installation with the exception that target status lights are not provided for each target. A target select key board 120 enables the operator to select a specific target or clear a previously selected target for display by the target status indicators 121. Three sets of target status indicators are provided so that the operator may monitor three targets simultaneously. Each of the three targets have an associated hits counter display therewith to provide cumulative data for that specific target, see 122 of FIG. 14. Total hits in the system are registered by a total hits display 123. The type of hits whether single or burst are selected by toggle switch 124 and automatic or manual operation is selected by a second toggle switch 125. A plurality of function selector push-buttons 126 are provided to raise and lower targets and initiate the performance of other system functions.

The hostile fire simulator is controlled by three toggle switches 127, 128, and 129 which provide on/off functions for the hostile fire, sound, illumination, and flasher respectively.

Battery status is indicated by a power on light 130 charger on light 131 and low level warning light 132. Battery power on/off is controlled by toggle switch 133 and the charger on/off function is controlled by toggle switch 134.

Figure 15:
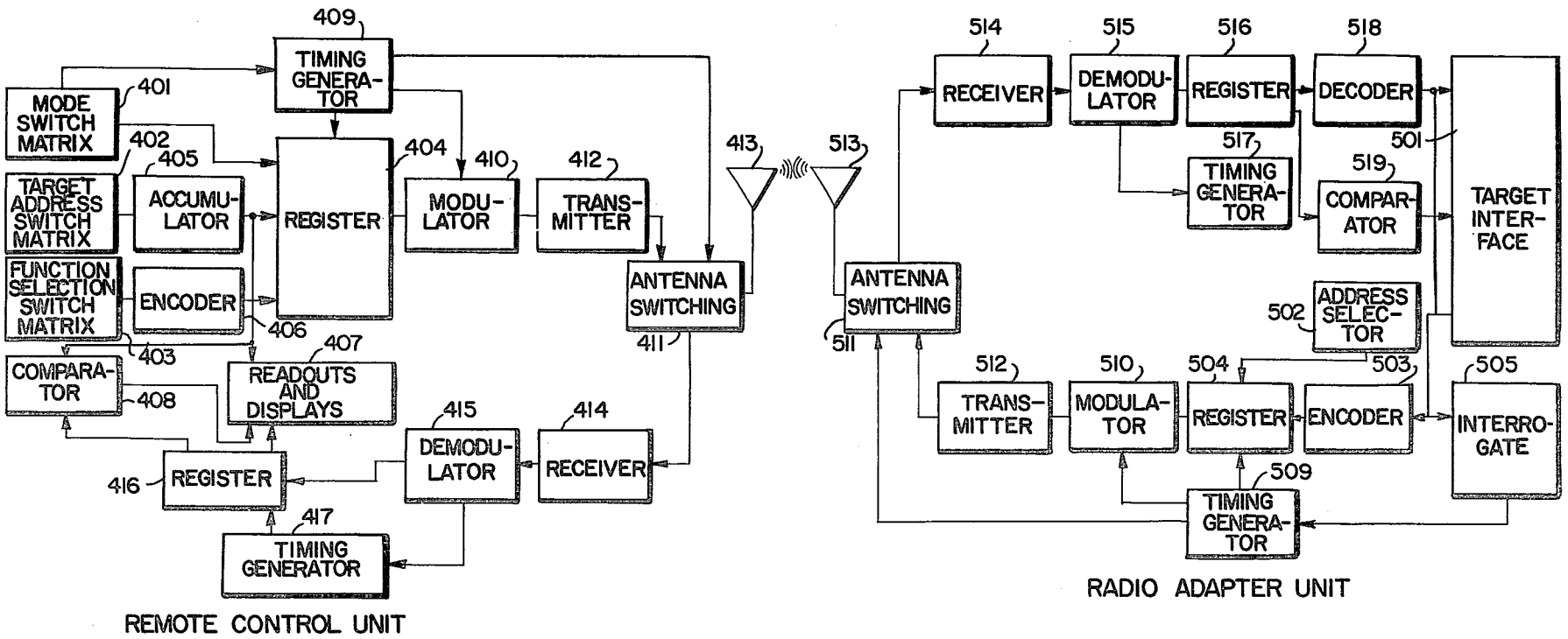
FIG. 15 is a diagram of the radio remote control system.

FIG. 15 presents a functional block diagram of the remote control unit and a single radio adapter unit. Control of a target is initiated in the mode switch matrix 401, the target address matrix 402, and the function selection switch matrix 403. The mode switches consist of four alternate action switches which control the operational modes of automatic or manual operation, hits or bursts, and illumination and flasher.

The address matrix 402 identifies target selected by two four bite words which allows selection of up to ninty nine targets. The function selection matrix 403 provides four bite activation commands which are normally selected one at a time. These commands are up, down, single fire, auto fire, interrogate, clear, test, and reset. The output of the mode switches are stored directly in a shift register 404. The address matrix 402 is buffered by an accumulator 405 which stores the addresses of up to three targets. The function switch matrix 403 is comprised of sixteen switches which are encoded in an encoder 406 to a four bite command prior to storage in register 404.

The register 404 stores sixteen bites of data prior to transmission as a serial word.

The output of the accumulator is used to drive a readout and display means 407 which is adapted to display targets selected and a comparator 408 which selectively gates the target code number and hits to the display when targets are interrogated.

A timing generator 409 controls the conversion of data from parallel to serial. It also controls the modulator 410 for tone selection and controls the TR switch 411.

The modulator 410 modulates the RF carrier by tone modulation utilizing a two-tone system for maximum rejection of interference. The transmitter 412 carrier is modulated by the data and applied to the TR switch 411 and antenna 413 when the TR switch is in the transmit mode. When the TR switch 411 is in the receive mode, the status data from the target is routed to the receiver 414 and demodulated in a tone decoder demodulator 415. After being demodulated, the received signal is converted from serial to parallel data in shift register 416. A second timing generator 417 transfers the data from the register to read out and displays. The timing signals are initiated by receipt of data from the target.

The radio adapter unit incorporates an antenna 513 coupled to receiver 514 and transmitter 512 by a TR antenna switching system 511 as in the remote control unit. The output of receiver 514 is demodulated by demodulator 515 while the transmitter is modulated by modulator 510 in a manner identical to that described for the remote control unit.

The functions of registers 516 and timing generator 517 are similar to the functions of register 416 and timing generator 417 of the remote control unit. The functions of register 504 and timing generator 509 are identical to the functions of register 404 and timing generator 509 of the remote control unit.

The output of the receiver register 516 is applied to decoder 518 and comparator 519. The decoder 518 recovers the control signals and supplies them to the target interface for target commands. The target interface 501 contains the buffers for driving the target mechanism and storage means for hit data.

The comparator 519 is used in combination with address selector 502 to identify target mechanisms being controlled. The hit and status data from the target are applied to encoder 503 for data formating prior to parallel to serial conversion by register 504. The interrogate system 505 accepts an interrogate command and generates a control signal to initiate transmission of target status and/or number of accumulated hits.

Figure 16:
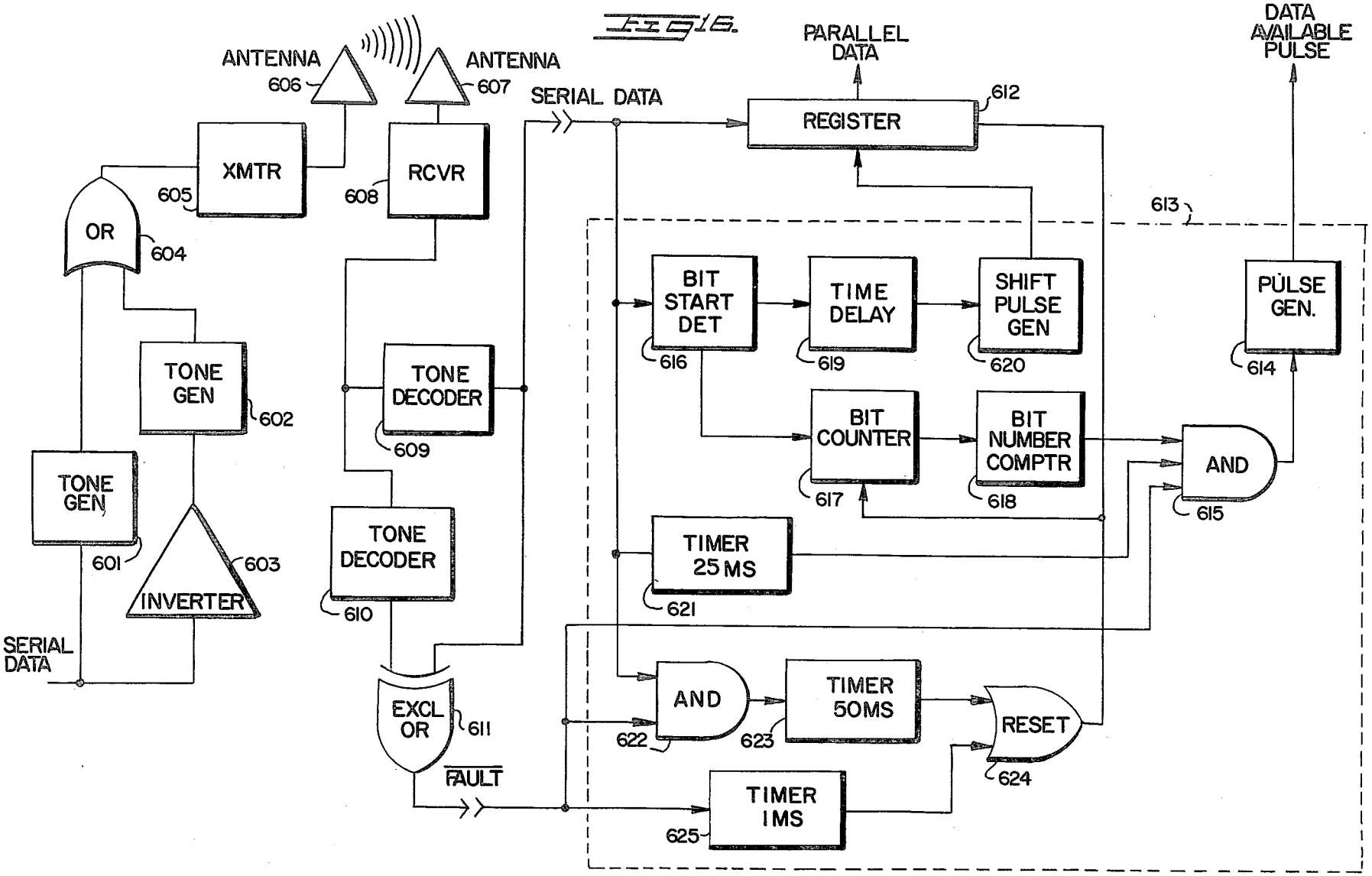
FIG. 16 is a diagram of the interference rejection network.

Rejection of interference from other radio sources in the same RF frequency band is provided by the rejection network illustrated in FIG. 16. Control of the target mechanisms via radio control uses pulse coded tone modulation of the serial digital control word. The data is used to activate tone generator 601 with a logic 1 or tone generator 602 with a logic 0 through inversion of the logic level by an inverter 603. The output of both tone generators is applied to OR gate 604 and then to transmitter 605 and antenna 606.

The radiated signal is detected by antenna 607 and receiver 608 which applies the received, detected signal to tone decoders 609 and 610. Tone decoder 609 is sufficient to recreate the digital bite stream data. Tone decoder 610 is used to generate a fault signal if two tones are present simultaneously, which can only happen if two RF sources are received using the same tones.

The exclusive OR circuit 611 generates a fault signal when simultaneous tones occur. This signal inhibits receipt of any data and prevents system operation. The absence of a transmitted signal also activates the fault signal and prevents stray RF interference during non-operation.

Serial data from tone decoder 609 is stored in register 612 which transfers data in parallel form to the control circuitry when a data available pulse is generated by timing generator 613.

The data available pulse is generated by pulse generator 614 which is responsive to the output of AND gate 615. AND gate 615 provides an output only when signals representing data word complete, absence of a fault signal and bite count complete are applied to its inputs.

When data is first received, the bite start detector 616 produces an output pulse for each bite. The bite counter 617 and bite comparator 618 produce a logic level output when 16 bites have been accumulated. The bite detector 616 also generates the shift pulses for register 612 by applying an input pulse to time delay 619. The delay pulse is then used to trigger shift pulse generator 620.

The end of data signal is generated by a timer 621 adapted to provide a signal 25 milliseconds after completion of the data.

The data register is reset prior to receiving data when a sync signal and an absence of fault signal are simultaneously applied to AND gate 622. The output of this gate is applied to a 15 milliseconds timer 623. The output of timer 623 is applied via OR reset gate 624 to register 612. Register 612 may also be reset when a pulse from exclusive OR gate 611 is applied to reset gate 624 via the 1 milliseconds timer 625.

The 50 millisecond delay provides sufficient time for synchronizing the receiver to the transmitter to block out any erroneous data prior to data being received. The 1 millisecond delay resets the complet circuit ignoring incoming data if dual signals are received or if data fade is detected.

Figure 17:
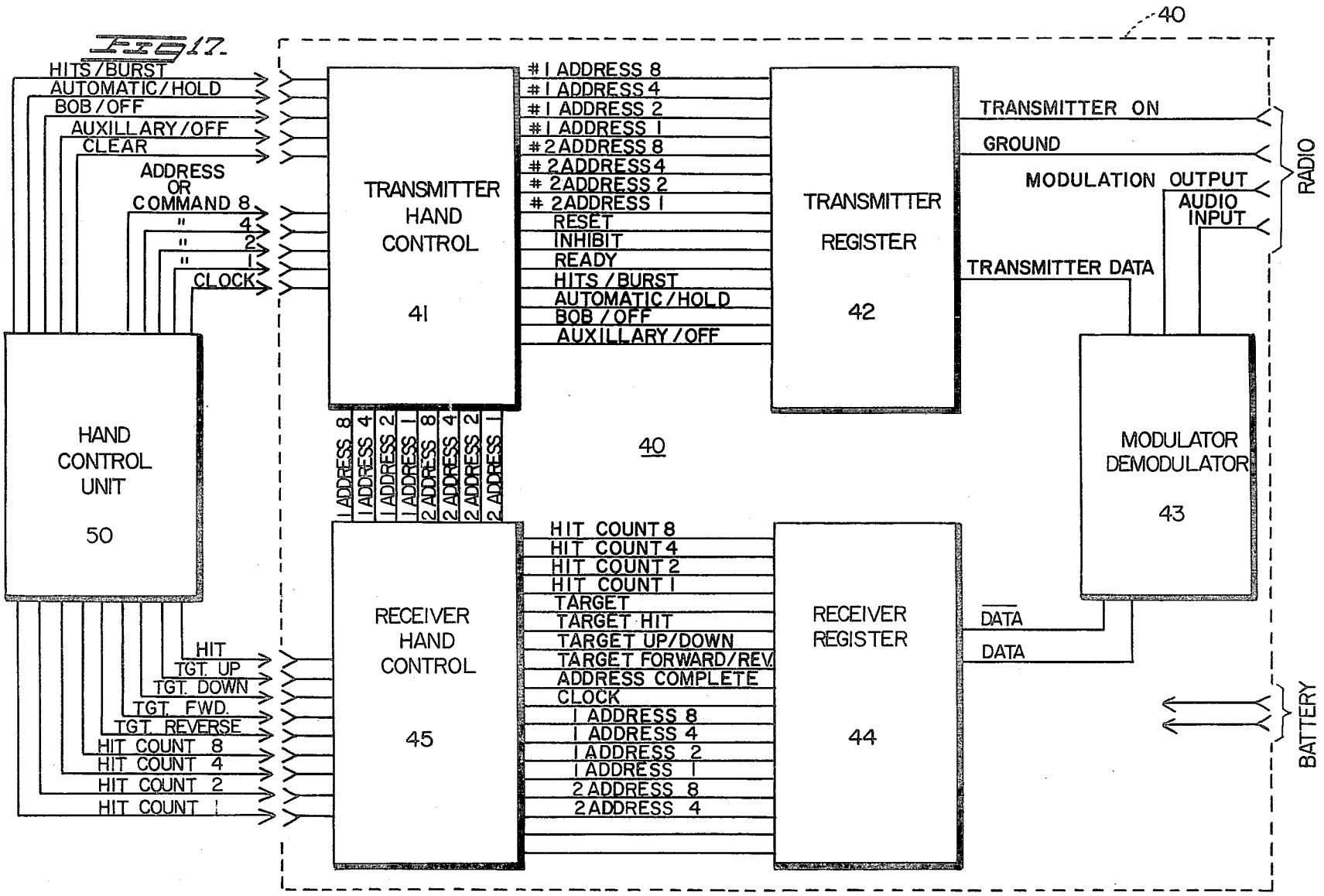
FIG. 17 is a diagram of the remote control interface.
Figure 12:
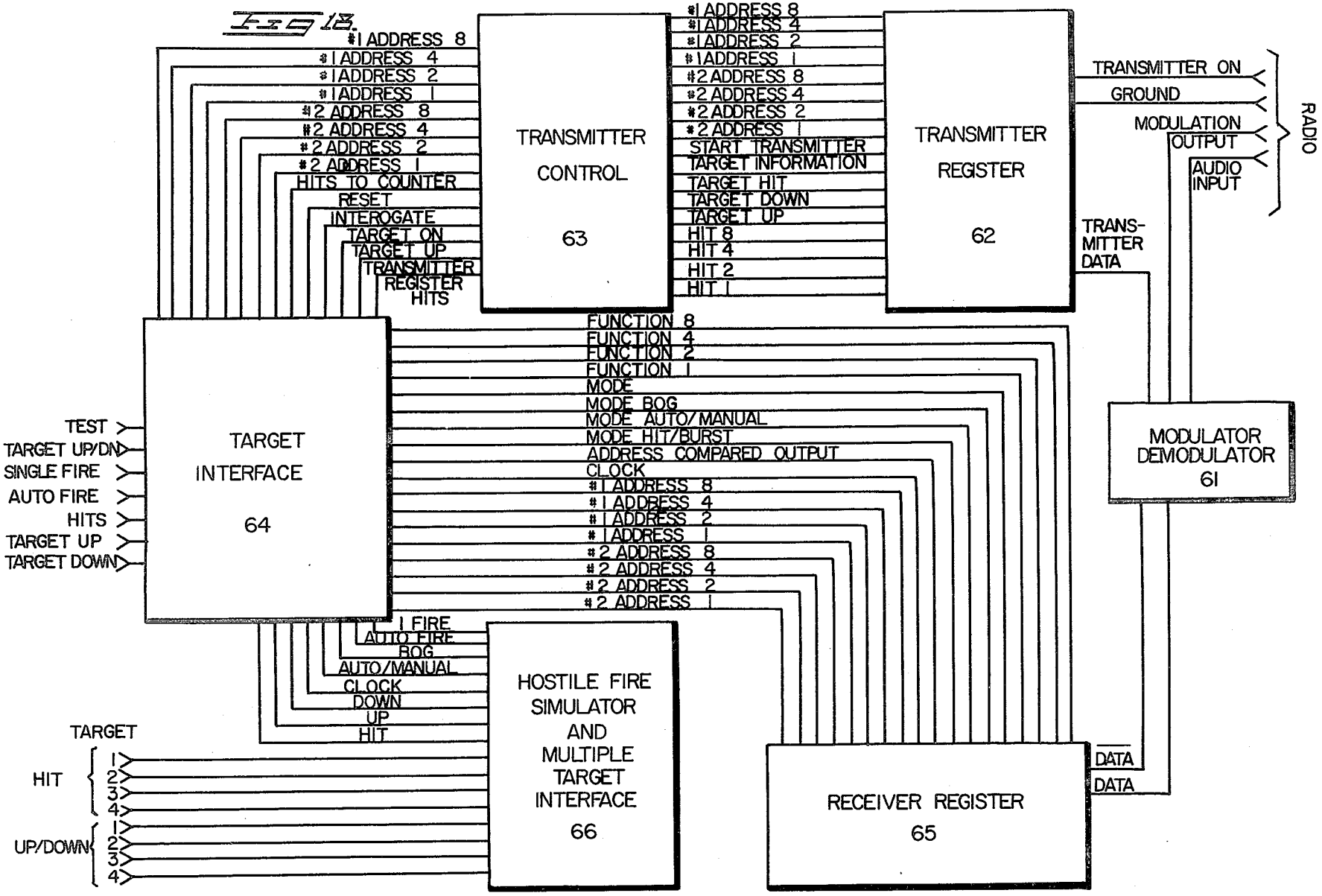
Figure 15:
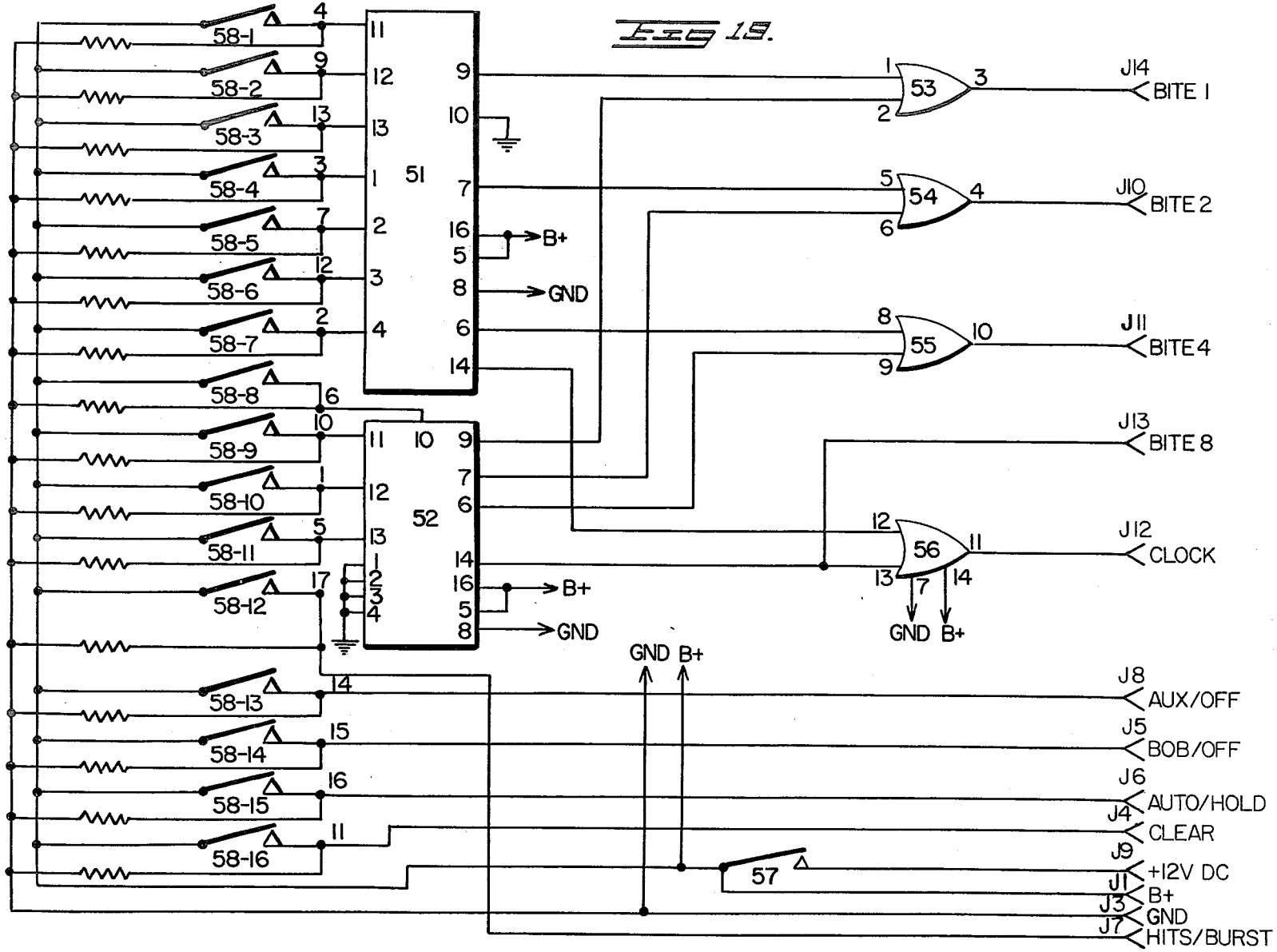

The remote control unit 40 and remote control panel 50 or hand control unit of FIG. 1 form a remote control interface system which is illustrated in block diagram form in FIG. 17.

The remote control unit 40 includes a transmitter hand control subassembly 41 adapted to control functions from the hand control unit 50 to the radio via transmitter register 42 and modulator/demodulator 43. Received data from the radio is coupled to the hand control unit 50 through the modulator/demodulator 43, receiver register 44 and receiver hand control 45.

The functions selected by the hand control unit 50 for transmission to individual targets are illustrated in FIG. 17. They include a binary target identification code provided as bites 1, 2, 4, and 8, each presented on individual conductors and a clock of synchronizing pulse. Also coupled from the hand control unit 50 to the transmitter hand control subassembly 41 are the alternate function selections of: hits/burst, automatic/hold, bob/-off, auxiliary/off, and clear. This data is coupled from the transmitter hand control subassembly 41 to the transmitter register subassembly 42 in combination with reset, inhibit and ready signals and a target identification code comprised of two decimal digits representing 00 through 99 in the form of a first four bite binary code for one digit and a second four bite binary code for the second digit which creates a BCD or binary coded decimal signal.

The transmitter register subassembly 42 converts the data applied to it in parallel form into a serial sequence. This information is coupled through the modulator/-demodulator 43 to the radio. Operating current for the transmitter register subassembly 42 is provided by an operating potential in the form of a transmitter current from the radio which also provides a chassis ground.

The hand control unit 50 functions as an indicator as well as a target function selector. The indicator functions of the hand control unit are supplied by the targets via the modulator/demodulator 43, the receiver register 44 and the receiver hand control subassembly 45. The receiver register 44 converts a serial pulse train into a group of parallel signals. The data coupled via this link is comprised of target hit information in binary form, and target status such as up, down, forward, or reverse.

This information is coupled between the receiver hand control subassembly 45 and receiver register assembly 44 in addition to the two sets of binary data required to select the two decimal digit target identification code identified in FIG. 17 as Number 1 address 1, 2, 4 and 8 and Number 2 address 1, 2, 4 and 8. Data and $\overline{\text{data}}$ is coupled from the radio via the modulator/-demodulator subassembly 43.

The information channeled via the remote control interface system of FIG. 17 is transmitted over a radio network to individual targets, each of which include a radio receiver transmitter system and a target assembly interface system like that illustrated in FIG. 18. This system includes a modulator/demodulator 61, transmitter register 62, transmitter control 63, target interface 64, receiver register 65, and hostile fire simulator and multiple target interface 66.

The serial data chain transmitted to the individual target radio receivers is coupled via the modulator/-demodulator 61 to the receiver register subassembly 65. Here the serial data is converted to parallel data including a four bite function input identified as functions 1, 2, 4 and 8, a mode selection input, a mode bob selection, a mode automatic or manual selection code, a mode hit or burst selection, and an address compared output. In addition to the foregoing parallel data input from the receiver register subassembly 65 to the target interface 64, a clock signal is provided with a target identification code comprised of a Number 1 and Number 2 address selection for bite binary input for the first and second decimal digits identifying the target. The target interface subassembly 64 receives the parallel data which was transmitted in serial fashion and uses the data to selectively gate target up or target down operation functions, simulated fire, or test functions. Also coupled to the target interface subassembly 64 is the hostile fire simulator and multiple target interface subassembly 66 which couples hit information and up/down status from four targets to the target interface. Interconnections are also included between the target interface 64 and hostile fire simulator and multiple target interface 66 for simulated fire, AF, Bob, and automatic or manual operation.

The up/down target status and target hits data is coupled from the target interface subassembly 64 to the transmitter control subassembly 63 in the form of parallel data representing: hits to the counter, reset, interrogate, target on status, target up, and transmitter register hits. In addition to this parallel data, a two-digit binary target identification code in the form of two four bite digital input codes is provided. The transmitter control process this data in parallel form and couples it to a transmitter register along with a start transmitter code. The transmitter register subassembly 62 converts the parallel data to a serial format and transfers it via the modulator/demodulator subassembly 61 to the radio.

The switching functions of the hand control unit are presented in the hand control units schematic FIG. 19. The display provided on the hand control unit is schematically presented in FIG. 20.

The hand control circuitry illustrated in FIG. 19 includes an eight bite encoder 51 which is an RCA integrated circuit CD4532B and a BCD rate multiplier 52 which is an RCA integrated circuit CD4572B. These two integrated circuits provide four outputs each from a plurality of inputs and each of the individual outputs are coupled to a lead of a two input OR gate, 53, 54, 55 and 56, so that the gate may be trued by either an output of the eight bite encoder 51 or the BCD rate multiplier 52.

The two input OR gates are identified by reference designators 53 through 56 and they are physically combined in an RCA integrated circuit CD4071B which is a quad, two input OR gate.

An on/off switch 57 is included in the circuitry to provide coupling 12 volts DC from the input connector J9 to the various B+ terminals of the hand control unit and also through the switch J1 to the remote control interface assembly.

Functions are selected through the hand control unit by the use of sixteen push-button switches which are arranged in a 4 by 4 matrix assembly. These switches, 58-1 through 58-16 are utilized to generate the various control functions required by the system. A one megohm resistor is positioned in shunt across each of the sixteen switching contacts to minimize switching transients.

The first seven switches, 58-1 through 58-7 provide inputs to the eight bite encoder 51 and the next four switches, 58-8 through 58-11 provide inputs to the BCD rate multiplier. The primary function of switch 58-1 is to provide a number 10 address while the primary functions of 58-2 through 58-10 are to provide addresses 1 through 9 respectively and switch 58-11 provides an ALL address function.

Switches 58-1 and 58-11 have no secondary function. However switches 58-2 through 58-10 have the following secondary functions respectively: up; down; interrogate; auto fire; single fire; test; reset; forward; reverse.

The remaining switches of the matrix assembly are identified as switches 58-12 through 58-16. They provide the following primary function which include a secondary or alternate function: kill/hold; auxiliary/off; bob/off; hits/burst; and clear.

Figure 20:
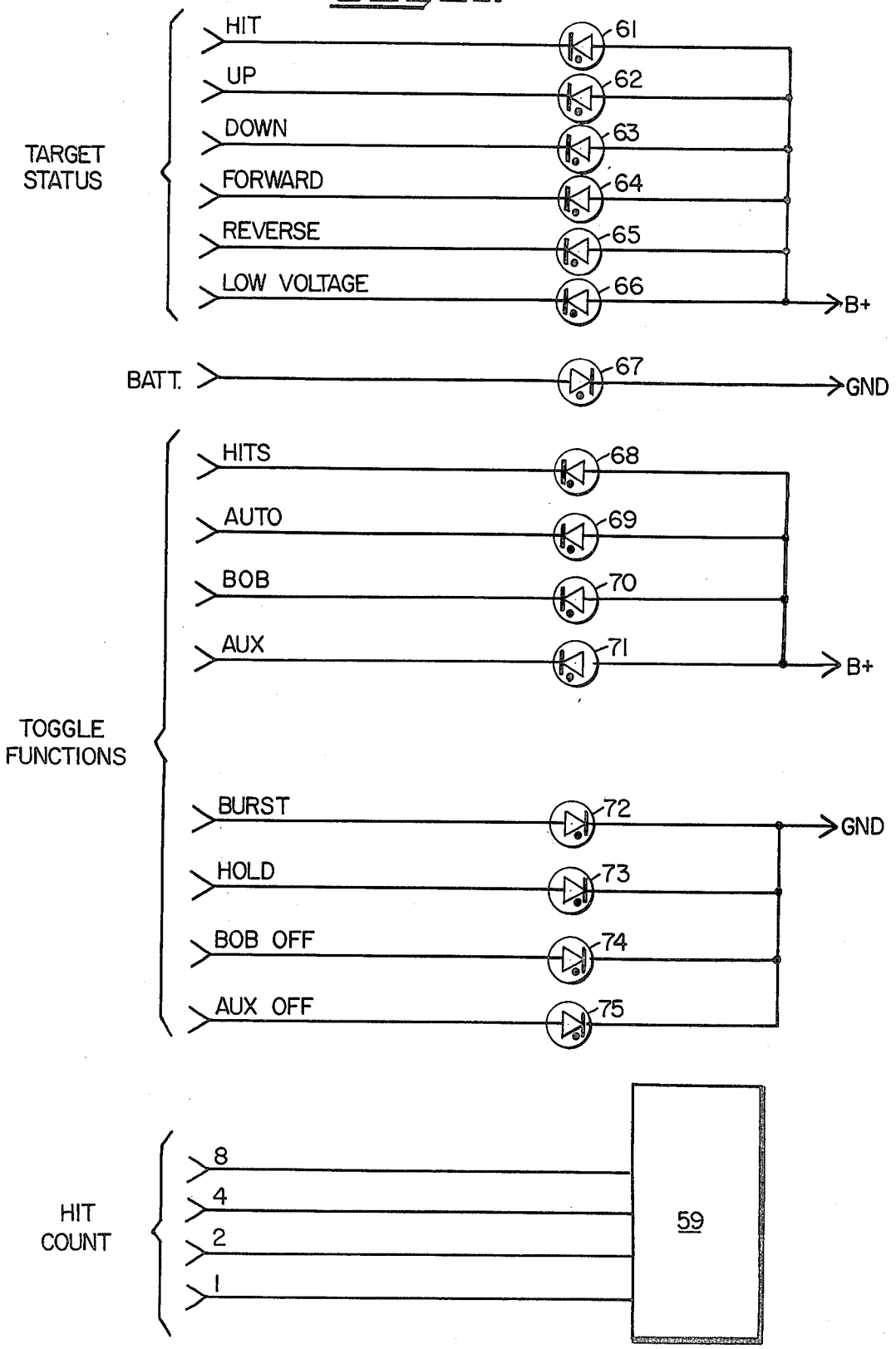
FIG. 20 is a schematic diagram of the hand control unit display.

FIG. 20 illustrates the hand control unit display devices which include a hit count display means 59 which is a two digit display responsive to the hit count 4 bite input of the receiver hand control subassembly 45 of FIG. 17.

Six light emitting diodes 61 through 66 of FIG. 20 are responsive to target status data from the receiver hand control assembly 45 of FIG. 17. The status indicated by these diodes relates to the existence of a hit, whether the target is up or down or travelling in a forward or reverse direction. Indicator 66 provides an indication as to whether or not the target is active and indicator 67 indicates if the battery has been properly connected to the circuitry.

Light emitting diodes 68 through 75 indicate toggle functions selected by switches 58-12 through 58-15 of FIG. 19. For instance, light emitting diodes 68 and 72 indicate the mutually exclusive selection of hits or burst by switch 58-12. Light emitting diodes 69 and 73 indicate automatic or hold as a function of the position of switch 58-15, light emitting diodes 70 and 74 are responsive to switch 58-15 and indicate the bob function or alternately the bob off function, and finally, light emitting functions 71 and 75 indicate auxiliary or auxiliary off as a function switch 58-13.

Figure 21:
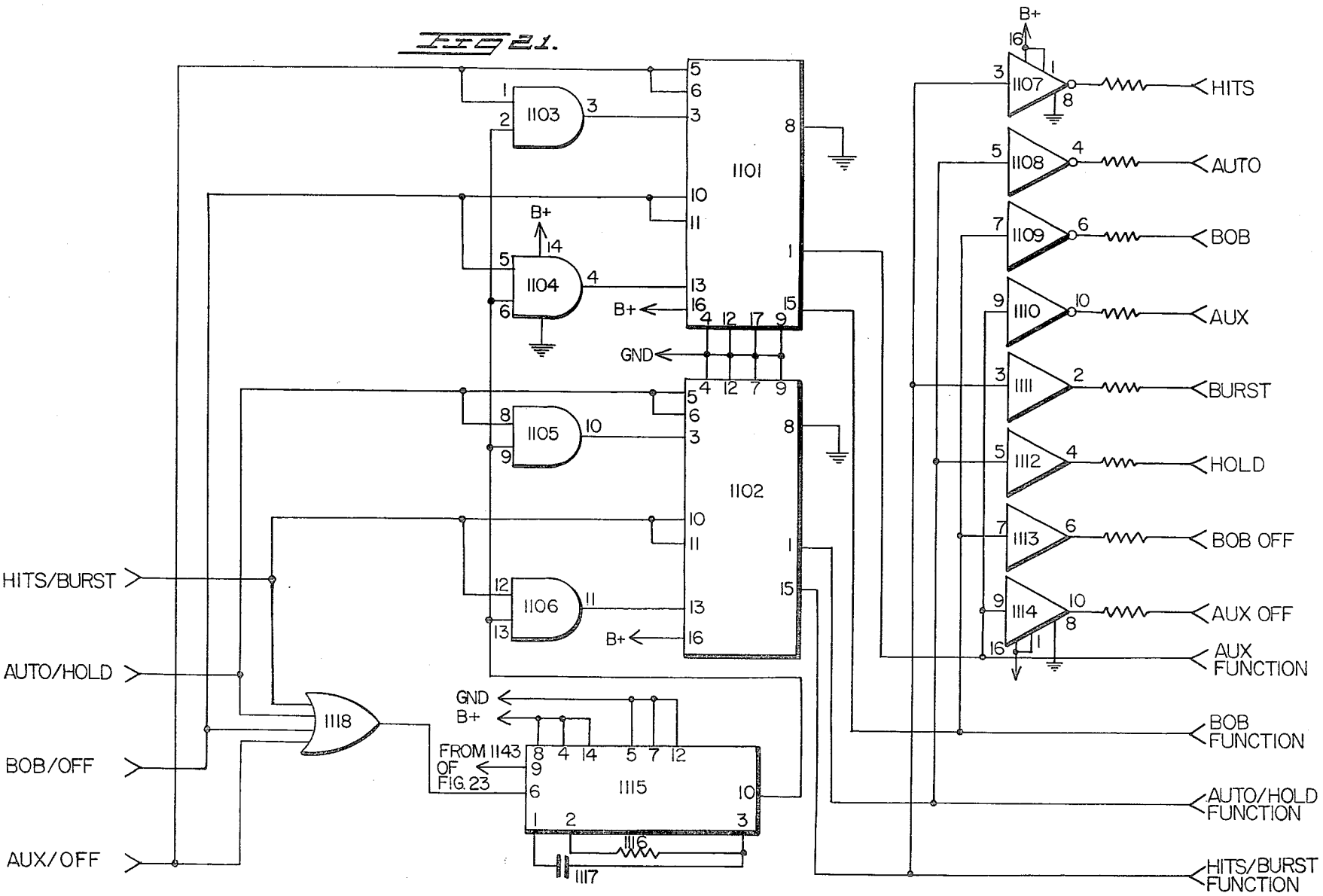
FIG. 21 is a schematic diagram of the transmitter hand control interface target function processor.

The hand control unit display of FIG. 20 is provided with 12 volts DC via switch 57 of FIG. 19 and the indicators are controlled by the transmitter hand control interface target function processor schematically illustrated in FIG. 21.

The hit/burst, auto/hold, bob/off, aux/off functions from switches 58-12 through 58-15 of the hand control unit are applied to OR gate 1118 of the transmitter hand control interface target function processor which generates the mode strobe or clock by pulsing the one microsecond one-shot multivibrator 1115. OR gate 1118 is an integrated circuit 7072B and the one microsecond one-shot multivibrator is an RCA circuit CD4047. The one microsecond operation of the one-shot multivibrator is achieved through the use of an 18 kilohm resistor 1116 connected between pins 2 and 3 of the circuit and a 0.022 microfarad capacitor 1117 connected between pins 1 and 3.

The four inputs from switches 58-12 through 58-15 of the hand control unit are also applied to individual inputs of four two input AND gates 1103 through 1106 of the processor. These AND gates also receive a clock pulse from the one microsecond, one-shot multivibrator 1115. The four AND gates are physically contained in an RCA circuit CD4081. AND gates 1103 and 1104 are responsive to the bob/off and aux/off command and apply trigger pulses to J-K flipflop 1101 which is an RCA CD4027. The output of this flipflop provides an aux function and a bob function in the set and reset modes respectively. The aux function is applied to the transmitter register assembly 42. This signal is also applied to inverter 1110 and buffer 1114. The output of inverter 1110 is applied through an 800 ohm resistor to light emitting diode 71 of the hand control display of FIG. 20 and the output of buffer 1114 is applied through an 800 ohm resistor to light emitting diode 75.

The bob function of J-K flipflop 1101 is applied to the transmitter register assembly 42 of FIG. 17 and back to the hand control unit via inverter 1109 and buffer 1113. Inverter 1109 couples the signal through an 800 ohm resistor to bob indicator light emitting diode 70 and the buffer 1113 couples the signal through an 800 ohm resistor to the bob off light emitting diode 74.

The hits/burst and auto/hold inputs from switches 58-12 and 58-15 of the hand control unit are applied to inputs of AND gates 1105 and 1106 as previously discussed. The outputs of these two gates are applied to J-K flipflop 1102 which produces an auto/hold function and a hits/burst function. These two functions are applied to the transmitter register subassembly 42 of FIG. 17 and to the light emitting indicator of the hand control units.

The auto/hold function is applied to the hand control unit through inverter 1108 and an 800 ohm resistor to activate the auto light emitting diode 69. This signal is also applied through converter 1112 and an 800 ohm resistor to hold light emitting diode 73.

The hits/burst function signal is applied through inverter 1107 and an 800 ohm resistor to the hits light emitting diode 69 of the hand control unit and through buffer 1111 and an 800 ohm resistor to the burst light emitting diode 72.

Inverters 1107 through 1110 are physically located on an RCA hex buffer inverting integrated circuit CD4009 and buffers 1111 through 1114 are contained on RCA hex buffer non-inverting integrated circuit CD4010.

Figure 22:
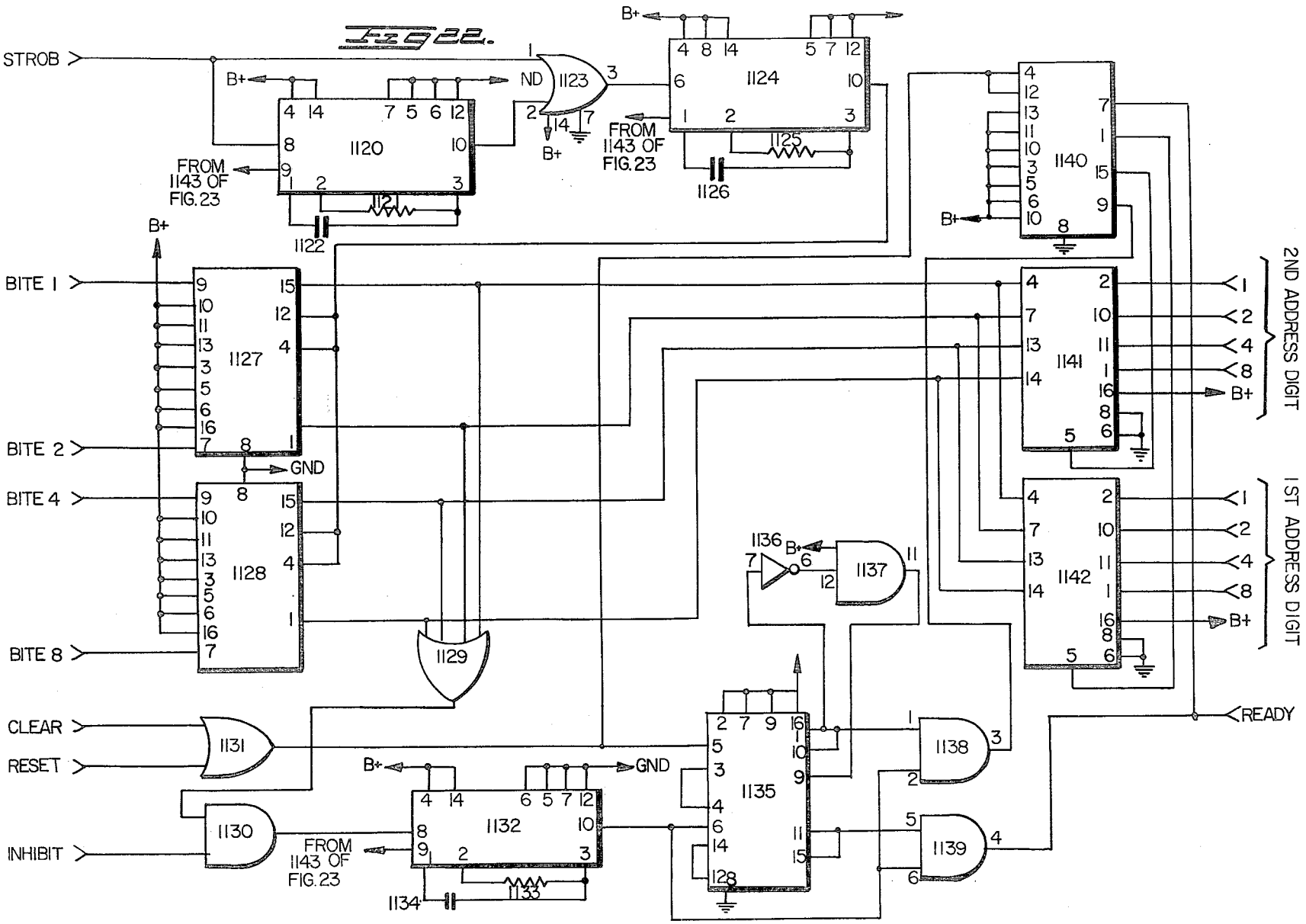
FIG. 22 is a schematic diagram of the transmitter hand control register interface.

The address or command binary coded decimal data bites 1, 2, 4 and 8 are applied to a pair of J-K flipflops of the transmitter hand control register interface of FIG. 22. These J-K flipflops, 1127 and 1128, are RCA integrated circuits CD4027 and they are utilized in conjunction with the four microsecond one-shot multivibrator 1120, OR gate 1123 and the one microsecond one-shot multivibrator 1124 to form a four microsecond digital filter calculated to eliminate switch bounce from the signals generated by the hand controlled unit keyboard.

The four microsecond and one microsecond one-shot multivibrators 1120 and 1124 respectively are RCA circuits CD4047. The four microsecond one-shot multivibrator derives its response time from the RC circuit comprised of resistor 1121 which is a 16 kilohm resistor connected between pins 2 and 3 of multivibrator 1120 and capacitor 1122 which is a 0.1 microfarad capacitor connected between pins 1 and 3 of the multivibrator. This one-shot multivibrator is responsive to the clock pulse or mode strobe generated by OR gate 1118 and one-shot multivibrator 1115 of the transmitter hand control interface target function processor illustrated in FIG. 21 and the outputs of J-K flipflops 1127 and 1128 which are responsive to the binary coded decimal output of the hand control unit.

The strobe input applied to pin 8 of the four microsecond one-shot multivibrator is also applied to one input of OR gate 1123 which is responsive to the output at pin 10 of the four microsecond one-shot multivibrator 1120. This OR gate triggers the one microsecond one-shot multivibrator 1124 which is timed by the 18 kilohm resistor 1125 connected between pins 2 and 3 and the 0.022 microfarad capacitor connected between pins 1 and 3. The output of the one microsecond multivibrator is applied to reset inputs 4 and 12 of J-K flipflops 1127 and 1128 to ensure that the binary coded decimal data applied to the J-K flipflops and coupled to the first and second address digit J-K flipflops 1141 and 1142 are not the result of pulses shorter than four microseconds which might have been caused by contact bounce of the switches.

The J-K flipflops 1127 and 1128 provide four inputs to J-K flipflops 1141 and 1142 in parallel so that these two flipflops will produce identical binary coded digital outputs. However, the flipflops are responsive to J-K flipflop 1140 which in turn is responsive to the operation of the clear key on the hand control unit or the reset signal from the transmitter register assembly 42 so that they will function as quad clocked latches which will store target addresses comprised of two digits.

Clear signal generated by the action of switch 58-16 of the hand control units is applied to OR gate 1131 which is also responsive to the reset signal from the transmitter register subassembly 42. The output of OR gate 1131 is applied to parallel in/out shift register 1135 whose function is to provide a position strobe so that J-K flipflop 1141 or 1142 may be reset to permit storing of a single digit without affecting the digit stored in the companion flipflop. This position strobing is accomplished by an inhibit input from the transmitter register subassembly 42 which is applied to AND gate 1130. This gate provides an AND function for a not inhibit input and an input from OR gate 1129 which is responsive to J-K flipflops 1127 and 1128 to generate a data strobe. Note that the four inputs to OR gate 1129 are the four inputs to J-K flipflop target storage devices 1141 and 1142 so that when both flipflops are set a process is immediately initiated to reset one flipflop to allow setting a second digit.

The output of AND gate 1131 is applied to a one microsecond one-shot multivibrator 1132 which is an RCA integrated circuit CD4047 adapted to provide the one microsecond operation by a 18 kilohm resistor 1133 connected between pins 2 and 3 and a 0.022 microfarad capacitor 1134 connected between pins 1 and 3. The output of the one microsecond multivibrator 1132 is applied to the second input to the parallel input/output shift register 1135 which is an RCA integrated circuit CD4035.

The outputs of the parallel input/output shift register 1135 are applied to a pair of AND gates 1138 and 1139 which also receive an input from the one microsecond multivibrator 1132. The parallel in/out shift register 1135 is stabilized by a feedback means comprised of the output of one channel which is applied to inverter 1136 and AND gate 1137 so that whenever a negative output appears at pin 1 of the input/output shift register an input will be applied to pin 9 of the register.

AND gates 1130, 1137, 1138 and 1139 are physically located on an RCA integrated circuit CD4081. OR gates 1123 and 1131 are located on an RCA quad two input OR gate circuit CD4071 while OR gates 1118 of FIG. 21 and 1129 of FIG. 22 are on a common integrated circuit 7072B.

Figure 23:
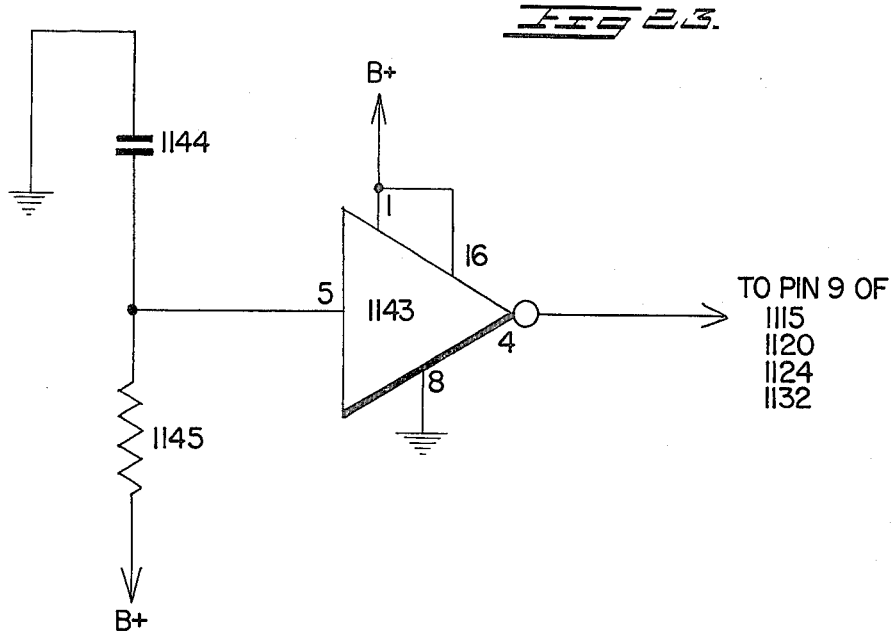
FIG. 23 is a schematic diagram of the transmitter hand control interface power reset circuit.

FIG. 23 illustrates a power up, reset circuit for one-shot multivibrators 1115, 1120, 1124 and 1132 of FIGS. 21 and 22. This circuit is comprised of an inverter responsive to B+ applied through a one megohm resistor 145 and coupled to ground by 0.05 microfarad capacitor 1144 so that when power is initially applied to the system the one-shot multivibrators will be reset. The inverter is physically located on an RCA hex buffer inverter CD4009. Also contained on this integrated circuit is inverter 1136 of FIG.22.

Figure 24:
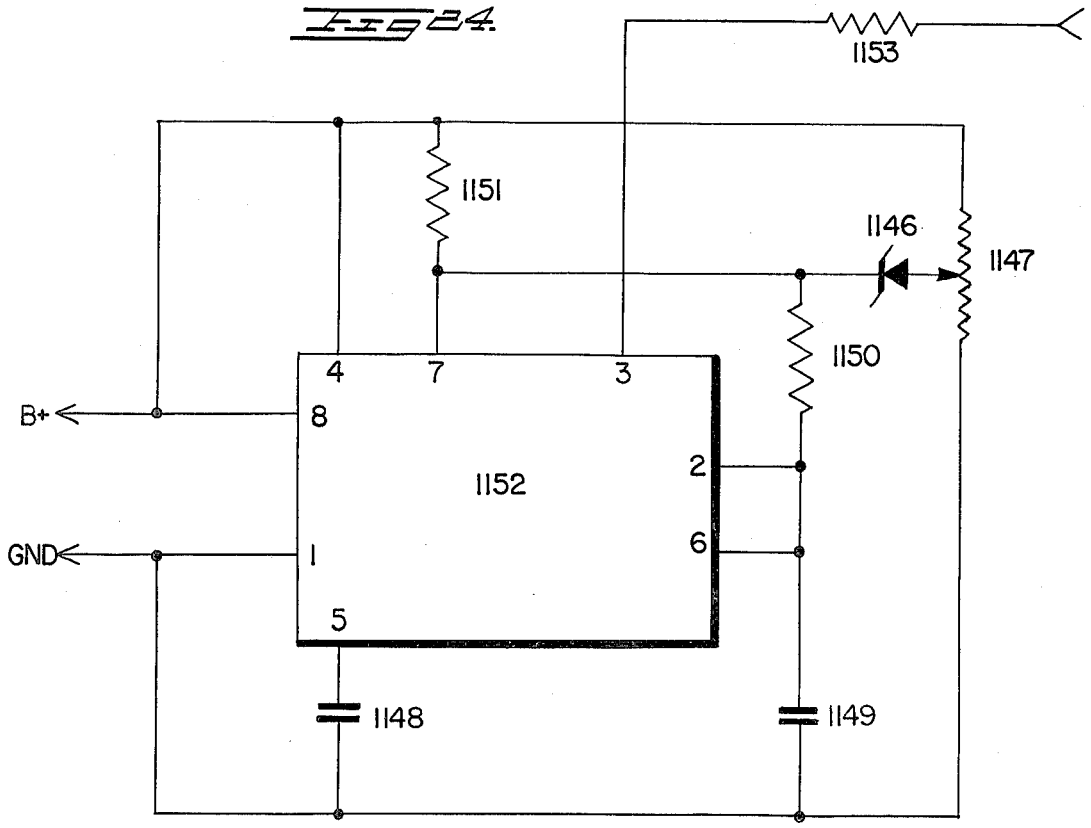
FIG. 24 is a schematic diagram of the transmitter hand control interface low voltage warning circuit.

FIG. 24 is a schematic diagram of the transmitter hand control interface low voltage warning circuit. It is comprised of a National integrated circuit timer NE555 coupled to the voltage supply so that whenever the battery voltage decreases below a predetermined level, set by a resistive network comprised of zener diode 1146 and resistor 1147, for a predetermined time the low voltage indicator light emitting diode 66 of the hand control circuit of FIG. 20 will begin to flash at about 4 pulses per second. The pulse repetition rate of the flashing light emitting diode and the circuit delay are generated by the 0.015 microfarad capacitor 1148 and the 8 microfarad capacitor 1149 in combination with the 210 kilohm resistors 1150 and 1151. The output signal to the low voltage indicator 66 from the timer 1152 is applied through an 820 ohm resistor 1153.

Figure 25:
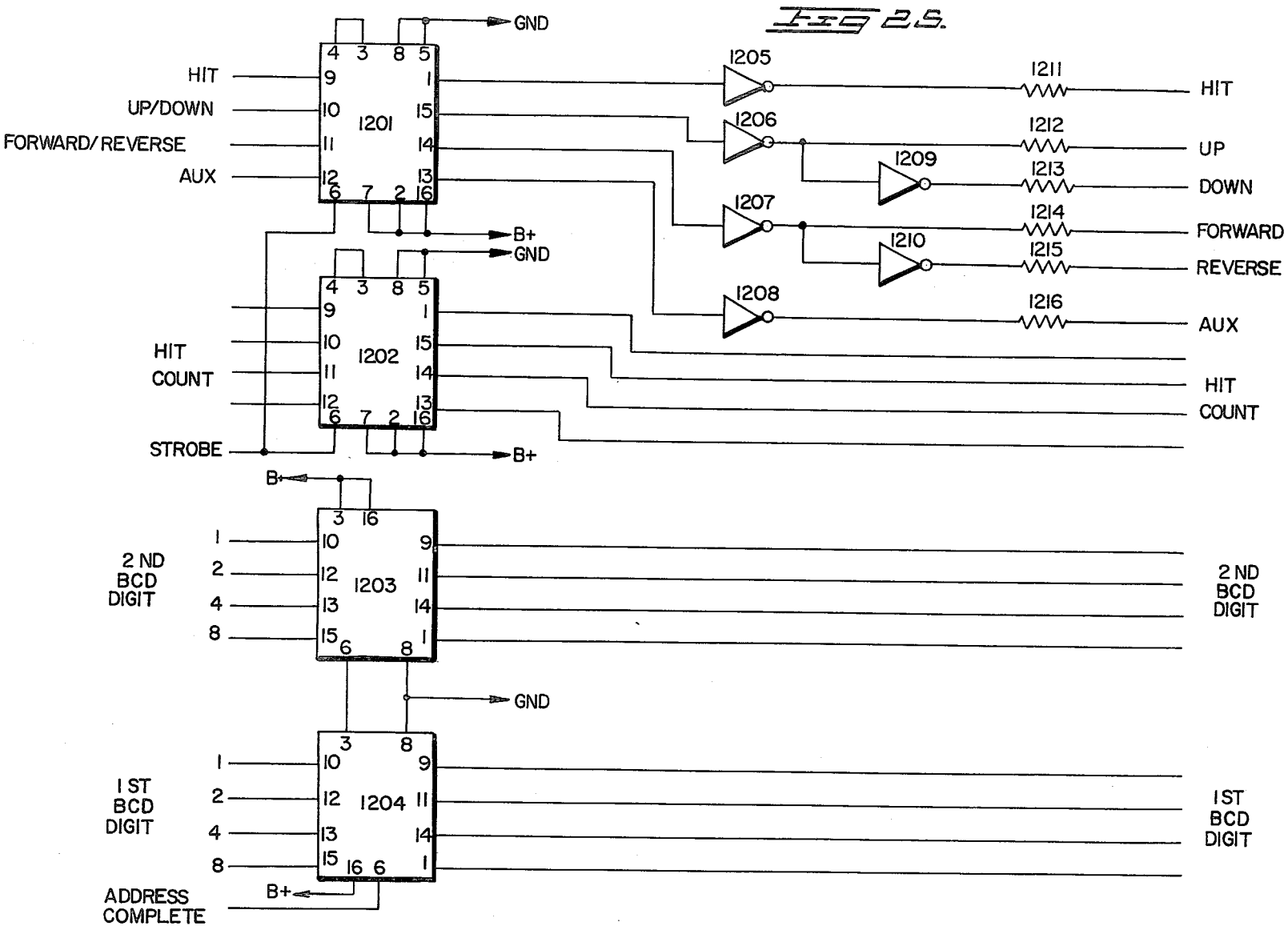
FIG. 25 is a schematic diagram of the receiver hand control interface system.

The receiver hand control interface subassembly 45 of FIG. 17 is illustrated in detail in FIG. 25. This circuit includes two parallel input/parallel output shift registers 1201 and 1202 which are RCA integrated circuits CD4035. Shift register 1201 receives target status from the receiver register subassembly 44 of FIG. 17. Target status is composed of hit, up/down, forward/reverse, and auxiliary inputs which are stored by the shift register and made available to the hand control unit via individual inverters 1205 through 1208 and 800 ohm resistors 1211 through 1216. The inverters 1205 through 1210 are located on a common RCA integrated circuit CD4009AE.

The six target status outputs provided by shift register 1201 are used in the hand control unit to cause activation of status light emitting diodes previously discussed with respect to FIG. 20.

Shift register 1202 stores the target hit count in the form of binary coded decimal data. It receives the binary signals from the receiver register subassembly 44 and passes then on to the hand control unit. Both shift registers 1201 and 1202 are clocked by a strobe signal which is processed by the receiver register subassembly.

FIG. 25 also includes two four bite comparators 1203 and 1204 which are RCA integrated circuits CD4063B. Comparator 1204 is coupled between the first digit binary coded data of the receiver register subassembly 44 and the first digit binary coded data from the transmitter hand control subassembly 41.

Comparator 1203 is similar to comparator 1204 in that it is responsive to the second digit binary coded data from the receiver register subassembly 44 and the second digit binary coded data from the transmitter hand control subassembly 41.

When a comparison is accomplished in comparator 1203 it provides an output to comparator 1204 which, when a comparison is provided therein in combination with an input from comparator 1203, provides an address complete signal.

The receiver register circuit converts the serially transmitted data to parallel data for processing in both the remote control interface system and the target assembly interface system illustrated in FIGS. 17 and 18 respectively. Receiver 44 and 65 of these two systems are identical with the exception that the serial in/parallel output shift registers 120 and 121 are used to process different data. When the circuit is utilized in the remote control interface system, serial-to-parallel shift register 1220 provides a parallel output representing the target position data hit, up/down, forward/reverse and auxiliary functions. The series-to-parallel shift register 1221 under the same use circumstance in the remote control interface system provides a four bite output representing binary coded digital hit data.

When the receiver register circuit is utilized in the target assembly interface system, serial-to-parallel shift register 1220 provides the following command functions: mode, bob, automatic/channel, hit/burst. Series-to-parallel shift register 1221 provides toggle functions for the target assembly interface. These functions are hit/burst, auto/hold, bob/off, and aux/off.

Serial data is applied to the receiver shift register circuit of FIG. 26 at J1-2, which is connected to one input of AND gate 1237 which is one AND gate of a dual AND gate RCA integrated circuit CD4081BE. The other AND gate of this circuit is AND gate 1245 which is responsive to the not data input on J1-5.

When AND gate 1237 is trued by a not function processed by a plurality of one-shot multivibrators 1247, 1251 and 1254, it applies the serial data stream to the input of serial-to-parallel shift register 1220 and to the input of one-shot multivibrator 1224 which produces a 10 microsecond pulse.

One-shot multivibrator 1224 is an RCA integrated circuit CD4047 as are all the other one-shot multivibrators of this circuit, 1225, 1234, 1239, 1247, 1251 and 1254. The pulse width of one-shot multivibrator 1224 is created by the RC circuit comprised of resistor 1228 which is a 43 kilohm resistor and capacitor 1229 which is a 0.1 microfarad capacitor. The one-shot multivibrator 1224 is triggered on the leading edge of each data pulse and functions to shorten or lengthen the width of the data pulses applied thereto, see for instance the timing chart in FIG. 34.

Figure 34:
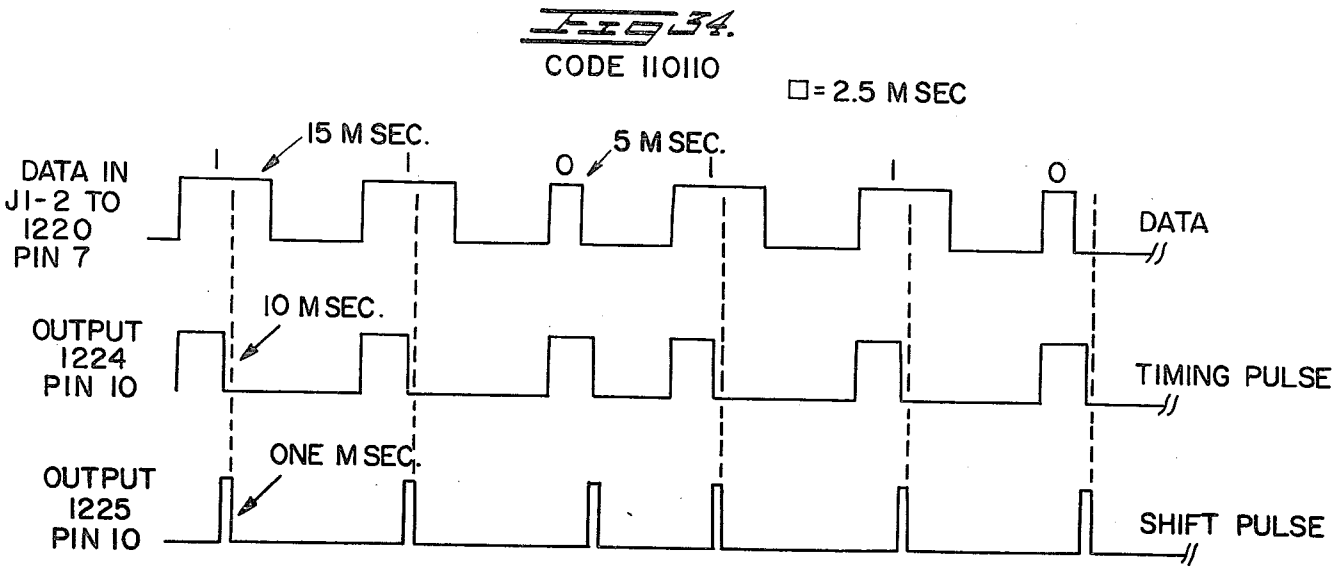
FIG. 34 is a receiver register timing chart.

The data pulse stream in FIG. 34 represents a binary code 011011 reading from right to left. Data pulses representing 0 are approximately 5 microseconds in duration while data pulses representing a 1 are approximately 15 microseconds in duration. However, pulses representing both 0's and 1's results in timing pulses of approximately 10 microseconds in duration because the 10 microsecond one-shot multivibrator 1224 is triggered by the leading edge. These timing pulses are applied to one-shot multivibrator 1225 which produces 1 microsecond pulses due to its RC circuit comprised of the 18 kilohm resistor 1230 and the 0.022 microfarad capacitor 1231. The 1 microsecond one-shot multivibrator is triggered on the trailing edge of the 10 microsecond pulse and its output is applied to serial-to-parallel shift registers 1220, 1221, 1222, and 1223 as shift pulses which cause the registers to shift one pulse to the right providing a data pulse is coincident therewith. For instance in FIG. 34 consider the extreme left data pulse which is a true or one 15 microsecond wide pulse. This pulse causes the 10 microsecond one-shot multivibrator to generate a pulse which in turn causes the 1 microsecond one-shot multivibrator to generate a relatively narrow pulse which is synchronous with a portion of the 15 microsecond pulse originating the action. Therefore when the 1 microsecond shift pulse is applied from one-shot multivibrator 1225 to pin 9 of serial-to-parallel shift register 1220, that shift register will shift 1 pulse to the right. The second pulse in the data train is also a one and it will cause a second one space shift to the right in the serial-to-parallel shift register 1220. When a 0 is present in the data train it presents a pulse of only 5 microseconds as can be seen in the data train with respect to the third pulse. Note that this pulse initiates the 10 microsecond wide timing pulse which in turn generates or results in the creation of a one microsecond wide shift pulse but the one microsecond wide shift pulse is not synchronous with any portion of the relatively narrow 0 pulse of the data train. Therefore when the shift pulse is applied to the series-to-parallel shift register no coincidence occurs between the data input and a 0 will be shifted in the register.

One-shot multivibrators 1224 and 1225 continue producing relatively narrow shift pulses in response to the data stream input and serial-to-parallel shift registers 1220 through 1223 continue to shift right until the complete serial word has been loaded in the four registers to provide a parallel output representing target position or command functions, hit count or toggle functions, the second BCD address digit, and the first BCD address digit. The foregoing parallel data is loaded into the target interface or receiver hand control subassembly when the data complete signal is generated.

The four series-to-parallel shift registers are physically located on RCA serial in, parallel out four stage shift registers CD4015AE.

The data complete signal required to clock out the parallel data from the serial-to-parallel shift registers is derived by a pair of series connected up/down counters 1226 and 1227. The counters are RCA integrated circuits CD4047 and they are adapted to count 16 pulses from the one microsecond one-shot multivibrator 1225. When a count of 16 has been achieved, a signal is applied to the J-K flipflop 1232 which provides an input to NAND gate 1233. The output of NAND gate 1233 is then applied to one-shot multivibrator 1234 which develops a one microsecond pulse as a function of the RC circuit comprised of the 18 kilohm resistor 1235 and 0.022 microfarad capacitor 1236. This one microsecond wide pulse functions as a gating signal to dump the four parallel shift registers.

NAND gate 1233 is a three input NAND gate which, in addition to the output of J-K flipflop 1232 receives an input from the address compared circuitry of the target interface or receiver hand control subassembly. This data complete signal is in the form of a clock signal and is so identified in FIGS. 17 and 18.

A third input to NAND gate 1233 is derived from the error prevention section of the receiver register circuit.

Considering the error prevention portion of the circuit illustrated in FIG. 26 note that the data and the not data inputs J1-2 and J1-5 respectively are applied to two inputs of exclusive OR/NOR gate 1238 which is RCA integrated circuit CD4070BE. Gate 1238 functions in this circuit as an exclusive OR gate and it provides an input through the RC circuit comprised of resistor 1257 and capacitor 1261 to OR gate 1242 which provides the third input to NAND gate 1233 which is an RCA integrated circuit CD4023AE.

The output of OR gate 1242 is controlled by one-shot multivibrator 1239 which includes an RC circuit comprised of a 50 kilohm resistor 1240 and a 0.022 microfarad capacitor 1241. This RC circuit causes the one-shot multivibrator to produce a 3 microsecond pulse so that if the output of exclusive OR gate 1238 goes low for more than the 3 microseconds, a fault pulse will be generated and applied to J-K flipflop 1232 via inverter 1243 and OR gate 1244. This fault pulse is also applied to both up/down counters 1226 and 1227 to the reset inputs so that when a fault pulse is generated, both counters and the J-K flipflop will be reset.

It is imperative that the counters 1226 and 1227 and the data present fliplflop, J-K flipflop 1232 are reset at start up so that the system will always begin with the 0 count. This is accomplished by AND gate 1245 and multivibrators 1247, 1251 and 1254 which function to provide a pulse to the other input of OR gate 1244.

AND gate 1245 is adapted to trigger one-shot multivibrator 1247 which produces a 45 microsecond pulse as a function of the RC circuit comprised of the 18 kilohm resistor 1248 and the 1 microfarad capacitor 1249. This 45 microsecond pulse is applied to the input of one-shot multivibrator 1251 which creates a pulse one microsecond in duration as a function of the RC circuit comprised of the 18 kilohm resistor 1252 and 0.022 microfarad capacitor 1253. An output from one-shot multivibrator 1251 is applied to OR circuit 1244 to reset the counters and J-K flipflop if a fault pulse is not present at the other input to OR gate 1244. The output of one-shot multivibrator 1251 is also applied to one-shot multivibrator 1254 which produces a 500 microsecond pulse as a function of the RC circuit comprised of resistor 1255 and capacitor 1256. This pulse is applied to AND gate 1237 to enable that gate so that the serial data stream may pass therethrough. Thus, approximately 50 microseconds after start up, if a fault pulse is not generated, the counters in J-K flipflop are reset and input AND gate 1237 is enabled.

A not output from the 500 microsecond one-shot multivibrator 1254 is applied in a feedback loop to a second input of AND gate 1245 to inhibit the start up circuitry for the 500 microsecond duration of serial-to-parallel conversion.

OR gates 1242 and 1244 are physically located on an RCA integrated circuit CD4071BE.

Figures 27, 28:
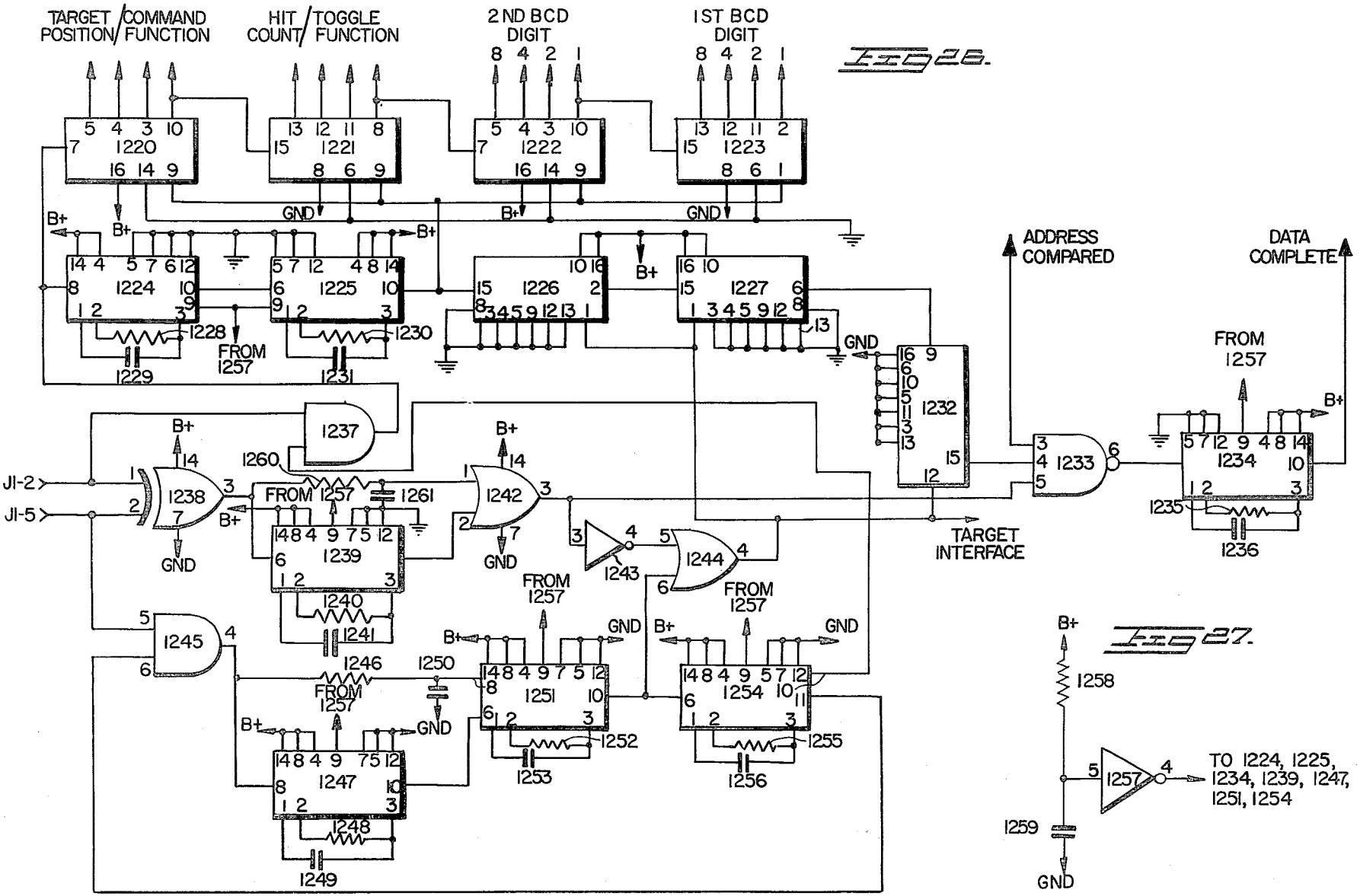
FIG. 27 is a schematic diagram of the receiver register power reset circuit.

FIG. 27 illustrates a power up reset circit comprised of inverter 1257 which produces a reset signal when power is first applied to the system as a function of current flow through the 1 megohm resistor 1258 and 0.05 microfarad capacitor 1259. This reset pulse is applied to all of the one-shot multivibrators illustrated in FIG. 26. The inverter utilized in the circuit may be an RCA integrated circuit CD4009 which also provides inverter 1243 of FIG. 26.

Figure 28A:
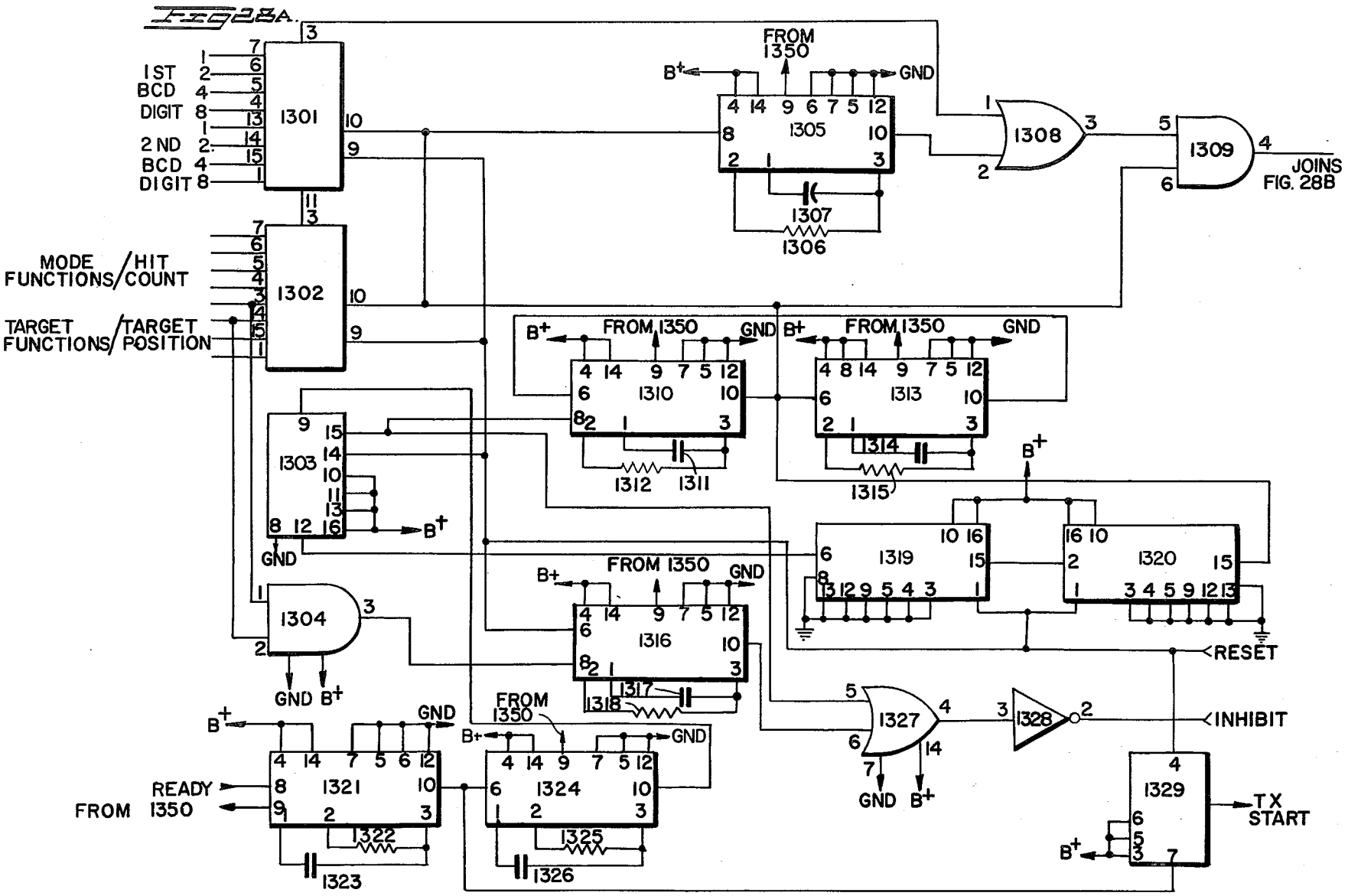
FIGS. 28A and 28B are a schematic diagram of the transmitter register circuit.

The transmitter register circuits 42 and 62 of the remote control interface system and target assembly interface system respectively are identical and presented in FIGS. 28A and B. The only difference between the circuit when utilized in the remote control interface system or the target assembly interface system is that the inputs to parallel-to-serial register 1302 differ. For instance, when the transmitter register circuit is utilized in the remote control interface system, the transmitter hand control subassembly provides hits/burst, auto/-hold, bob/off, and auxiliary/off modes to pins 7, 6, 5 and 4. Pins 13, 14, 15, and 1 receive the following functions, auxiliary, bob, auto/hold, and hits/burst. When the transmitter register is utilized in the target assembly interface system, the 8 inputs to the parallel-to-serial register 1302 are comprised of the hit count binary coded decimal signals for input 7, 6, 5 and 4 and target information, target hit, target down, and target up for inputs 13, 14, 15 and 1. One additional feature is that one-shot multivibrator 1321 is triggered by a ready signal from the transmitter hand control subassembly when the circuit is utilized in the remote control interface system and the same pin receives a start transmitter signal from the transmitter control subassembly when utilized in the target assembly interface system.

These differences do not affect the functioning of the circuit, they are only the labels applied to the data bites. Therefore, a discussion of the transmitter register circuit is applicable for the circuit when utilized in either system.

When a ready signal or start transmit signal is applied to pin 8 of the one-shot multivibrator 1321 it produces a 5 microsecond pulse is response to the RC network comprised of resistor 1322 and capacitor 1323. This 5 microsecond pulse triggers one-shot multivibrator 1324 and causes it to produce a 1 microsecond pulse as a function of its RC network comprised of resistor 1325 and capacitor 1326.

The delay provided by one-shot multivibrators 1321 and 1324 provide a dwell time between data time and transmitter on time to ensure that the transmitter is in a condition to function when the first data bite arrives. Both multivibrators are RCA integrated circuits CD4047AE.

The output of multivibrator 1324 is applied to the J-K flipflop 1303 which is an RCA integrated circuit CD4027A. This flipflop is the start data transmission flipflop. A second flipflop is physically located on this integrated circuit and it is J-K flipflop 1329 which provides the actual transmitter start signal.

The start data transmission flipflop 1303 triggers a 500 microsecond multivibrator 1316 which produces a pulse with a duration which is a function of the 200 kilohm resistor 1318 and the 1 microfarad capacitor 1317. This extremely long duration pulse functions as a gate during which time one set of data may be serially processed. This multivibrator is an RCA integrated circuit CD4047AE as are the remaining one-shot multivibrators 1305, 1310, and 1313 of this circuit.

The 500 microsecond wide output pulse of one-shot multivibrator 1316 is applied to one input of a two input OR gate 1327 to provide an inhibit function via inverter 1328. This inhibit signal is applied to the transmitter hand control subassembly or the transmitter control subassembly. The OR gate is physically located on an RCA integrated circuit CD4071B which also contains OR gate 1308. The inverter 1328 is contained on the same integrated circuit as inverter 1350 of FIG. 29. It is an RCA integrated circuit CD4010A.

The second input to OR gate 1327 is provided by an output of the J-K flipflop 1303. The same input that was applied to initiate the 500 microsecond pulse of one-shot multivibrator 1316 is also applied to parallel-to-serial registers 1301 and 1302 as a reset pulse. This pulse also resets up/down counters 1319 and 1320 and J-K flipflop 1323. Thus J-K flipflop 1323 has a 5 microsecond pulse input applied to pin 7 by one-shot multivibrator 1321 and a reset signal applied approximately 1 microsecond after the termination of that pulse.

The 500 microsecond one-shot multivibrator 1316 receives an enabling signal from AND gate 1304 which is coupled to two inputs of the parallel-to-serial register 1302.

Figure 35:
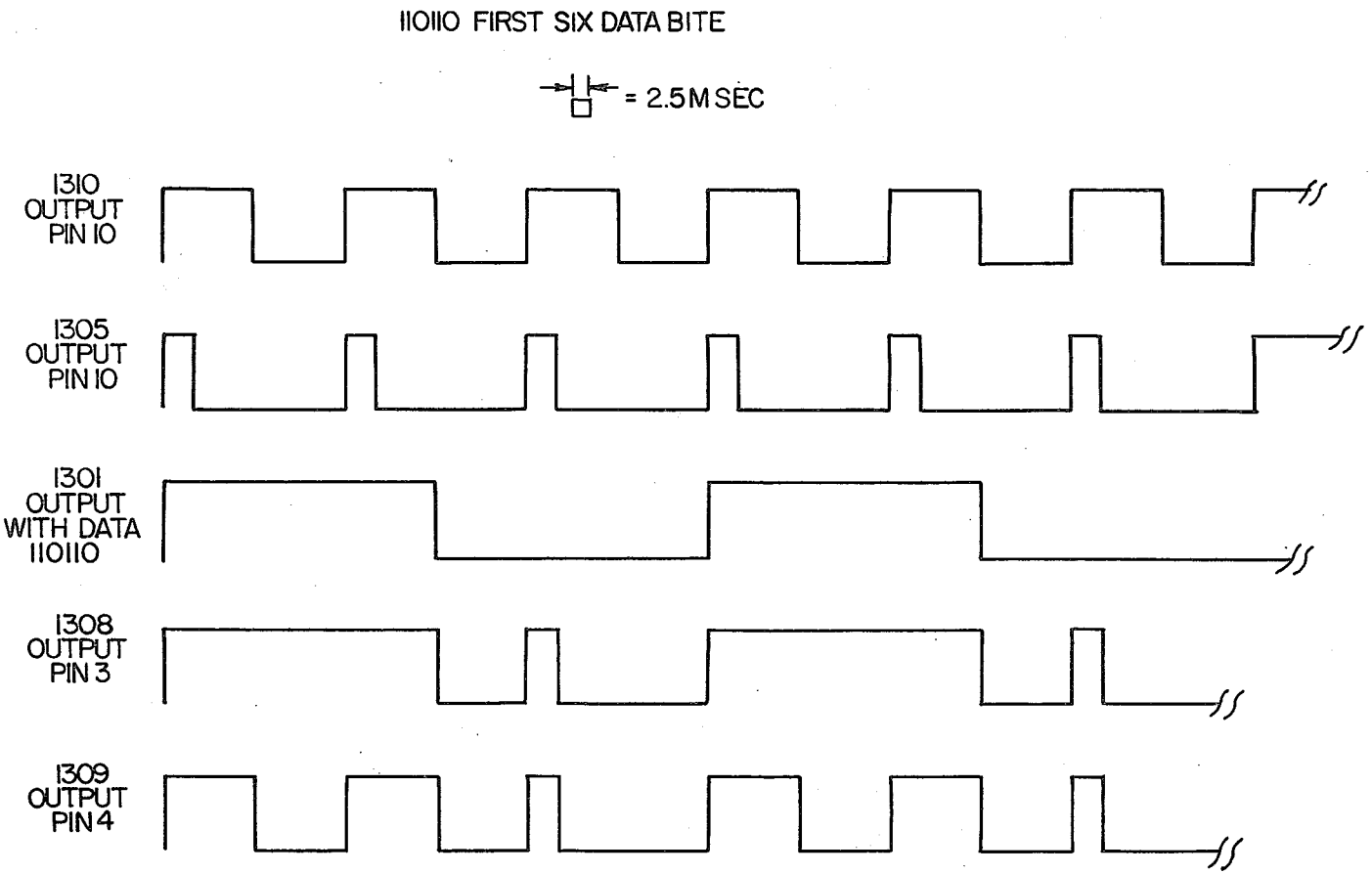
FIG. 35 is a transmitter register timing chart.

When J-K flipflop 1303 resets the parallel-to-serial shift registers 1301 and 1302, they are immediately loaded with the parallel data on the sixteen respective inputs and this data is then clocked out in serial fashion. FIG. 35 contains a timing diagram representing a hypothetical first six data bites out of the shift registers which are RCA integrated circuits CD4014A. The first pulse train across the top of the figure illustrates the output of one-shot multivibrator 1310 which is coupled with a second one-shot multivibrator 1313, both of which are adapted to produce 15 microsecond pulses as the result of the RC networks comprised of 27 kilohm resistors 1312 and 1315 and 0.022 microfarad capacitors 1311 and 1314. One-shot multivibrator 1310 is enabled by an output from the J-K flipflop 1303 so that an output from either parallel-to-serial shift registers 1301 or 1302 will initiate the operation of one-shot multivibrator 1313 which in turn initiates the operation of one-shot multivibrator 1310. The output of one-shot multivibrator 1310 is then applied to AND gate 1309. The two 15 microsecond one-shot multivibrators interact so that this output is alternately true or false or high and low for 15 microseconds as illustrated in the upper series of pulses in FIG. 35.

The positive going output of one-shot multivibrator 1310 is applied to pin 8 of one-shot multivibrator 1305 which produces a 5 microsecond pulse in response thereto as a function of the 20 kilohm resistor 1306 and 0.1 microfarad capacitor 1307 associated therewith. This creates a wave train of 5 microsecond pulses positioned at the beginning of each data bite time frame in sequence with the 15 microsecond pulses also commencing at the beginning of each data bite time frame.

The output of one-shot multivibrator 1305 is applied to one input of OR gate 1308 which provides a pulse to one input of AND gate 1309. Thus AND gate 1309 will always be trued during the duration of the output pulses of one-shot multivibrator 1305 and will have an output similar to that illustrated for pin 10 of 1305 in FIG. 35 unless positive data pulses are being clocked out of the parallel-to-serial register 1301.

Considering the data bites illustrated in FIG. 35, the output of register 1301 as it is applied to pin 1 of OR gate 1308 will cause AND gate 1309 to be enabled while positive outputs are provided from one-shot multivibrator 1310 on four different occasions to result in a serial data stream similar to the bottom wave train of FIG. 35 representing 110110.

Figures 28, 28B:
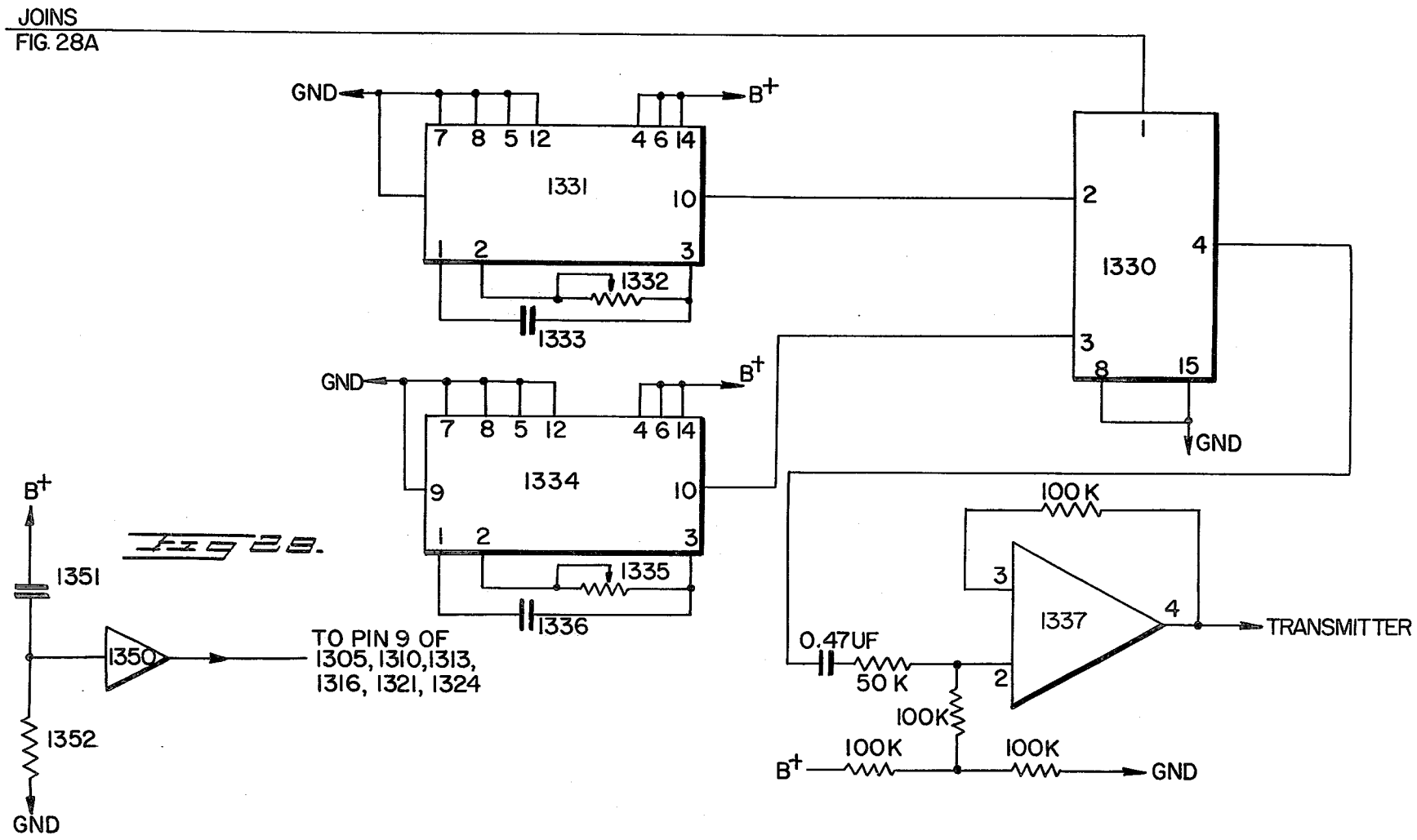

The serial data generated by the response of AND gate 1309 to the coincidence of the 15 microsecond pulse and the 5 microsecond pulse or the data pulses being clocked out of the serial to parallel register is applied to a two input multiplexer which is a National semiconductor integrated circuit DI74C157 identified in FIG. 28B as reference 1330.

Two integrated RCA circuits CD4047 are interconnected to form stable multivibrators 1331 and 1334 which are adapted to oscillate at audio frequencies as a function of their respective RC circuits formed of resistors 1332 and 1335 and capacitors 1333 and 1336.

A multiplexed signal comprised of one of the audio frequencies and the serial data pulse train is applied through an RC network to the positive input of operational amplifier 1337 which functions as a buffer driver and in a preferred embodiment it is a National semiconductor circuit LM2900. The output of operational amplifier 1337 is applied to the transmitter for further processing.

FIG. 29 is a buffer adapted to produce a pulse when power is first applied to the circuit through the action of the 100 kilohm resistor 1352 and the 0.01 microfarad capacitor 1351. The output pulse of buffer 1350 is applied to all of the one-shot multivibrators illustrated in FIG. 28A as a reset pulse.

Figure 30:
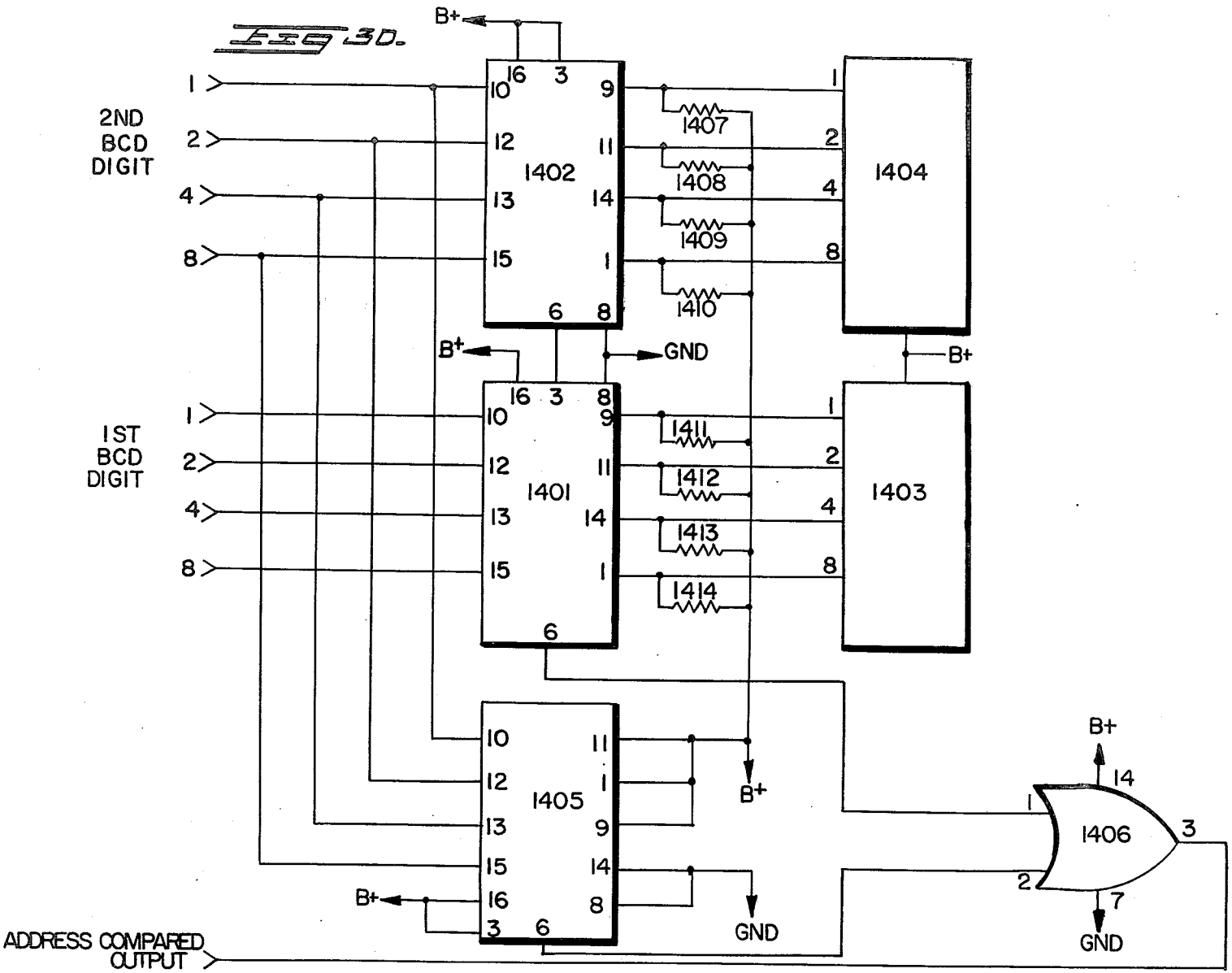
FIG. 30 is a schematic diagram of the target interface system.

The target interface assembly 64 of FIG. 18 is schematically presented in FIGS. 30, 31 and 32.

FIG. 30 presents the schematic diagram of the target interface system address selection means. This circuit incorporates three four bite magnitude comparators, 1401, 1402 and 1405 which are RCA integrated circuits CD4063. Comparator 1401 receives the first binary coded decimal data from the transmitter control assembly and compares it with the settings on switch 1403 which is a binary coded decimal switch adapted to provide digital outputs 1, 2, 4, and 8 to the comparator. The four inputs to the comparator from switch 1403 include individual 1.5 megohm resistors 1411 through 1414 coupled to ground. The second binary coded decimal digit is applied to comparator 1402 wherein it is compared with the settings of binary coded decimal switch 1404 in a manner similar to that accomplished by comparator 1401 with respect to binary coded decimal switch 1403. The second digit switch input to comparator 1404 includes individual resistors 1407 through 1410 to ground. These resistors are 1.5 megohm resistors as were the resistors utilized in the first digit circuit.

The second binary coded decimal digit from the transmitter control assembly 63 is applied to comparator 1405 in addition to comparator 1402. Comparator 1405 is hard wired by having pins 8 and 14 connected to ground and pins 1, 9 and 11 connected to the B+ supply. This arrangement simulates a binary coded decimal input for Number 11. Thus whenever a code 11 appears as the second digit, a comparison in comparator 1405 occurs and an output is applied to OR gate 1406 which supplies an address compared output.

The output of the second digit comparator is applied to an input of the first digit comparator so that if comparisons occur in both the first and second binary coded decimal comparators, a true output is applied to OR gate 1406 which in turn provides an address compared output signal. OR gate 1406 is one OR gate located on an RCA quad to input OR gate integrated circuit CD4071.

FIG. 31 presents schematically the circuit utilized to process the command functions and toggle functions within the transmitter target interface system. In this circuit the command functions are processed by a four bite latch/4-to-16 line decoder 1415 and the toggle functions of hits/burst, auto/hold, bob/off, and aux/off are processed by a parallel in/out shift register 1416. The four bite latch/4-to-16 line decoder 1416 is an RCA integrated circuit CD4514B and the parallel in/out shift register 1416 is an RCA integrated circuit CD4035.

The command functions applied to decoder 1415 are in binary coded decimal form and the outputs are individual signals representing the various functions of the target such as reverse, forward, reset, test, single fire, auto fire, interrogate, down and up.

The parallel in/out shift register 1416 functions as a storage means for the toggle functions.

A one microsecond data complete signal pulse is applied as a clock to both the parallel input/output shift register 1416 and to the decoder 1415. This pulse is also applied to one input of the two input AND gate 1431. The second input to that AND gate is the target up function from decoder 1415. Thus when a data complete signal is provided, an output will be channeled to OR gate 1433 if the target function is up. OR gate 1433 is on the same RCA integrated circuit CD4071 as OR gate 1406 of FIG. 30. The output of this gate is applied to the set inputs for J-K flipflops 1423 and 1435 and to the reset input of J-K flipflop 1446. These three flipflops are RCA integrated circuit CD4027.

Flipflop 1446 is used to store hit indication data to be transmitted to the control unit. The hit indication is retained until the target is given an up command, at which time the flipflop is reset via AND gate 1341 and OR gate 1433 as previously described.

The bob/off output of pin 14 of shift register 1416 is applied to one input of AND gate 1432. A second input to this two input AND gate is derived from the one microsecond, one-shot multivibrator 1436 which is triggered by a down command from operational amplifier 1441. The one-shot multivibrator creates the one microsecond pulse as a function of the RC circuit comprised of resistor 1437 and capacitor 1438 coupled to the RCA integrated circuit CD4047AE. The operational amplifier 1441 is a National semiconductor operational amplifier integrated circuit which also includes operational amplifiers 1439 and 1440. These three operational amplifiers receive the hits, up, and down functions respectively through a T type RC filter. For instance, the down input to 1441 includes a 1.3 kilohm resistor 1461 to ground, and in line 470 kilohm resistor 1462, a 0.01 microfarad capacitor 1464 interconnected between resistor 1462 and the series resistor 1465, which is also a 470 kilohm resistor, to ground. The up signal is coupled to operational amplifier 1440 and the hits signal is coupled to operational amplifier 1439 by identical RC circuits and all three amplifiers receive a B+ input through a resistive T comprised of a 51 kilohm resistor such as 1430 in series with a 910 kilohm resistor 1466 and a grounded 1.5 kilohm resistor 1467.

Thus when a down signal is provided by operational amplifier 1441 to the one-shot multivibrator 1436, it applies an enabling pulse to AND gate 1432 which, in response to the bob/off output of shift register 1416 will provide an input to OR gate 1433 which will cause that gate to set flipflops 1423 and 1435 and reset the hits storage flipflop 1446 as previously discussed with respect to an up command in the presence of a data complete command or signal.

When OR gate 1433 sets J-K flipflops 1423 and 1435 it causes flipflops to change state and create outputs at pins 1 for flipflop 1435 and 15 for flipflop 1423. These two positive states cause AND gate 1428 to conduct through a 100 kilohm resistor 1427. This resistor couples the signal to operational amplifier 1429 which then provides a signal to the target mechanism causing the target to be erected. This operational amplifier includes a negative feedback through a 200 kilohm resistor 1430. The amplifier is part of a National semiconductor integrated circuit LM2900. This integrated circuit also contains operational amplifier 1422 of the test circuit on this schematic.

When a down signal is provided at pin 10 of decoder 1415, it resets flipflop 1423 which removes the positive pulse at pin 5 of AND gate 1428. This action removes the up command to the target mechanism and the target is lowered.

AND gate 1434 is part of an RCA quad two-input AND integrated circuit CD4081 which also contains AND gates 1432, 1431, and 1428. When AND gate 1432 is trued by the output of the auto/hold function of shift register 1416 at pin 15, and the output of the hits operational amplifier 1439, it will provide an output to pin 4 of J-K flipflop 1435 causing that flipflop to be reset and disabling AND gate 1428 to cause the target to be lowered if it is in the up position. Thus a hit will cause the target to be lowered but, if the bob function has been selected it will reset J-K flipflops 1423 and 1435 one microsecond after the down function has been accomplished and sensed by operational amplifier 1441 to trigger one-shot multivibrator 1436 as previously discussed. This causes the target to raise automatically after it has been knocked down by a hit.

The two input multiplexer 1445 is a National semiconductor quad, two input multiplexer integrated circuit MM74C157. Its function is to select either the hits or the burst mode as a function of the output at pin 1 of the parallel in/out shift register 1416. When this output is high, the hit mode is selected and all hits registered through operational amplifier 1439 will appear at the output or pin 4 of the multiplexer from where they are coupled to the input of the J-K flipflop 1446 and to the counter.

If the burst mode has been selected, pin 1 of register 1416 will be low and this low input to pin 1 of multiplexer 1445 causes the multiplexer to couple hits out of the circuit only during periods when the 800 microsecond one-shot multivibrator 1442 is inactive. This one-shot multivibrator is an RCA integrated circuit CD4047 timed by the RC circuit comprised of resistor 1443 and capacitor 1444. It is triggered by a hit input at pin 6 from the output of operational amplifier 1439 so that when the burst mode has been selected, a first hit will register through the system but then the hits will be inhibited for the duration of the 800 microsecond pulse and its impact on pin 3 of multiplexer 1445.

This circuit contains a test function which includes an RCA integrated circuit adapted to function as a one-shot multivibrator which will produce a 20 microsecond pulse in response to an input because of the RC circuit comprised of an 82 kilohm resistor 1418 and a 0.1 microfarad capacitor 1419. One-shot multivibrator 14, when triggered by a test input from decoder 1415 at pin 8 of 1417 applies a 20 microsecond pulse through a 100 kilohm resistor 1420 to the negative input or pin 6 of operational amplifier 1422. Feedback is provided at the positive input to the operational amplifier via the 200 kilohm resistor 1471.

The 20 microsecond input to operational amplifier 1422 is also applied through a 200 kilohm resistor 1421 to the resistive network comprised of the 1.5 megohm resistor 1424 connected to B+ and the 1.5 megohm resistor 1425 connected to ground and an additional 200 kilohm resistor 1426 connected to the positive input of operational amplifier 1429. Thus when a test mode is selected a 20 microsecond target mechanism command will be generated via operational amplifier 1429.

The transmitter target interface circuitry is reset when power is applied by the reset circuit of FIG. 32 which is comprised of inverter 1468 and the RC newtork comprised of capacitor 1470 and 1469. The output of the inverter is applied to the reset inputs for one-shot multivibrators 1417, 1436, and 1442.

Figure 33A:
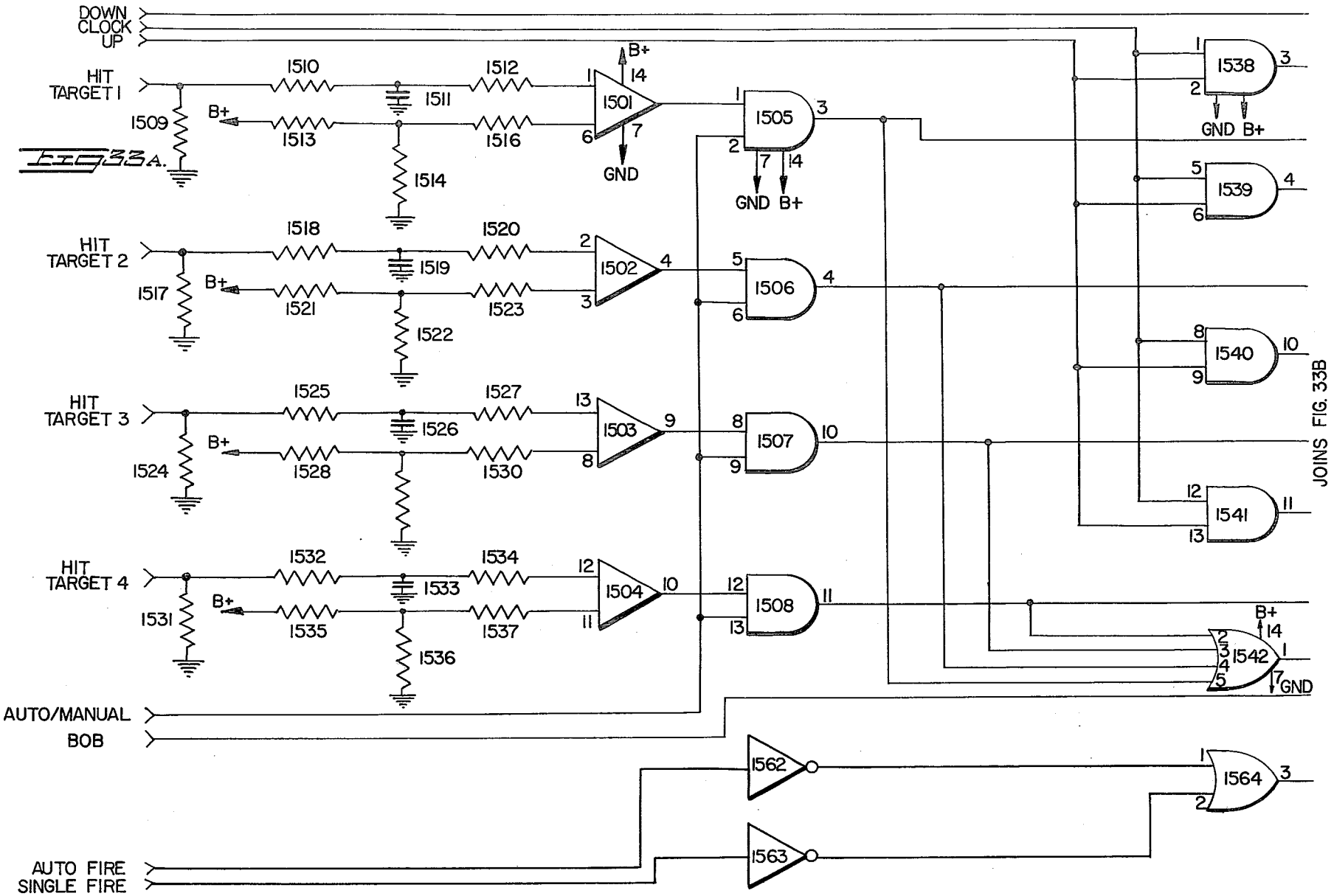
FIGS. 33A and 33B are a schematic diagram of the hostile fire simulator and multiple target interface system.
Figure 33B:
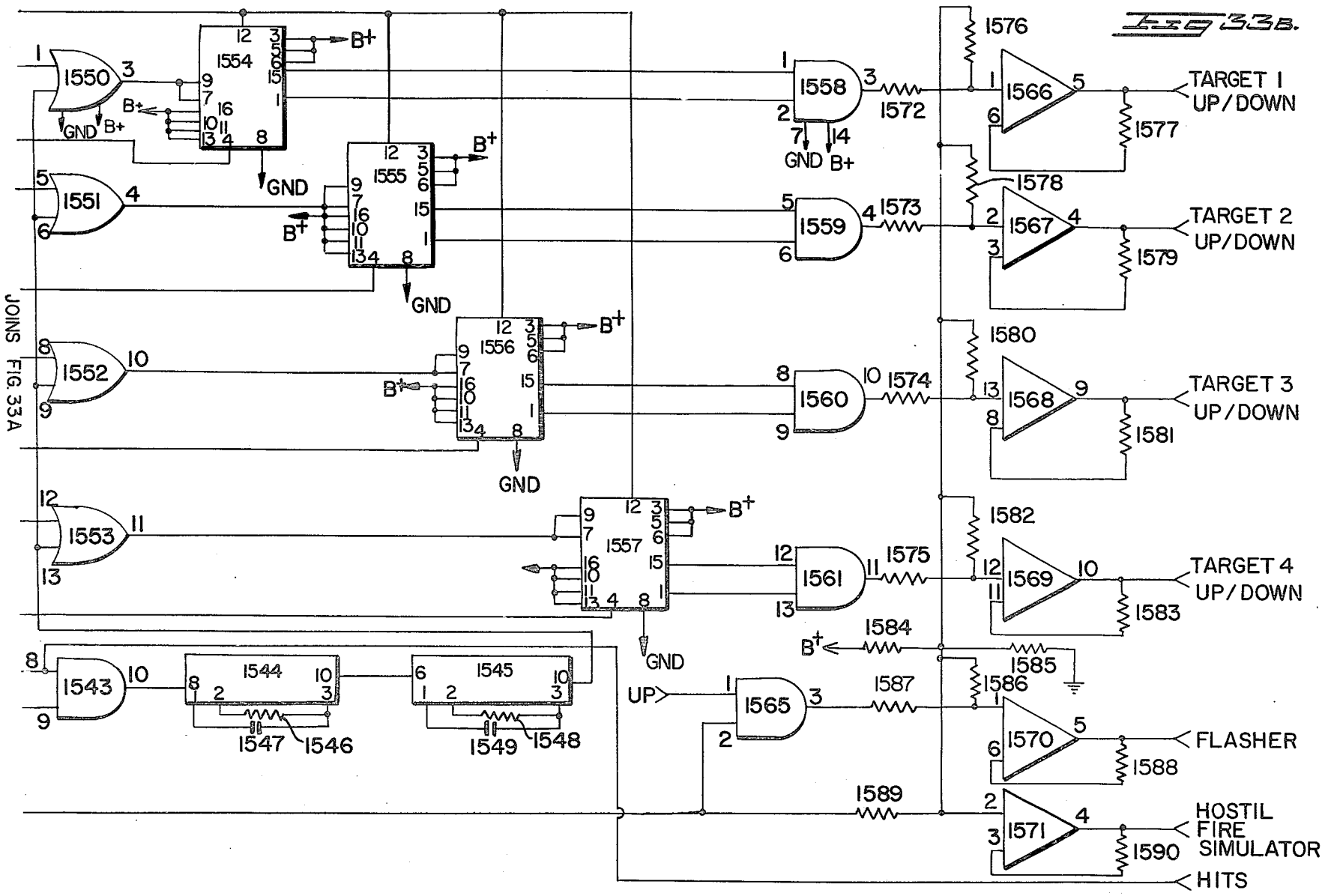

FIGS. 33A and 33B schematically represent the hostile fire simulator and a multiple target interface system capable of interfacing the up/down function for four separate targets. The four separate targets are controlled by four individual channels of this circuit which are identical so that an explanation of a single channel will suffice for all of them. For instance, note the similarity of the four operational amplifiers 1501 through 1504 and the associated line filters comprised of the RCT input and resistive T B+ input pad. The outputs of the four operational amplifiers are applied to individual AND gates 1505 through 1508 which are incorporated physically in an RCA quad to input AND gate integrated circuit CD4081B. The four operational amplifiers 1501 through 1504 are physically located on a National semiconductor quad operational amplifier integrated circuit LM2900.

The line receiver filters to the operational amplifiers of the individual hit channels are comprised of a 1.3 kilohm resistor 1509 in the target 1 channel and a pair of series connected 470 kilohm resistors 1510 and 1512 respectively which have a common connection to a 0.01 microfarad capacitor 1511. B+ is applied to the other input of the operational amplifier via a T network comprised of a 51 kilohm resistor 1513 in series with a 910 kilohm resistor 1516, both of which have a common connection to a 15 kilohm resistor 1514.

The outputs of the operational amplifiers 1501 through 1504 are applied to individual AND gates 1505 through 1508. These AND gates are enabled by second inputs which are connected in common to the auto/- manual input for the circuit when the AND gates are enabled, a hit in a target channel trues the AND gate and an output is applied to the reset input of one-half of the dual J-K flipflops 1554 through 1557 which are RCA integrated circuits CD4027. The pulse applied to pin 4 will reset the pin 1 output of the J-K flipflop and inhibit the associated AND gates 1558 through 1561, causing the target to be lowered. AND gates 1558 through 1561 are located in a common RCA quad to input AND gate CD4081B.

A similar function will occur when a down signal is applied to pin 12 of one of the four dual J-K flipflops 1554 through 1557. In this case, the pin 15 output goes low and inhibits the AND gate causing the down function to be transmitted to the target mechanism. When an up signal is applied to AND gates 1538 through 1541, which are RCA quad to input AND gates on a common integrated circuit CD4081B, a signal will be coupled through the associated OR gate provided a clock pulse is also applied to the other input of the AND gates. These associated OR gates, 1550 through 1553 are RCA quad to input OR gates CD4071B. An output from one of these four OR gates to its associated dual J-K flipflop resets both flipflops via pins 7 and 9 and causes a high or positive output at pins 1 and 15. This trues the associated AND gates 1558 through 1561 and causes a control signal to be applied through the 100 kilohm resistor 1572 through 1575. This signal is applied through the respective operational amplifier and coupled to the target mechanism causing the target to be raised.

When the bob function has been selected, AND gate 1543 is enabled so that when the output of one of the AND gates 1505 through 1508 causes a target to be lowered, the same impulse will be applied to the second input to AND gate 1543 through OR gate 1542 which trues AND gate 1543 and allows it to trigger one-shot multivibrator 1544. One-shot multivibrator 1544 generates a 1 microsecond pulse as a function of the RC circuit comprised of the 130 kilohm resistor 1546 and the 3 microfarad capacitor 1547. At the termination of the 1 microsecond pulse produced by one-shot multivibrator 1544, one-shot multivibrator 1545 generates a 1 microsecond pulse as a function of the RC network comprised of a 4 kilohm resistor 1548 and a 0.1 microfarad capacitor 1549. This 1 microsecond control pulse is applied through the four OR gates 1550 through 1553 to reset all of the dual J-K flipflops 1554 through 1557 and raise any target which may be in a down condition.

One-shot multivibrators 1554 and 1555 are RCA integrated circuits CD4047AE and the four input OR gate 1542 is an RCA integrated circuit CD4072B. AND gate 1543 is located on an RCA integrated circuit CD4081B which also contains AND gate 1565.

The auto fire and single fire functions are coupled through inverters 1562 and 1563 respectively to a two input OR gate 1564. The inverters are RCA integrated circuits CD4009 and the OR gate is a CD4071B. The output of this OR gate is applied through a 100 kilohm resistor 1589 to an operational amplifier 1571 coupled to the hostile fire simulator.

The output from OR gate 1564 is also applied to one input of a two input AND gate 1565. This AND gate is trued by an up function applied to its other input and it is adapted to energize the flasher through operational amplifier 1570. Thus the flasher circuitry will function only when targets are commanded up.

The invention has been described in detail with particular reference to preferred embodiments thereof, but it will be understood that variations and modifications can be offered within the spirit and scope of the invention.

We claim:

1. An automated target scoring system, comprising:
- a control panel comprising;
- a target status indicator for providing visual indications of target status, and
- a target function selection means for generating target function selection signals, and
- at least one target assembly comprising;
- a target responsive to said target function selection signals,
- a plurality of target status signal generation means responsive to said targets operational and physical condition,
- a piezoelectric accelerometer responsive to vibration of said target generated by projectile hits,
- a hits signal processor responsive to signals generated by said piezoelectric accelerometer for generating hit signals for activation of said target status indicator,
- a remote control interface means for conditioning said target function selection signals for transmission to said target assembly and for conditioning said target status signals and said hit signals from said target assembly for application to said control panel; and
- a target assembly interface means for conditioning said target status signals and said hit signals for transmission to said control panel via said remote control interface and for conditioning said target function selection signals for application to said target assembly.

2. An automated target scoring system as defined in claim 1 wherein said target comprises:
- a simulated quarry;
- a simulated quarry actuation means; and
- an actuation control circuit responsive to said target function selection means.

3. An apparatus as defined in claim 2 wherein said simulated quarry actuation means comprises:
- a bracket;
- means to secure said simulated quarry to said bracket;
- said piezoelectric accelerometer rigidly affixed to said bracket; and
- means to rotate said bracket from a first position to a second position wherein said simulated quarry is held horizontally by said bracket in said first position and vertically by said bracket in said second position.

4. An apparatus as defined in claim 3 wherein said means to rotate said bracket comprises:
- an electric motor responsive to said actuation control circuit and including a drive shaft;
- a transmission including an output lug, said transmission adapted to convert rotary motion of said drive shaft to linear motion of said output lug;
- a first elongated rigid linkage including a first bearing at one end and a second bearing at the other end thereof, said first bearing adapted to secure said first rigid member to said transmission lug;
- a torsion rod rigidly affixed to said bracket;
- a second rigid elongated linkage rigidly affixed to said torsion rod at one end and incorporating a bearing means at the other end;
- coupling means adapted to secure said first rigid bracket second bearing means to said second bracket bearing means and permit rotational movement therebetween;

a torsion rod bearing means; and mounting base means to rigidly support said torsion rod bearing means and said transmission in a spaced relationship adapted to cause said linear movement of said lug to be converted to rotational movement of said torsion rod through said first and second linkages.

5. An apparatus as defined in claim 4 comprising:

spring bias means coupled between said mounting means and said coupling means adapted to urge said bracket to said second position.

6. An apparatus as defined in claim 5 wherein said bracket comprises first and second arms rigidly affixed to opposite ends of said torsion rod, a simulated quarry attachment means rigidly affixed to said first and second arms, and said torsion rod bearing means comprises first and second bearings positioned adjacent to said first and second bracket arms respectively.

7. An apparatus as defined in claim 6 further including:

first and second microswitches; and cam means driven by said shaft and adapted to actuate said first and second microswitches.

8. An apparatus as defined in claim 7 further comprising means to electrically couple said first and second microswitches to said target status indicator.

9. An apparatus as defined in claim 7 wherein said actuation control circuit comprises:

a first signal inverter responsive to said target function selection means;

a first silicon controlled rectifier;

a first transistor responsive to said first inverter adapted to gate on said first SCR;

a positive voltage source coupled through said first microswitch to said first silicon controlled rectifier;

a second inverter responsive to the output of said first inverter;

a second silicon controlled rectifier;

a second transistor responsive to the output of said second inverter and adapted to gate on said second silicon controlled rectifier;

a source of negative potential coupled through said second microswitch to said second silicon controlled rectifier; and means to electrically connect said first and second silicon controlled rectifiers to said motor.

10. An apparatus as defined in claim 2 wherein said actuation control circuit comprises:

a first signal inverter responsive to said target function selection means;

a first silicon controlled rectifier;

a first transistor responsive to said first inverter adapted to gate on said first SCR;

a positive voltage source coupled through a first microswitch to said first silicon controlled rectifier;

a second inverter responsive to the output of said first inverter;

a second silicon controlled rectifier;

a second transistor responsive to the output of said second inverter and adapted to gate on said second silicon controlled rectifier;

a source of negative potential coupled through a second microswitch to said second silicon controlled rectifier; and means to electrically connect said first and second silicon controlled rectifiers to said motor.

11. An apparatus as defined in claim 2 wherein said target assembly comprises:

a mounting base adapted to support said simulated quarry actuation means and said actuation control circuit; and a projectile deflector rigidly secured to said mounting base and dimensioned and positioned to screen said simulated quarry actuation means and said actuation control circuit.

12. An apparatus as defined in claim 11 wherein said mounting base is circular with an upward deflected peripheral section.

13. An apparatus as defined in claim 12 wherein said peripheral section is deflected from the horizontal at an angle of between 30 and 60 degrees.

14. An apparatus as defined in claim 13, comprising:

a first winch assembly including a first cable mechanically coupled to said mounting base; and a second winch assembly including a cable mechanically secured to said mounting base.

15. An apparatus as defined in claim 14 wherein said first winch assembly comprises:

a towing cable including a plurality of electrical conductors;

a hollow shaft;

one end of said cable passing through said hollow shaft;

a hollow drum mounted on said hollow shaft by rotational bearing means;

an electric motor including a shaft;

drive means coupling said shaft to said hollow drum for rotational movement thereof; and level wind means driven by said shaft and adapted to maintain a predetermined number of turns of said cable about the outer periphery of said hollow drum and coil the remaining stored portion of said cable within said hollow drum.

16. An automated target scoring system as defined in claim 15, including a plurality of said first and second winch assemblies.

17. An automated target scoring system as defined in claim 15, wherein said second winch assembly comprises:

a towing cable;

a hollow shaft;

one end of said cable passing through said hollow shaft;

a hollow drum mounted on said hollow shaft by rotational bearing means;

an electric motor including a shaft;

drive means coupling said shaft to said hollow drum for rotational movement thereof; and level wind means driven by said shaft and adapted to maintain a predetermined number of turns of said cable about the outer periphery of said hollow drum and coil the remaining stored portion of said cable within said hollow drum.

18. An automated target scoring system as defined in claim 17, including a plurality of said first and second winch assemblies.

19. An apparatus as defined in claim 2 wherein said hit signal processor comprises:

a preamplifier;

a first differential amplifier capacitively driven by the output of said preamplifier, said first differential amplifier including an active feedback circuit and a capacitive and inductive output circuit;

a second differential amplifier responsive to the output of said first differential amplifier output circuit, said second differential amplifier including a reference voltage source;

said second differential amplifier and said reference voltage source adapted to prevent passage of signals having an amplitude less than a predetermined value;

a re-triggerable multivibrator responsive to the output of said second differential amplifier and adapted to sustain input pulses thereto an additional five milliseconds; p1 a ten millisecond one-shot multivibrator adapted to produce a ten millisecond pulse in response to an input from said re-triggerable multivibrator;

a differential amplifier responsive to the outputs of said re-triggerable multivibrator and said ten millisecond multivibrator, said third differential amplifier adapted to be inhibited by the output of said retriggerable multivibration;

a twenty millisecond multivibrator adapted to produce a twenty millisecond pulse in response to an output from said third differential amplifier; and a line driver responsive to the output of said twenty millisecond multivibrator.

20. An apparatus as defined in claim 2 wherein said means to couple the output of said hit signal processor to said target status indicator and said target function selection means to said target comprises an electrical cable.

21. An apparatus as defined in claim 1 wherein said hit signal processor comprises:

a preamplifier responsive to said piezoelectric accelerometer;

a filter responsive to a predetermined frequency range of said piezoelectric accelerometer output frequencies coupled to the output of said preamplifier;

a single amplitude detector responsive to the output of said filter;

a pulse generator responsive to the output of said amplitude detector and adapted to provide an output of a predetermined duration greater than said input;

a second pulse generator responsive to the output of said pulse generator and adapted to provide an output of a predetermined duration;

a logic circuit inhibited by the output of said pulse generator and enabled by the output of said second pulse generator when the output of said pulse generator is not present; and p1 a third pulse generator responsive to said logic circuit for producing a pulse of predetermined duration.

22. An apparatus as defined in claim 1 wherein said means to couple the output of said hit signal processor to said target status indicator and said target to said target function selection means, comprises:

a two-way radio network.

23. An apparatus as defined in claim 22 wherein said two-way radio network comprises:

a remote control unit receiver transmitter responsive to said control panel and a radio adapter receiver transmitter for each target assembly adapted to be responsive to said target and said hit signal processor.

24. An apparatus as defined in claim 23 wherein said remote control receiver transmitter comprises:

a target address switch matrix adapted to generate a digital code representing a predetermined target;

a function selection switch matrix adapted to generate a digital code representing predetermined target functions;

a mode switch matrix adapted to generate a predetermined code representative of the type of operational control;

an accumulator responsive to said target address switch matrix; p1 an encoder responsive to said function selection switch matrix;

a first register responsive to said mode switch martix, said accumulator and said encoder, said first register adapted to convert said parallel inputs to a serial output;

a modulator responsive to said first register;

a transmitter responsive to said modulator;

an antenna;

an antenna switching means adapted to couple said transmitter to said antenna;

a transmitter timing generator responsive to said mode switch matrix adapted to reset said register, key said modulator, and cycle said antenna switching means;

a receiver coupled to said antenna by said antenna switching means;

a demodulator responsive to said receiver; p1 a second register responsive to said demodulator and adapted to convert serial data into parallel data;

a receiver timing generator responsive to said demodulator and adapted to reset said register;

a comparator responsive to said accumulator and said second register and readout and display means responsive to said accumulator, said second register, and said comparator.

25. An apparatus as defined in claim 24 wherein said radio adapter receiver transmitter comprises: p1 an antenna; p1 an antenna switching means;

a receiver responsive to said antenna via said antenna switching means;

a demodulator responsive to said receiver;

a receiver register responsive to said demodulator and adapted to convert serially received coded data to parallel data words;

a decoder responsive to said receiver register;

a comparator responsive to said receiver register;

a receiver timing generator responsive to said demodulator and adapted to reset and receiver register;

a target interface adapted to store hit data from said hit signal processor and couple target function and command signals to said target;

an interrogation means responsive to said decoder and adapted to initiate readout of said hit data stored in said target interface;

an encoder responsive to said interrogate means and said target interface; p1 an address selector adapted to provide a code representing a predetermined target assembly;

a transmitter timing generator responsive to said interrogation means;

a transmitter register responsive to said encoder, said address selector, and said transmitter timing generator for converting parallel data to serial data words;

a modulator responsive to said transmitter register and said transmitter timing generator;

said transmitter timing generator adapted to control said antenna switch means; and a transmitter means responsive to said modulator and coupled to said antenna via said antenna switching means.

26. An apparatus as defined in claim 25 wherein said modulator comprises:

a first tone generator responsive to said serial data; an inverter responsive to said serial data;

a second tone generator responsive to said inverter;

an OR gate responsive to said first and said second tone generators;

said demodulator comprises a first tone decoder responsive to said receiver;

a second tone decoder responsive to said receiver;

an exclusive OR gate responsive to said first and said second tone decoders;

an AND gate responsive to said exclusive OR gate and said first tone decoder;

a fifty millisecond timer responsive to said AND gate;

a one millisecond timer responsive to said exclusive OR gate;

a reset OR gate responsive to said fifty millisecond timer and said one millisecond timer;p1 a bit start detector responsive to said first tone decoder;

time delay means responsive to said bit start detector; p1 pulse shift generator responsive to said time delay and adapted to provide a shift signal to said receiver register;

said receiver register adapted to store serial data from said first tone decoder and be reset by said reset OR gate;

a bit counter responsive to said bit start detector and said reset OR gate;

a bit number computer responsive to said bit counter; a twenty-five millisecond timer responsive to said first tone decoder;

an AND gate responsive to said bit number computer, said twenty-five millisecond timer, and said exclusive OR gate; and a pulse generator responsive to said AND gate and adapted to provide a signal indicative of a valid pulse received.

27. An automated target scoring system as defined in claim 1, wherein said remote control interface means comprises: p1 a transmitter hand control means responsive to predetermined signals of said target function selection signals for generating voltage levels representing said target function selection signals and for energizing respective ones of said target status indicators;

a transmitter register means responsive to said voltage levels generated by said transmitter hand control means for creating a pulse train having a pulse position for each of said voltage levels;

a modulator means responsive to the pulse train generated by said transmitter register means for combining said pulse train with an audio frequency and forwarding said combined signal to said target assembly interface means;

a demodulator responsive to said target assembly interface means for selectvely gating a pulse train from said target assembly interface means; a receiver register means responsive to said selectively gated pulse train for converting said pulse train into a plurality of individual, pulse oriented voltage levels representing said target status signals and said hit signals; and a receiver hand control means responsive to said voltage levels generated by said receiver register for generating a plurality of voltages for energizing predetermined ones of said target status indicators.

28. An automated target scoring system as defined in claim 1, wherein said target assembly interface means comprises:

a demodulator responsive to said target function signals from said remote control interface means for selectively gating said signals;

a receiver register adapted to convert said selectively gated signals into a plurality of voltage levels corresponding with individual target function selection signals;

a target interface control assembly responsive to said receiver register target function selection voltage levels for energizing selected target functions and storing said hit signals;

a hostile fire simulator responsive to predetermined target function selection voltage levels from said target interface control assembly;

a multiple target interface responsive to said target interface control assembly for coupling said hit signals and said target status signals from a plurality of targets to said target interface control;

a transmitter control means responsive to said target interface control for storing as individual voltage levels said hit signals and said target status signals;

a transmitter register responsive to said transmitter control hit signal and target status signal voltage levels for converting said voltage levels into a series pulse train having a pulse position for each function and potential hit; and a modulator for combining said pulse train with an audio frequency for transmission to said remote control interface means.

29. An automated target scoring system as defined in claim 1, wherein said target status indicator comprises:

a plurality of light emitting diodes and a binary coded decimal indicator; and said target function selection means comprises;

a first plurality of manually activated switches, a plurality of flipflops responsive to said first plurality of manually activated switches for generating a parallel pulse group representing a binary coded decimal, and a second plurality of manually actuated switches for selecting functions.

30. An automated target scoring system as defined in claim 1, including a plurality of said target assemblies.

31. A small arm training apparatus for training personnel in the use of rifles, handguns and similar weapons comprising a target assembly including a target movable between a first upright position and a second down position, actuating means for moving said target between said first and said second positions and a piezoelectric accelerometer supported on said target assembly and responsive to vibration of said target generated by projectile hits, a hits signal processor responsive to signals generated by said piezoelectric accelerometer for generating hit signal, said target assembly further including a bracket;

means to secure said target to said bracket; said piezoelectric accelerometer being rigidly affixed to said bracket; and said actuating means including means operatively connected to said bracket for rotating said bracket from a first position to a second position whereby said target is held vertically by said bracket in said first position and horizontally by said bracket in said second position, said means operatively connected to said bracket including an electric motor having a drive shaft;

a transmission including an output lug, said transmission adapted to convert rotary motion of said drive shaft to linear motion of said output lug;

a first elongated rigid linkage including a first bearing at one end and a second bearing at the other end thereof, said first bearing adapted to secure said first rigid member to said transmission lug;

a torsion rod rigidly affixed to said bracket;

a second rigid elongated linkage rigidly affixed to said torsion rod at one end and incorporating a bearing means at the other end;

coupling means adapted to secure said first rigid bracket to said second bracket bearing means and permit rotational movement therebetween;

a torsion rod bearing means; and, mounting base means to rigidly support said torsion rod bearing means and said transmission in a spaced relationship adapted to cause said linear movement of said lug to be converted to rotational movement of said torsion rod through said first and second linkage.

32. An apparatus as defined in claim 31 comprising:

spring bias means coupled between said mounting means and said coupling means adapted to urge said bracket to said second position.

33. An apparatus as defined in claim 31 wherein said bracket comprises first and second arms rigidly affixed to opposite ends of said torsion rod, target attachment means rigidly affixed to said first and second arms, and said torsion rod bearing means comprises first and second bearings positioned adjacent to said first and second bracket arms, respectively.

34. An apparatus as defined in claim 33 further including:

first and second microswitches; and, cam means driven by said shaft and adapted to actuate said first and second microswitches.

35. An apparatus as defined in claim 34 further comprising a target status indicator and means to electrically couple said first and second microswitches to a target status indicator.

36. An actuation control circuit for apparatus as defined in claim 34 comprising:

a first signal inverter responsive to the position of said target;

a first silicon controlled rectifier (SCR);

a first transistor connected to the gate of said first SCR and responsive to said first inverter for gating said first SCR on its ON condition;

a positive voltage source coupled through said first microswitch to said first silicon controlled rectifier;

a second inverter responsive to the output of said first inverter;

a second silicon controlled rectifier;

a second transistor connected to the gate of said second SCR and responsive to the output of said second inverter for gating said second SCR in its ON condition;

a source of negative potential coupled through said second microswitch to said second silicon controlled rectifier; and, means to electrically connect said first and second silicon controlled rectifiers to said motor for energizing said motor and driving said motor in said first or second direction in accordance with the ON condition of said first or said second SCR.

37. An apparatus as defined in claim 31 wherein said target assembly further includes:

a mounting base adapted to support said target actuating means and a projectile deflector rigidly secured to said mounting base and dimensioned and positioned to screen said actuation means and said hits signal processor so as to protect said actuating means from stray projectiles.

38. An apparatus as defined in claim 37 wherein said mounting base is circular with an upward deflected peripheral section.

39. An apparatus as defined in claim 38 wherein said peripheral section is deflected from the horizontal at an angle of between 30 and 60 degrees.

40. An apparatus as defined in claim 39, comprising:

a first winch assembly including a first cable mechanically coupled to said mounting base; and a second winch assembly including a cable mechanically secured to said mounting base.

41. An apparatus as defined in claim 40 wherein said first winch assembly comprises:

a towing cable including a plurality of electrical conductors;

a hollow shaft;

one end of said cable passing through said hollow shaft;

a hollow drum mounted on said hollow shaft by rotational bearing means;

an electric motor including a shaft;

drive means coupling said shaft to said hollow drum for rotational movement thereof; and level wind means driven by said shaft and adapted to maintain a predetermined number of turns of said cable about the outer periphery of said hollow drum and coil the remaining stored portion of said cable within said hollow drum.

42. A hit signal processor for generating hit signals in response to vibrations of a target generated by projectile hits comprising:

a piezoelectric accelerometer for generating an output signal in response to vibrations of the target;

a filter responsive to a predetermined frequency range of said piezoelectric accelerometer output signal;

an amplitude detector responsive to the output of said filter;

a first pulse generator responsive to the output of said amplitude detector and adapted to provide an output of a predetermined duration greater than said input;

a second pulse generator responsive to the output of said first pulse generator and adapted to provide an output of a predetermined duration;

a logic circuit inhibited by the output of said first pulse generator and enabled by the output of said second pulse generator when the output of said pulse generator is not present; and, a third pulse generator responsive to said logic circuit for producing a pulse of predetermined duration.

43. An apparatus as defined in claim 42 wherein said hit signal processor further includes:

a preamplifier coupled to the output of said piezoelectric accelerometer and means for coupling the output of said preamplifier to said filter.

44. A hit signal processor for generating hit signals in response to vibrations of a target generated by projectile hits comprising;

a piezoelectric accelerometer for generating an output signal in response to vibration of the target;

a first differential amplifier responsive to the output signal of said accelerometer;

a second differential amplifier responsive to the output of said first differential amplifier output circuit, said second differential amplifier including a reference voltage source;

said second differential amplifier and said reference voltage source adapted to prevent passage of signals having an amplitude less than a predetermined value;

a re-triggerable multivibrator responsive to the output of said second differential amplifier and adapted to sustain input pulses thereto an additional duration;

a first multivibrator adapted to produce a pulse longer in duration than said sustained pulses in response to an input from said re-triggerable multivibrator;

a third differential amplifier responsive to the outputs of said re-triggerable multivibrator and said first multivibrator, said third differential amplifier adapted to be inhibited by the output of said re-triggerable multivibrator;

a second multivibrator adapted to produce a pulse longer in duration than the output pulse of said first multivibrator in response to an output from said third differential amplifier; and a line driver responsive to the output of said third multivibrator.

45. An apparatus as defined in claim 44 wherein said first differential amplifier is capacitively driven by the output of said preamplifier, said first differential amplifier including an active feedback circuit and a capacitive and inductive output circuit.

46. An apparatus as set forth in claim 44 wherein said re-triggerable multivibrator responsive to the output of said second differential amplifier is adapted to sustain input pulses thereto an additional five milliseconds.

47. An apparatus as set forth in claim 44 wherein said one-shot multivibrator is adapted to produce a ten millisecond pulse in response to an input from said re-triggerable multivibrator, and said second multivibrator is adapted to produce a pulse of twenty millisecond duration.

48. An automated target scoring system, comprising a control panel having a target status indicator for providing visual indications of target status and a target function selection means for generating target function selection signals, and at least one target assembly comprising; a target responsive to said target function selection signals, a pluratity of target status signal generation means resonsive to said targets operational and physical condition, a piezoelectric accelerometer responsive to vibration of said target generated by vibration of the target due to projectile hits, wind gusts and flying debris striking the target, and a hits signal processor responsive to signals generated by said piezoelectric accelerometer for generating hit signals for activation of said target status indicator, said hit signal processor including a time domain filter for providing an output in response to said projectile hit signals which discriminates hits on the basis of amplitude, frequency and time to enable said scoring system to distinguish projectile hits from wind gusts and flying debris striking the target.

49. An automated target scoring system, comprising a control panel having a target status indicator for providing visual indications of target status and a target function selection means for generating target function selection signals, and at least one target assembly comprising; a target responsive to said target function selection signals, a plurality of target status signal generating means responsive to said targets operational and physical condition, a piezoelectric accelerometer responsive to vibration of said target and a hits signal processor responsive to signals generated by said piezoelectric accelerometer for generating hit signals for activation of said target status indicator, said hit signal processor including a time domain filter for providing an output in response to said hit signals which discriminates hits on the basis of amplitude, frequency and time said hit signal processor time domain filter being responsive to a predetermined frequency range of said piezoelectric accelerometer output signal; and said processor further including an amplitude detector responsive to the output of said filter; a first pulse generator responsive to the output of said amplitude detector and adapted to provide an output of a predetermined duration greater than said input; a second pulse generator responsive to the output of said first pulse generator and adapted to provide an output of a predetermined duration; a logic circuit inhibited by the output of said first pulse generator and enabled by the output of said second pulse generator when the output of said pulse generator is not present; and, a third pulse generator responsive to said logic circuit for producing a pulse of predetermined duration.

50. An automated target scoring system, comprising: a control panel having a target status indicator for providing visual indications of target status, and a target function selection means for generating target function selection signals, and at least one target assembly comprising; a target responsive to said target function selections signals, a plurality of target status signal generation means responsive to said targets operational and physical condition, a piezoelectric accelerometer responsive to vibration of said target and a hits signal processor responsive to signals generated by said piezoelectric accelerometer for generating hit signals for activation of said target status indicator, said hit signal processor including a time domain filter for providing an output in response to said hit signals which discriminates hits on the basis of amplitude, frequency and time, said hit signal procesor including a first differential amplifier responsive to the output signal of said accelerometer; a second differential amplifier responsive to the output of said first differential amplifier output circuit, said second differential amplifier including a reference voltage source; said second differential amplifier and said reference voltage source adapted to prevent passage of signals having an amplitude less than a predetermined value; a re-triggerable multivibrator responsive to the output of said second differential amplifier and adapted to sustain input pulses thereto an additional duration; a first multivibrtor adapted to produce a pulse longer in duration than said sustained pulses in response to an input from said re-triggerable multivibrator; a third differential amplifier responsive to the outputs of said re-triggerable multivibrator and said first multivibrator, and third differential amplifier adapted to be inhibited by the output of said re-triggerable multivibrator; a second multivibrator adapted to produce a pulse longer in duration than the output pulse of said first multivibrator in response to an output from said third differential amplifier; and a line driver responsive to the output of said third multivibrator.

51. A small arms training apparatus for training personnel in the use of rifles, handguns and similar weapons comprising a target assembly including a target movable between a first upright position and a second down position, actuating means for moving said target between said first and second positions and a piezoelectric accelerometer supported on said target assembly and responsive to vibration of said target generated by projectile hits, wind gusts and flying debris and a hits signal processor means responsive to signals generated by said piezoelectric accelerometer for generating hit signals, said hit signal processor including a time domain filter for providing an output in response to said projectile hit signals which discriminates hits on the basis of amplitude, frequency and time to enable said apparatus to distinguish between projectile hits and false hits from wind gusts and flying debris.

52. A small arms training apparatus for training personnel in the use of rifles, handguns and similar weapons comprising a target assembly including a target movable between a first upright position and a second down position, actuating means for moving said target between said first and said second positions, a piezoelectric accelerometer supported on said target assembly and responsive to vibration of said target generated by projectile hits, and a hits signal processor responsive to signals generated by said piezoelectric accelerometer for generating hit signals, said hit signal processor including a time domain filter for providing an output in response to said hit signals which discriminates hits on the basis of amplitude, frequency and time said hit signal processor time domain filter being responsive to a predetermined frequency range of said piezoelectric accelerometer output signal; and said processor further including an amplitude detector responsive to the output of said filter; a first pulse generator responsive to the output of said amplitude detector and adapted to provide an output of a predetermined duration greater than said input; a second pulse generator responsive to the output of said first pulse generator and adapted to provide an output of a predetermined duration; a logic circuit inhibited by the output of said first pulse generator and enabled by the output of said second pulse generator when the output of said pulse generator is not present; and, a third pulse generator responsive to said logic circuit for producing a pulse of predetermined duration.

53. A small arms training apparatus for training personnel in the use of rifles, handguns and similar weapons comprising a target assembly including a target movable between a first upright position and a second down position, actuating means for moving said target between said first and said second positions and a piezoelectric accelerometer supported on said target assembly and responsive to vibration of said target generated by projectile hits, and a hits signal processor responsive to signals generated by said piezoelectric accelerometer for generating hit signals, said hit signal processor including a time domain filter for providing an output in response to said hit signals which discriminates hits on the basis of amplituded, frequency and time, said hit signal processor including a first differential amplifier responsive to the output signal of said accelerometer; a second differential amplifier responsive to the output of said first differential amplifier output circuit; said second differential amplifier including a reference voltage source; said second differential amplifier and said reference voltage source adapted to prevent passage of signals having an amplitude less than a predetermined value; a re-triggerable multivibrator responsive to the output of said second differential amplifier and adapted to sustain input pulses thereto an additional duration; a first multivibrator adapted to produce a pulse longer in duration than said sustained pulses in response to an input from said re-triggerable multivibrator; a third differential amplifier responsive to the outputs of said re-triggerable multivibrator and said first multivibrator, said third differential amplifier adapted to be inhibited by the output of said re-triggerable multivibrator; a second multivibrator adapted to produce a pulse longer in duration than the output pulse of said first multivibrator in response to an output from said third differential amplifier; and a line driver responsive to the output of said third multivibrator.

* * * * *

UNITED STATES PATENT AND TRADEMARK OFFICE

CERTIFICATE OF CORRECTION

PATENT NO. : 4,222,564

DATED : September 16, 1980

INVENTOR(S) : Donnie ALLEN et al.

It is certified that error appears in the above-identified patent and that said Letters Patent are hereby corrected as shown below:

Column 33, line 12 after "milliseconds" (first occurrence) delete "pl". Column 33, line 52 after "and" delete "pl. Column 34, line 10 after "matrix" delete "pl". Column 34, line 27 after "receiver" delete "pl". Column 34, line 37 after "comprises" delete "pl". Column 34, line 38 after "antenna" delete "pl". Column 34, line 56 after "interface" delete "pl". Column 35, line 22 after "times" delete "pl". Column 35, line 25 delete "pl". Column 35, line 45 after "comprises" delete "pl".

Signed and Sealed this

*Eighteenth* Day of *November 1980*

[SEAL]

*Attest:*

SIDNEY A. DIAMOND

*Attesting Officer*

*Commissioner of Patents and Trademarks*